US005887233A

United States Patent [19]

Abe et al.

[11] Patent Number: 5,887,233

[45] Date of Patent: Mar. 23, 1999

[54] PHOTOGRAPHIC DEVELOPING APPARATUS AND ELECTRIFYING APPARATUS

[75] Inventors: Jun Abe; Noriaki Yamazaki; Akihiko Noda; Shinichi Kuramoto; Shota Oba, all of Kanagawa, Japan

[73] Assignee: Fuji Xerox Co., Ltd., Tokyo, Japan

[21] Appl. No.: 895,556

[22] Filed: Jul. 16, 1997

[30] Foreign Application Priority Data

| | | | |
|---|---|---|---|
| Jul. 19, 1996 | [JP] | Japan | 8-207619 |
| Aug. 16, 1996 | [JP] | Japan | 8-234754 |
| Aug. 22, 1996 | [JP] | Japan | 8-239865 |

[51] Int. Cl.[6] ..... G03G 15/02; G03G 15/08

[52] U.S. Cl. ..... 399/284; 250/326; 361/225; 399/168; 399/28; 399/285

[58] Field of Search ..... 399/168, 169, 399/171, 252, 270, 272, 274, 281, 284, 285, 50, 55; 361/225, 229; 250/324, 325, 326; 430/120, 902

[56] References Cited

U.S. PATENT DOCUMENTS

| | | | |
|---|---|---|---|
| 4,194,830 | 3/1980 | Ohnuma et al. | 399/284 |
| 4,558,334 | 12/1985 | Fotland | 250/325 X |
| 4,709,298 | 11/1987 | Hosono et al. | 250/326 X |
| 4,766,468 | 8/1988 | Hosono et al. | 399/284 X |
| 5,153,435 | 10/1992 | Greene | 250/326 |
| 5,245,502 | 9/1993 | Genovese | 361/225 |
| 5,621,506 | 4/1997 | Hosaka et al. | 399/284 |
| 5,655,188 | 8/1997 | Nagamori et al. | 361/225 X |

FOREIGN PATENT DOCUMENTS

| | | |
|---|---|---|
| 50-843 | 1/1975 | Japan . |
| 50-13661 | 5/1975 | Japan . |
| A-54-17030 | 2/1979 | Japan . |
| A-58-150975 | 9/1983 | Japan . |
| A-60-83972 | 5/1985 | Japan . |
| A-62-291678 | 12/1987 | Japan . |
| U-63-20160 | 2/1988 | Japan . |
| U-63-138560 | 9/1988 | Japan . |
| A-64-62675 | 3/1989 | Japan . |
| A-64-73367 | 3/1989 | Japan . |
| B2-3-27117 | 4/1991 | Japan . |
| A-4-51266 | 2/1992 | Japan . |
| A-4-249270 | 9/1992 | Japan . |
| A-4-268587 | 9/1992 | Japan . |
| 4-291375 | 10/1992 | Japan . |
| 5-181346 | 7/1993 | Japan . |
| 8-006352 | 1/1996 | Japan . |
| 8-062937 | 3/1996 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

A photographic developing apparatus which visualizes a latent image formed on an image carrier is disclosed which includes:

a developing powder carrier provided so as to be opposite to the image carrier;

a layer forming member for forming a thin layer of developing powder over a circumferential surface of the developing powder carrier;

a charge imparting member which is provided so as to be opposite to the developing powder carrier and causes an electric field between the charge imparting member and the developing powder carrier; and an electrification control member which is interposed between the charge imparting member and the developing powder carrier, and limits an ionization area caused by electric discharge in the electric field by receiving an intermediate electric potential between the electric potential of the charge imparting member and the electric potential of the developing powder carrier.

36 Claims, 39 Drawing Sheets

| | |
|---|---|
| GAP LENGTH l | 100μm |
| DEGREE OF MIGRATION | |
| POSITIVE ION μ+ | 1.32 (cm/s) / (v/cm) |
| ELECTRON μ- | $2.11 \times 10^2$ (cm/s) / (v/cm) |
| IONIZATION COEFFICIENT α | 1147 TIMES/cm |

| | |
|---|---|
| GAP LENGTH l | 100μm |
| DEGREE OF MIGRATION | |
| POSITIVE ION μ+ | 1.32 (cm/s) / (v/cm) |
| ELECTRON μ- | $2.11 \times 10^2$ (cm/s) / (v/cm) |
| IONIZATION COEFFICIENT α | 1147 TIMES/cm |

PHOTOGRAPHIC DEVELOPING APPARATUS AND ELECTRIFYING APPARATUS

BACKGROUND OF THE INVENTION

The present invention relates to an electrifying apparatus which is used in an electrophotographic apparatus or an electrostatic recorder and imparts electric charge to toner used by an image carrier or for developing purposes, as well as to a photographic developing apparatus which visualizes an electrostatic latent image formed on the image carrier by applying toner to the image.

One-component developing equipment or two-component developing equipment is known as a photographic developing apparatus for visualizing a latent image formed on an image carrier by adhering toner to the latent image. Such developing equipment has a rotatable developing powder carrier positioned opposite the image carrier. A toner layer or a magnetic brush consisting of two-component developing powder is formed on the developing powder carrier and is carried to the developing area opposite the image carrier. An electric field is formed by applying a developing bias voltage between the developing powder carrier and the image carrier, thereby transferring toner to the latent image on the image carrier.

In order to properly apply the toner to the latent image on the image carrier in the developing area, the developing equipment must impart a predetermined amount of electric charges to the toner. In two-component developing equipment, electric charges are imparted to toner by mixing and stirring it with carriers which are separated from the toner in terms of friction and electrification ranks. A charge-control agent applied to the outside of toner particles may be liberated from the toner particles, and the thus-liberated charge-control agent may contaminate the surface of the carrier. For this reason, if the carrier is used for a long period of time, the liberation of the charge-control agent makes it impossible to impart an electric charge to the toner, whereby the developing powder must be exchanged. Further, a toner concentration controller or developing powder stirring equipment is needed to maintain a toner-carrier ratio constant. Further, a magnet must be provided in the developing powder carrier in order to hold a magnetic carrier, and this makes the developing equipment rather complicated.

In contrast, one-component developing equipment is widely used as an developing apparatus capable of overcoming the foregoing drawbacks of the two-component developing equipment. In one-component developing equipment, a toner layer forming member which is made of an elastic member and is called a blade is pressed against the developing powder carrier. A toner layer of one component is formed on the developing powder carrier, and an electric charge is imparted to the toner by friction and electrification from the toner layer forming member. The blade generally has a low electrification capability for toner, and hence it is difficult to sufficiently electrify all the toner particles. Therefore, there are so-called toner particles of the opposite polarity which are electrified with a polarity opposite to a desired polarity. These toner particles of the opposite polarity cause a background fog. Specifically, the frictional electrification caused by the blade provides a slight chance of bringing the toner in contact with the blade, and toner, particularly, fine toner, may be fed past the layer forming area without being frictionally electrified, so that the toner is not electrified. An increase in pressure for pressing the toner layer forming member against the toner is thought to promote frictional electrification. However, binder resin contained in the toner is fused by frictional heat, and the resultantly-condensed toner becomes attached to the blade, thereby resulting in white lines being formed on an image.

To solve the problems with developing equipment which frictionally electrifies the toner, there is proposed a developing apparatus which directly imparts an electric charge to the toner. Examples of such a developing apparatus are disclosed in; e.g., the Unexamined Japanese Utility Model Application Publication No. Sho 63-138560, the Japanese Patent Application Publication Nos. Sho 64-62675, Sho 54-17030, and Sho 62-291678, or illustrated in FIGS. 14 and 15.

The developing apparatus disclosed in the Unexamined Japanese Utility Model Application Publication No. Sho 63-138560 has a developing powder carrier and a corona discharge unit positioned so as to be opposite to it. An electric charge is imparted to the toner by exposing a toner layer to ions having a desired polarity. The use of the corona discharge unit results in soiling of a corotron wire, which in turn causes an uneven electric discharge. Further, a high voltage is necessary to ionize an air layer in the vicinity of the corotron wire. In terms of the stability of an electric discharge in the axial direction, a voltage of more than 5 kV is necessary. A large amount of ozone is produced at the time of an electric discharge.

In contrast, a developing apparatus illustrated in FIG. 14 is comprised of a developing powder carrier 202; a toner layer forming blade 203 which is pressed against the developing powder carrier to form a toner layer; a cylindrical electrifying member 204 which is supported while remaining in contact with or being spaced a very small distance away from the developing powder carrier 202; a toner supply member 205 which supplies toner to the developing powder carrier; a developing bias power source 206; and a toner electrifying power source 207. An electric discharge is produced across the gap between the cylindrical electrifying member 204 and the developing powder carrier 202 by applying a voltage to the cylindrical electrifying member 204 from the toner electrifying power source 207. Ions or electrons resulting from the electric discharge are adhered to the toner, whereby the toner is electrified.

The developing apparatus illustrated in FIG. 15 has a developing powder carrier 212 and a layer forming blade 213 positioned so as to be pressed against it. A voltage for electrifying toner is applied to the layer forming blade 213 from a power source 217, whereby an electric discharge is produced across the gap between the layer forming blade 213 and the developing powder carrier 212. A toner layer is formed on the developing powder carrier 212, and the toner is electrified.

The developing apparatus as illustrated in either FIG. 14 or 15 does not need the high voltage required for the corona discharge unit and produces only a small amount of ozone.

In a conventional electrophotographic apparatus or an electrostatic recording apparatus, a corona discharge device is commonly used for electrifying a photosensitive material or an image carrier. This corona discharge device is classified into corotrons and scorotrons. FIG. 48 is a schematic representation showing a scorotron type corona discharge device. This corona discharge device is principally made up of a discharge wire 102*q* laid so as to be opposite to an article to be electrified, and a conductive shield 103*q* provided so as to surround the discharge wire 102*q*. The discharge wire 102*q* has a line size of about several tens micrometers, and a high voltage is applied to the article from the discharge wire 102*q*. Ions are produced in the vicinity of the discharge wire 102*q* as a result of corona discharge, and the article is electrified by the migration of the thus-produced ions. Such a corona discharge device is capable of imparting a sufficient amount of discharged electric charges to the article by means of a simple structure.

Devices for electrifying a photosensitive material are disclosed in the Unexamined Japanese Patent Application Publication Nos. Sho 50-843, Sho 50-13661, Sho 64-73367, Sho 58-150975, Hei 4-51266, and Hei 4-249270.

In the devices disclosed in the Unexamined Japanese Patent Application Publication Nos. Sho 50-843, Sho 50-13661, and Sho 64-73367, a roller which is a resistive material is brought into contact with a photosensitive material, and electric discharge is continually produced in a minute gap by applying a voltage between the roller and the photosensitive material, whereby the photosensitive material is electrified. In the devices disclosed in the Unexamined Japanese Patent Application Publication Nos. Sho 58-150975, Hei 4-51266, and Hei 4-249270, a high-resistance conductive film is brought into contact with a photosensitive material, and electric discharge is produced in a minute gap by applying a voltage between the photosensitive material and the film.

Devices for electrifying toner are disclosed in the Unexamined Japanese Patent Application Publication Nos. Sho 60-83972, Sho 54-17030, Sho 62-29-1678, and Sho 64-62675.

In the device disclosed in the Unexamined Japanese Patent Application Publication No. Sho 60-83972, a plurality of electrodes are stacked on an insulating substrate in a side-by-side configuration, and they are positioned so as to be opposite to a developing roller having a thin layer of toner formed thereon. A discharge voltage is applied between the electrodes and the toner layer, thereby electrifying the toner provided on the developing roller.

In the devices disclosed in the Unexamined Japanese Patent Application Publication Nos. Sho 54-17030, Sho 62-291678, and Sho 64-62675, as shown in FIGS. 49A and 49B, a roller-shaped electrode 112*q* or a blade-shaped electrode 113*q* to which a voltage is applied is brought into contact with a toner layer formed on a developing roller 111*q*, and toner is electrified by electric discharge produced across a minute gap.

In general, in a photographic developing apparatus which employs one-component developing powder, toner is electrified by means of the friction between a developing roller and a toner layer regulating member pressed against the developing roller. It is difficult to impart sufficient electric charges to all toner particles by this method, and the toner of the opposite polarity is produced. To prevent the toner of the opposite polarity, there is proposed a technique of electrifying toner provided on the developing roller through use of the aforementioned electrifying device.

The toner of the opposite polarity is toner which is electrified with the polarity opposite to intended plurality. In a case where a latent image is developed by electrifying the toner with negative polarity, positively-electrified toner is the toner of the opposite polarity.

However, the developing equipment illustrated in either FIG. 14 or 15 has the following problem.

Specifically, if the voltage applied to the cylindrical electrifying member 204 is smaller than the discharge voltage, an electric charge is not sufficient because of the toner having high volume resistivity in the developing equipment illustrated in FIG. 14. Therefore, the toner cannot be electrified with the desired polarity. In contrast, toner can be electrified by means of electric discharge produced from electrodes by increasing the applied voltage. As shown in FIG. 16, electron avalanche occurs in the gap between the cylindrical electrifying member 204 and the developing powder carrier 202 as a result of ionization associated with electric discharge. Consequently, there are positive ions and electrons or negative ions which are opposite in polarity to each other in the discharge area. Similarly, electron avalanche occurs in the gap between the layer forming blade 213 and the developing powder carrier 212 in the developing equipment shown in FIG. 15, and there are eventually ions which are opposite in polarity to each other (see FIG. 17).

For these reasons, even if an attempt is made to adhere electrons or negative ions to toner in order to electrify the toner with a desired polarity (a negative polarity in this example), the discharge area is filled with positive ions and electrons or negative ions resulting from ionization. Therefore, both the positive ions and electrons or negative ions are imparted to the toner. As a result; the toner electrified as a result of electric discharge has a mixture of polarities; namely, particles of the opposite polarity are produced. The toner of the opposite polarity is thought to occur in the foregoing manner. The opposite polarity indicates a positive electric charge if the toner is desired to be electrified with a negative polarity as is in the present example. However, if the toner is electrified with a positive polarity, a negative polarity corresponds to the opposite polarity. A relative density between electrons and positive ions developing in the space between two parallel electrodes is calculated with reference to the paper entitled "Electric Discharge Phenomenon" (Tokyo Denki University Press., Atushi HONDA, pg. 64). As shown in FIG. 18, positive ions are also present in the vicinity of a positive electrode (i.e., the developing powder carrier), and the toner particle is several thousand times larger than an electron (i.e., the toner particle measures 7 to 10 $\mu$m). In short, if an attempt is made to electrify toner with a negative polarity by electric discharge, a fair amount of positively charge toner is processed at the same time.

For example, as described in the article entitled "Recent Development and Actual Use of Electrophotographic Developing System and Toner" (Publishing Department of Nihon Kagaku Joho Co., Ltd., Manabu TAKEUCHI, pg. 303), the toner of the opposite polarity produced in the developing equipment is found to constitute 20% by weight by measuring the polarity of each of toner particles and the amount of electric charges in the form of profiles. If the toner particles of the opposite polarity are carried to the developing area as a result of the rotation of the developing powder carrier, picture degradation, such as background fog, arises in a developed toner image, resulting in a degraded image. Further, the toner of the opposite polarity on the developing powder carrier, splashes up and soils the inside of the developing equipment.

The present invention has been conceived in view of the foregoing problem, and the object of the present invention is to provide a photographic developing apparatus which produces an image with superior quality over a long period of time by preventing toner from being electrified with the opposite polarity and uniformly electrifying the toner on a developing powder carrier.

However, the previously-described photographic developing apparatus which directly imparts an electric charge to toner by applying a voltage to the toner present the following problems.

Specifically, if toner still remaining on a developing powder carrier is carried to the photographic developing apparatus after passage of a developing area, toner is additionally supplied to the residual toner, and an electric charge is again imparted to this toner by an electrifying device. As a result, an electric charge is imparted to the toner in small quantities as a result of electrification of the toner by the first rotation of a developing powder carrier, or in the first developing cycle. However, the amount of electric charges imparted to the toner shows a tendency to gradually increase in the next cycle and to become stable after passage of several cycles. The reason for this is that the toner still remaining on the developing powder carrier after completion of a developing operation is again carried to an electrifying area, thereby increasing the amount of electric charges of the toner. In contrast, toner newly applied to the developing powder carrier is not electrified in as large quantities as is the residual toner by one electrifying operation. Consequently, there arises a difference in the amount of electric charges among the toner particles.

As described above, the amount of electric charges imparted to the toner is instable. If the amount of electric charges changes from cycle to cycle, the quantity of toner to be transferred at the time of developing operation is also changed, thereby resulting in degradation of picture quality called ghosts.

Further, there is a case where an excessive electric current flows into the developing powder carrier as a result of local electric discharge developing between electrodes, toner is eventually electrified to such an extent that it would not contribute to the developing of an image. As a result, the quantity of toner to be transferred increases.

There is proposed a photographic developing apparatus as shown in, e.g., FIG. 28 or 29 as means for stabilizing the amount of electric charges imparted to developing powder.

As shown in FIG. 28, the photographic developing apparatus is comprised of a developing powder carrier 202*p*, a layer forming blade 203*p* which is pressed against the developing powder carrier 202*p* to thereby form a layer of toner; a cylindrical electric charge imparting member 204*p* which is supported so as to come into contact with the developing powder carrier 202*p*; a toner supply member 205*p* for feeding toner to the developing powder carrier 202*p*; a cylindrical conductive member 206*p* which is brought into pressed contact with the toner still remaining on the developing powder carrier after completion of the developing operation; a developing bias power source 207*p*; and a power source 208*p* for electrifying toner. The conductive member 206*p* is provided upstream from the toner supply member 205*p* in the direction of rotation of the developing powder carrier 202*p* and is electrically grounded.

In this photographic developing apparatus, electric discharge is caused across the gap between the electric charge imparting member 204*p* and the developing powder carrier 202*p* by applying a voltage to the electric charge imparting member 204*p*. Toner is electrified by applying ions or electrons caused by the electric discharge to the toner. An electrostatic latent image is developed through use of the toner, and the toner still remaining on the developing powder carrier after passage of the developing area is brought into contact with the conductive member 206*p*, thereby eliminating the electric charge of the toner. A photographic developing apparatus as described in, e.g., the Unexamined Japanese Patent Application Publication No. Hei 4-268587 is analogous to the foregoing photographic developing apparatus.

A photographic developing apparatus shown in FIG. 29 is comprised of a layer forming blade 213*p* which is positioned so as to be pressed against a developing powder carrier 212*p*; a power source 218*p* for applying a voltage used for electrifying toner; and a conductive film member 216*p* to be pressed against the toner provided on the developing powder carrier. The photographic developing apparatus causes electric discharge across the gap between the layer forming blade 213*p* and the developing powder carrier 212*p*, thereby forming a layer of toner on the developing powder carrier 212*p* and electrifying the toner. The conductive film member 216*p* eliminates the electric charge of the residual toner after passage of a developing area.

A charge removing mechanism of the photographic developing apparatus shown in FIG. 28 or 29 is merely a grounded conductive member. As a result of the conductive member physically coming into contact with the toner, a small degree of distortion occurs in the formation of the toner layer. However, the effect of reducing the extent to which the toner is electrified can be hardly expected.

The present invention has been conceived in view of the foregoing drawbacks, and the object of the present invention is to provide a photographic developing apparatus which ensures superior picture quality without ghosts by stabilizing the amount of electric charges imparted to toner provided on a developing powder carrier in each developing cycle.

However, the previously-described conventional electrifying devices have the following drawbacks.

Specifically, in the device which produces corona discharge, electric discharge develops in other directions in addition to the direction in which there is an electrode loaded with an insulating material to be electrified, and the device must be provided with a conductive shield in order to stabilize electric discharge. If this shield moves too close to a discharge electrode (i.e., the discharge wire) in an ionization area, spark discharge will be produced. For this reason, the shield must be spaced a given distance or more away from the discharge electrode. Since the size of the shield cannot be reduced so much, it is difficult to make the electrifying apparatus compact.

In an electrifying device in which a voltage is applied to a roller-shaped or film-shaped electrode consisting of a resistor, the electrode loaded with an article to be electrified is moved close to a resistor, and electric discharge is produced by means of an electric field directed toward the electrode. As a result, the article is imparted with an electric charge. Therefore, the gap between the resistor and the electrode must be set to a very small distance in order to produce a discharge electric field. In many cases, they are in contact with each other. Foreign articles adhered to the discharge electrode cause disturbances in the electrifying characteristics of the electrifying device. In short, in a case where this electrifying device is used for electrifying a photosensitive material, the electrifying characteristics of the electrifying device become changed or uneven by adhesion of a toner-including substance or paper dust still remaining on a photosensitive material to the discharge electrode or by abrasion of the surface of the discharge electrode.

In contrast, the following problems are encountered in electrifying toner through use of an electrifying device in which a voltage is applied to a roller-shaped or blade-shaped blade consisting of a resistor.

As shown in FIGS. 50A and 50B, a resistor electrode to which a voltage is applied is brought into contact with a toner layer, and electric discharge is produced between an electrode and a developing roller or between the electrode and a member for carrying toner. Therefore, the toner is present in the electric discharge occurring between them, so that the toner particles are not uniformly electrified with desired polarity; namely, so-called the toner of the opposite polarity is produced.

The following phenomenon will be considered as a mechanism to produce the toner of the opposite polarity.

Electron avalanche occurs as a result of ionization associated with electric discharge, whereby electric charges of opposite polarities such as positive ions and electrons or negative ions are produced. As illustrated in FIGS. 50A and 50B, since the toner is in the discharge area, both the positive ions and electrons or negative ions contribute to imparting of electric charges to the toner, thereby resulting in the toner of the opposite polarity.

For example, a relative density between electrons and positive ions produced in the space between two parallel electrodes is calculated with reference to the paper entitled "Electric Discharge Phenomenon" (Tokyo Denki University Press., Atushi HONDA, pg. 64). As shown in FIGS. 51A and 51B, positive ions are also present in the vicinity of a positive electrode (i.e., a developing powder carrier), and a toner particle is several thousand times larger than an electron (i.e., the toner particle measures 7 to 10 $\mu$m). Further, as a result of the polarity of and the amount of electric particles of each toner particle being measured in the form of profiles by the method described in the article entitled "Recent Development and Actual Use of Electrophotographic Developing System and Toner" (Publishing Department of Nihon Kagaku Joho Co., Ltd., Manabu TAKEUCHI, pg. 303), the toner of the opposite polarity constitutes 20% by weight.

The electrifying device disclosed in the Unexamined Japanese Patent Application No. Sho 60-83972 also has similar problems.

The present invention has been conceived in view of the foregoing drawbacks, and the object of the invention is to provide an electrifying apparatus which prevents foreign articles from sticking to the electrifying apparatus by keeping the electrifying apparatus from contact with an article to be electrified, and which can be made compact.

Another object of the present invention is to provide a compact electrifying apparatus which prevents the generation of the toner of the opposite polarity by imparting an electric charge of single polarity to toner when it is used for electrifying the toner, and which can form an image with a stable picture quality over a long period of time in an image forming apparatus.

"The present invention has been conceived in view of the foregoing drawbacks in the prior art, and the object of the present invention is to provide a photographic developing apparatus which substantially uniformly electrifies toner provided on a developing powder carrier by preventing generation of toner of the opposite polarity, and which ensures superior picture quality over a long period of time. Another object of the present invention is to provide a photographic developing apparatus which ensures superior picture quality without ghosts by stabilizing the amount of electric charge of toner provided on a developing powder carrier every developing cycle. Further object of the present invention is to provide an electrifying apparatus which prevents attachment of foreign articles by keeping it out of contact with an article to be electrified and can be rendered compact.

SUMMARY OF THE INVENTION

To this end, the present invention provides a photographic developing apparatus including an image carrier having a latent image formed thereon by means of an electrostatic potential difference, a developing powder carrier provided in close proximity to or in contact with the image carrier, and a layer forming member for forming a thin layer of developing powder on the circumferential surface of the developing powder carrier, wherein the developing powder formed in a thin layer is selectively transferred so as to visualize the latent image in a developing area where the image carrier is opposite to the developing powder carrier, the improvement being characterized by comprising:

an electric charge imparting member which is provided so as to be in close proximity to and opposite the developing powder carrier and produces an electric field between the developing powder carrier and the electric charge imparting member; and an electrification control member which is provided between the electric charge imparting member and the developing powder carrier and limits an ionization area to be caused by electric discharge within the electric field by receiving an intermediate electric potential between the electric potential of the electric charge imparting member and the developing powder carrier.

In the developing apparatus, provided that a mean value of the voltage applied to the electric charge imparting member is Vb (V) and a mean value of the voltage applied to the electrification control member is Vm (V), a voltage is independently applied to the electric charge imparting member and the electrification control member so as to satisfy $|Vb|>|Vm|$. A voltage greater than a discharge start voltage is applied to the gap between the electric charge imparting member and the developing powder carrier, and the voltage is set so as not to cause electric discharge but to form an electric field between the electric charge imparting member and the developing powder carrier in such a way that ions having a desired polarity or electrodes migrate toward the developing powder carrier.

In this developing equipment, a strong electric field is formed by applying the voltage greater than the discharge start voltage between the electric charge imparting member and the electrification control member, so that electric discharge occurs between them. The electric discharge causes ionization, so that positive ions, electrons, and negative ions occur as a result of electron avalanche. However, the ionizing area is limited between the electric charge imparting member and the electrification control member, and ionization does not occur in the area between the electrification control member and the developing powder carrier; namely, the area in which toner is formed into a thin layer on the developing powder carrier. For this reason, ionization does not occur in the range of the thickness of the toner layer, and therefore positive and negative ions are not produced.

A small electric field has already been produced between the electrification control member and the developing powder carrier before electric discharge is commenced. Either positive or negative ions developing between and in the vicinity of the electric charge imparting member and the electrification control member are drawn to the developing powder carrier by the action of the electric field produced between the electrification control member and the developing powder carrier. The ions are then imparted to the toner layer formed on the developing powder carrier, enabling electrification of toner with the desired polarity.

In this developing equipment, both the electric charge imparting member and the electrification control member can be formed from conductive or semi-conductive material. In order to produce electric discharge continuously, it is desirable to make either of the members from semi-conductive material. Semi-conductive materials have a volume resistivity of about $10^3$ Ω·cm–$10^{11}$ Ω·cm.

The electrification control member can be formed into any shape as required, so long as it is capable of uniformly electrifying toner. For example, the electrification control member can be formed into a mesh member consisting of conductive or semi-conductive material or into a porous thin-plate member consisting of conductive or semi-conductive material. This electrification control member may be supported with a very small gap between it and electric charge imparting member or may be supported while partially remaining in contact with the electric charge imparting member. A porous thin mesh or plate member consisting of insulating material may be interposed between the electric charge imparting member and the electrification control member.

In the developing apparatus, the electric charge imparting member is cylindrically formed and is supported so as to be rotatable around the axis. The electrification control member is formed into a cylinder which is larger in diameter than that of the electric charge imparting member. The electric charge imparting member includes this electrification control member, and the electrification control member can be supported so as to rotate while the charge imparting member is opposite to the developing powder carrier with a part of the electrification control member between them.

In this developing apparatus, the electric charge imparting member, the electrification control member, and the developing powder carrier rotate together, and electric discharge develops in the vicinity of a very small gap between the electric charge imparting member and the electrification control member. The electric discharge is limited to the area where the electric charge imparting member is opposite to the developing powder carrier. Therefore, an excessive electric current can be prevented from flowing between the electric charge imparting member and the electrification control member.

In the developing apparatus, the electrification control member is sandwiched between the electric charge imparting member and the developing powder carrier and can be rotatively driven so as to follow the rotation of the developing powder carrier. As a result, the supporting structure of the electrification control member can be simplified, enabling prevention of an increase in the size of the developing apparatus or of complication of the same.

The electrification control member is supported so as to be spaced away from the developing powder carrier and is rotatively driven in such a way as to cause the electrification control member to differ from the developing powder carrier in terms of circumferential speed. As a result, electrode portions or openings formed in the electrification control member move relatively to the surface of the developing powder carrier, enabling further uniform electrification of developing powder on the developing powder carrier.

In the developing apparatus of the present invention, the electrification control member is formed from a conductive or semi-conductive layer stacked on the surface of the electric charge imparting member via the insulating layer. As a result, there is prevented leakage of an electric charge between the electric charge imparting member and the electrification control member, enabling appropriate electrification of toner by stable electric discharge. Assembling the electrification control member and the electric charge imparting member into one unit results in the developing apparatus not being increased in size and complexity. The insulation layer is a layer formed from material having a volume resistivity of more than $10^{12}$ Ω·cm.

In this developing apparatus, the electric charge imparting member can be supported so as to be integral with the layer forming member. As a result, a developing powder layer is formed on the developing powder carrier by the layer forming member, and electric discharge can be produced in the vicinity of the electric charge imparting member. For this reason, formation of the developing powder layer and electrification of developing powder become feasible, enabling an increase in the size of the developing apparatus and complications related to that.

The electric charge imparting member is made up of a rotatable cylindrical member or an endless-belt-like member capable of rotating and can be driven so as to differ from the developing powder carrier in terms of circumferential speed. As a result, an electrode layer which is the electrification control member moves relatively to the surface of the developing powder carrier. Although electric discharge is microscopically irregular, the developing powder attached to the surface of the developing powder carrier can be uniformly electrified.

At least a part of the electrification control member may be coated with semi-conductive or insulating material. As a result, there is prevented leakage of electric charges between the electric charge imparting member and the electrification control member or between the electrification control member and the developing powder carrier. Further, electrification failures due to a drop in the electric potential of the surface of the electric charge imparting member is prevented, thereby enabling proper electrification of toner.

In this developing apparatus, the ionization area in which ions are produced is limited to the electric charge imparting member by placing the electrification control member between the electric charge imparting member and the developing powder carrier which is a substance to be electrified. A scorotron electrifying apparatus used as a conventional electrifying unit is similar in structure to the developing apparatus of the present invention. More specifically, in the scorotron electrifying apparatus, a discharge wire is an electric charge imparting member of the present invention, and a substance to be electrified is a photosensitive material or a developing powder carrier. Further, the electrification control member of the present invention can be considered to correspond to a screen grid electrode to be interposed between the discharge wire and the substance to be electrified. However, the diameter of the discharge wire employed by the scorotron electrode is as small as 30 to 100 μm, and hence the electric field caused by the discharge wire in the area between a shield electrode surrounding the discharge wire and the substance to be electrified causes ionization only in the vicinity of the discharge wire. Only the ions or electrodes migrate in the vicinity of the shield and the substance to be electrified. In short, the screen grid electrode makes the potential of the substance to be electrified constant by limiting the migration of ions having the same polarity as that of the substance to be electrified or migration of electrodes, but does not actively limit the ionization area caused by electric discharge. In contrast, the developing apparatus of the present invention separates the electric field developing between two minute electrodes into the ionization area and the electron/ion migration area to thereby prevent ions having a polarity opposite to that of the substance to be electrified from developing in large amounts in the vicinity of the substance to be electrified. Thus, the developing apparatus of the present invention is completely different in function from the conventional scorotron.

To solve these problems, the present invention provides a photographic developing apparatus including an image carrier having a circumferential surface on which an electrostatic latent image is formed, and a developing powder carrier which is positioned so as to be opposite to the image carrier in such a way that a circumferential surface of the developing powder carrier can rotate, wherein the electrostatic latent image is visualized by bringing a thin layer of one-component developing powder formed on the developing powder carrier into close proximity to or contact with the image carrier, the apparatus comprising:

an electrifying device which comes into close proximity to or contact with the thin layer of developing powder formed on the developing powder carrier to thereby impart electric charge to developing powder particles; and charge reducing means which reduces the amount of electric charge of the developing powder particles provided on the developing powder carrier after the developing powder carrier has passed through a developing area in which it comes into close proximity to or contact with the image carrier.

In such a photographic developing apparatus, the quantity of electric discharge of developing powder particles still remaining on the developing powder carrier after passage of the developing area is reduced by the charge reducing means. After a layer of developing powder has been formed on the developing powder carrier, electric charge is imparted to the developing powder particles provided on the developing powder carrier by the electrifying device, enabling substantially uniform electrification of the developing powder. For this reason, even if the developing powder still remaining on the developing powder carrier after completion of the developing operation is repeatedly carried to the developing area, the amount of electric charges imparted to the developing powder can be substantially uniformly stabilized at the time of developing operation. Accordingly, the developing characteristics of the photographic developing apparatus are prevented from changing from cycle to cycle, and hence a superior ghost-free image can be produced.

Preferably, the charge reducing means has conductive or semi-conductive electrodes which are provided so as to come into close proximity to or contact with the developing powder layer formed on the developing powder carrier, and a.c. voltage is applied to the electrode. At this time, a peak-to-peak voltage of the a.c. voltage is preferably set so as to be more than twice larger than a discharge start voltage and to prevent leakage of electric charge. As a result, a vibrating electric field is caused between the electrodes and the developing powder carrier, and electric discharge is caused across a minute gap between the electrodes and the developing powder carrier by a large potential difference between them. As a result of electric discharge, the amount of electric charges imparted to developing powder particles provided on the developing powder carrier converges on the vicinity of 0 V, whereby the amount of electric charges is substantially uniformly reduced. In this way, the layer of developing powder formed on the developing powder carrier can be electrified by the electrifying device after the amount of electric charges of the developing powder particles has been substantially uniformly reduced. Accordingly, the developing powder can be electrified to a substantially uniform electric potential without a difference in the amount of electric charges between developing cycles.

Preferably, a frequency "f" of the a.c. voltage is set into a range in which toner cannot travel back and forth pursuant to the frequency of the a.c. voltage. As a result, the toner does not travel back and forth within the gap between the electrodes and the developing powder carrier pursuant to the vibrating electric field, thereby preventing the toner from sticking to the electrodes.

Preferably, the charge reducing means doubles as a layer forming member which is pressed against the developing powder carrier to thereby form a thin layer on the developing powder carrier, and a portion of the layer forming member which is in contact with the developing powder carrier is made of semi-conductive resilient material. Further, a.c. voltage is preferably applied to this contact portion.

In this photographic developing apparatus, the charge reducing means doubles as the layer forming member and forms a layer of developing powder on the developing powder carrier, thereby enabling a reduction in the amount of electric charges of the developing powder particles. Consequently, the photographic developing apparatus can be reduced in size. Further, the developing powder can be prevented from traveling back and forth pursuant to the vibrating electric field by correctly setting the frequency of the a.c. voltage, which in turn prevents developing powder from sticking to the layer forming member. As described above, even if the charge reducing means doubles as the layer forming member, the amount of electric charges of the developing powder particles can be substantially uniformly reduced, which makes it possible to prevent the developing powder from being unstably electrified from cycle to cycle.

Preferably, the electrifying device comprises an electric charge imparting member which is placed so as to be in close proximity to and opposite to the developing powder carrier and produces an electric field between the electric charge imparting member and the developing powder carrier; and an electrification control member which is interposed between the electric charge imparting member and the developing powder carrier and limits an ionization area caused by electric discharge in the electric field by receiving an intermediate electric potential between the electric potential of the electric charge imparting member and the electric potential of the developing powder carrier.

In this photographic developing apparatus, a voltage greater than a discharge start voltage is applied between the electric charge imparting member and the electrification control member, and a voltage is applied to the electric charge imparting member and the developing powder carrier so as to prevent electric discharge from occurring between them. As a result, there is formed an electric field which permits migration of ions of desired polarity or electrons toward the developing powder carrier in the vicinity of the developing powder carrier. A strong electric field is formed between the electric charge imparting member and the electrification control member by the applied voltage, thereby causing electric discharge between them. Ionization results from the electric discharge, and positive ions and electrons or negative ions occur as a result of electron avalanche. However, the ionization area is limited to a space between the electric charge imparting member and the electrification control member, thereby preventing ionization from occurring in a space between the electrification control member and the developing powder carrier; namely, the area of the developing powder carrier in which the layer of developing powder is present. Therefore, ionization does not occur in the range of the thickness of the developing powder layer, so that neither positive nor negative ions are produced. In contrast, an electric field which is too small to cause electric discharge is formed between the electrification control member and the developing powder carrier. Either positive or negative ions caused by the action of the electric field between the electric charge imparting member and the electrification control member are attracted toward the developing powder carrier, and the thus-attracted ions are imparted to the developing powder layer formed on the developing powder carrier. As a result, the toner can be electrified with a desired polarity.

As shown in FIG. 30 or 31, in a case where the electrification control member is not provided between the electric charge imparting member and the developing powder carrier, ionization will occur across a small gap between them if electric discharge occurs between them. As a result, electrons or ions of opposite polarity are caused by the influence of electron avalanche. Since electron avalanche due to ionization occurs in any place within the minute gap, ionization occurs even in an air layer contained in the developing powder layer formed on the developing powder carrier. Consequently, ions of opposite polarity occurred in the vicinity of the toner are imparted to the toner, thereby resulting in so-called toner of the opposite polarity.

As described above, the photographic developing apparatus can reduce the toner of the opposite polarity and prevent electrostatic aggregation of toner particles. Further, the developing powder carrier and the developing powder layer can be prevented from electrostatically sticking to the developing powder carrier firmly, enabling prevention of an increase in the amount of toner to be transferred.

Preferably, the charge reducing means is pressed upstream in the direction of rotation of the developing powder carrier and doubles as a layer forming member which forms a thin layer on the developing powder carrier, and a portion of the layer forming member which is in contact with the developing powder carrier is formed from semi-conductive resilient material. Moreover, preferably, a.c. voltage is applied to this contact portion, and the electrification control member is formed semi-conductive layer on or semi-conductive layer on the surface of the electric charge imparting member via an insulating layer. Further, the electric charge imparting member is preferably supported so as to be integral with the charge reducing means.

In this photographic developing apparatus, the charge reducing means is pressed upstream in the direction of rotation of the developing powder carrier, whereby a layer of developing powder is formed on the developing powder carrier in an upstream direction, and the amount of electric charges of the developing powder particles is reduced. Then, electric charge can be imparted to the developing powder particles in a downstream position. Therefore, the developing powder can be substantially uniformly electrified, and cyclic variations in the electrifying voltage can be prevented. Further, the photographic developing apparatus can be rendered compact.

To solve the previously-described problems, the present invention provides an electrifying apparatus which is positioned so as to be spaced away from and in proximity to an article to be electrified provided on a conductive substrate, and which applies an electric charge to the article, the apparatus comprising:

a first electrode which is made of a resistor and is positioned so as to be opposite to the developing powder carrier; a second electrode which is made of a resistor or conductor; which is positioned so as to be opposite to the substrate; and which is placed in close proximity to and in parallel with the first electrode without a contact; wherein that a voltage is applied so as to continually produce electric discharge between the first and second electrodes; and the electric potentials of the first and second electrodes are set in such a way that an electric field (which permits migration of electrons or ions having an electric charge of polarity with which the article is electrified toward the substrate) is formed between the first or second electrode and the substrate.

In the electrifying apparatus, the first electrode is preferably be formed from a resistor, or a high-resistance conductor. The second electrode is preferably be formed from a conductor. The reason for this is that either the first or second electrode is formed from a resistor in order to continually produce electric discharge between the first and second electrodes to thereby prevent spark discharge between the electrodes. Consequently, the volume resistivity of the resistor can be set in a range in which electric discharge can be continually produced while preventing spark discharge.

In the electrifying apparatus, the first and second electrodes may be of the same polarity or the opposite polarity. The electric potentials of the electrodes are determined so as to maintain the electric potential required for continual production of electric discharge between the electrodes in terms of the relationship between the electric potential of the substrate and the electric potentials of the electrodes. In short, the electric potentials of the electrodes are set so as to produce an electric field (that guides toward the substrate electrons or ions of polarity with which the article is to be electrified) between the first or second electrode and the substrate. More specifically, the electric potentials will be determined in the following manner.

If the article is to be negatively electrified, an electric field is produced between the electrode having a lower electric potential (i.e., a negative electrode) and the substrate. Therefore, the electrode is set so as to have a lower electric potential (i.e., to become negative) with reference to the substrate. At this time, either the other electrode (i.e., the electrode having a higher electric potential) or the substrate may have a higher electric potential to such an extent that the potential difference between them does not produce an electric field which would otherwise cancel the electric field produced between the substrate and the electrode having a lower potential. More specifically, if an electric field is formed as a result of the other electrode (i.e., the electrode having a higher electric potential) having become considerably higher in potential than the substrate, the migration of ions of the opposite polarity may occur. The electric potentials of the electrodes and the substrate are set so as to avoid the foregoing problem.

In this electrifying apparatus, a potential difference greater than a discharge start voltage is imparted between the first electrode and the second electrode opposite to the second electrode, thereby producing electric discharge between the electrodes. As a result, ionization results from electric discharge between the electrodes, resulting in electron avalanche. The electron avalanche causes positive ions and electrons or negative ions between the electrodes, and the thus-produced ions and electrons migrate between the first and second electrodes. If the potential difference between the first and second electrodes is increased to a much greater extent, an electrical current flows to the substrate positioned in close proximity to and opposite to the first or second electrode after the potential difference has passed a certain threshold value. As a result, the article placed on the substrate can be electrified with a single electric charge.

In the electrifying apparatus, the first electrode and the second electrode are positioned in close proximity to and opposite to each other, and neither the first nor second electrode requires a large volume. The interval between the substrate loaded with the article and the electrodes is very small, and hence the overall electrifying apparatus can be rendered compact. Further, since the electrifying apparatus can electrify the article without contact between them, variations in the electrifying characteristics of the electrifying apparatus can be prevented which would otherwise be caused by adhesion of foreign substances to the electrifying apparatus.

In the electrifying apparatus, the process of the phenomenon in which an electrical current flows from the first or second electrode to the substrate can be estimated as follows.

When the electric discharge developing between the first and second electrodes has increased to a certain extent, there is also an increase in the quantity of positive ions and electrons or negative ions which migrate along the electric field between the electrodes. The profile of electric charges extends off the discharge electric field produced between the electrodes by a collision between ions or electrons or by repulsive force of the electric charges. This causes changes in the profile of an electric field in the vicinity of the electrodes, and the ions or electrons (which are ionized by the strong electric field in the vicinity of the area where the electrodes are opposite to each other) flow to the substrate loaded with the article from the first or second electrode along the path of the electric field.

Preferably, the first and second electrodes are placed so as to be in close proximity to and opposite to a belt or cylinder whose circumferential surface is endlessly movable, and they are supported so as to be spaced a uniform interval away from and opposite to the circumferential surface in its widthwise direction.

This electrifying apparatus can uniformly electrify an insulating article in its widthwise direction, so long as the belt or cylinder has a conductive substrate loaded with the insulating article. For example, if the belt or cylinder is an image carrier used in an electrophotographic apparatus or an electrostatic recorder, the circumferential surface of the image carrier can be uniformly electrified to the desired potential. Further, if the belt or cylinder is a developing roller or a developing powder carrier to be provided opposite to the image carrier, a thin layer of toner formed on the circumferential surface of the developing roller or the developing powder carrier can be uniformly electrified in its widthwise direction.

Preferably, a feeding member consisting of conductive material is bonded to substantially the entire reverse side of each of the first and second electrodes consisting of a resistor; and the second and first electrodes have a uniform thickness in the widthwise direction of the circumferential surface of the belt or cylinder.

In this electrifying apparatus, a conductive feeding member is bonded to the electrodes consisting of a resistor, and a voltage is applied to the electrodes. When electric discharge is produced between the first and second electrodes, a potential difference arises even in one electrode between the surface of the electrode facing the other electrode and the area of the electrode remaining in contact with the feeding member. However, in this electrifying apparatus, the feeding member is bonded on substantially the entire reverse sides of the electrodes, and the electrodes have a uniform thickness. Consequently, the potential difference between the area of the electrode bonded to the feeding member and the surface of the same electrode in which the electric discharge is developing, becomes substantially uniform in the widthwise direction of the belt or cylinder. Therefore, electric discharge develops substantially uniform in the widthwise direction of the belt or cylinder, enabling uniform electrification.

Preferably, the first and second electrodes are bonded together with an insertion member consisting of an insulating material between them, and the insertion member whose end face is substantially flush with or set back from the ends of the first and second electrodes facing the developing powder carrier.

In this electrifying apparatus, the distance between the two electrodes can be easily set by controlling the thickness of the insertion member. If the end face of the insertion member is brought into alignment with or set back from the ends of the electrode members, electric discharge can be produced between the end faces of the electrodes or between the electrodes and the surface of the article in the vicinity of the end faces.

Preferably, the first and second electrodes are made up of a plurality of electrodes which are spaced at an even interval away from the article in a distributed manner while one type of electrode is spaced a uniform interval away from the other type of electrode.

The first and second electrodes are each comprised of a plurality of separated components. Preferably, all the components constituting the first electrode are set to the same potential, and all the components constituting the second electrode are set to the same potential.

In this electrifying apparatus, electric discharge is produced between the adjacent electrodes, and part of ions or electrons migrating between the electrodes flow to the article, whereby the article is electrified. The extent to which the article is electrified or the intensity of an electric charge can be arbitrarily set by appropriately selecting the arrangement of the constituent components of the first electrode and the second electrode.

Preferably, the first and second electrodes are made of conductive or resistive material stacked on an insulating board.

In this electrifying apparatus, it becomes easy to arrange the first and second electrodes in an arbitrary pattern or profile, enabling manufacture of various modifications of the electrifying apparatus inexpensively.

BRIEF DESCRIPTION OF THE DRAWINGS

FIGS. 5A and 5B are segmentary views showing an electric charge imparting member and an electrification control member of a photographic developing apparatus according to another embodiment of the present invention of;

FIGS. 11A and 11B are schematic representations illustrating a photographic developing apparatus according to the first embodiment of the present invention of;

DETAILED DESCRIPTION OF THE PREFERRED EMBODIMENTS

Embodiments of the present invention will be described with reference to the accompanying drawings.

Figure 1:
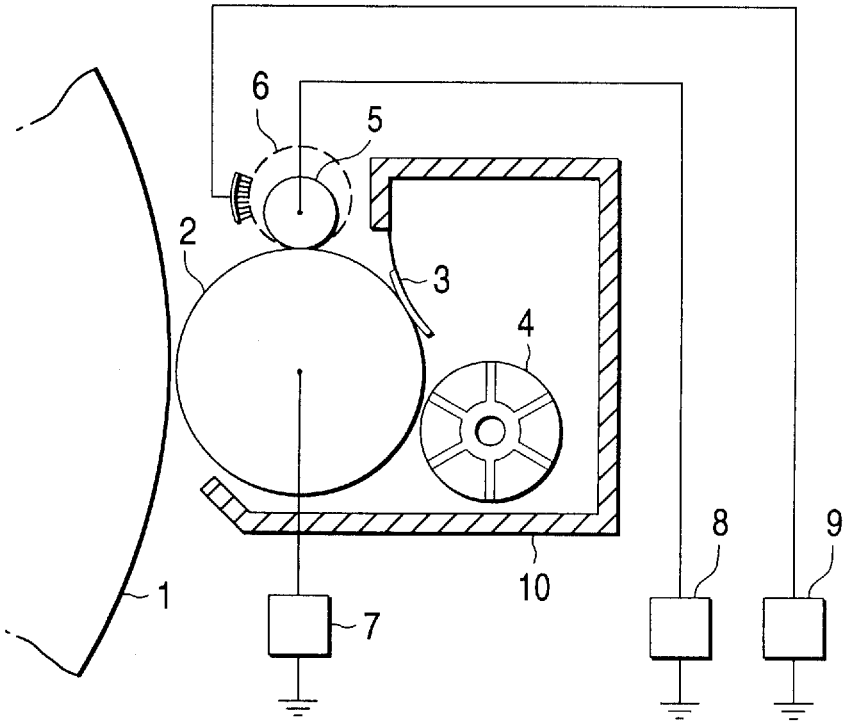
FIG. 1 is a schematic diagram illustrating a photographic developing apparatus which is one embodiment of the present invention.

FIG. 1 is a schematic diagram illustrating a photographic developing apparatus which is one embodiment of the present invention.

This photographic developing apparatus is placed so as to be opposite to an image carrier 1 capable of forming a latent image thereon by means of a charge potential difference. A housing 10 contains a developing powder carrier 2 which is positioned in close proximity to and opposite to the image carrier 1 and carries toner while the toner is adhered to the surface of the developing powder carrier 2; a layer forming member 3 which forms a toner layer by limiting the toner on the developing powder carrier; a stirring-and-supply member 4 which stirs the toner and supplies the toner to the developing powder carrier 2; an electric charge imparting member 5 which is positioned so as to be opposite to the developing powder carrier 2 and produces electric discharge between the gap between the electric charge imparting member 5 and the developing powder carrier 2; and an electrification control member 6 which is interposed between the electric charge imparting member 5 and the developing powder carrier 2 and limits an ionization area caused by the electric discharge developing between them. Further, the photographic developing apparatus comprises a developing power source 7 which applies a voltage for developing purposes between the developing powder carrier 2 and the image carrier 1; a toner electrifying power source 8 which applies between the developing powder carrier 2 and the electric charge imparting member 5 a voltage used for electrifying toner; and an electrification control power source 9 which applies to the electrification control member 6 a voltage used for limiting an ionization area.

The developing powder carrier 2 is rotatively supported, and a d.c. current of about −200 V having the same polarity as that of the toner is applied to the developing powder carrier 2 from the developing power source 7. As a result, an electric field is formed between the developing powder carrier 2 and the image carrier 1, and the toner is transferred to the latent image formed on the image carrier 1. Irregularities having Ra=about 0.1 to 5.0 $\mu$m are formed in the developing powder carrier 2 by cutting a round bar or pipe of aluminum or stainless steel, and subjecting the outer surface of the thus-cut bar or pipe to chemical etching or machining such as sand blasting, liquid honing or emery polishing. Alternatively, the developing powder carrier may be formed by cutting a round bar or pipe of aluminum or stainless steel, and coating the surface of the bar or pipe with a resin layer having conductive powder dispersed therein. The developing powder carrier 2 of the present embodiment has a diameter of 20 mm and is formed by cutting an aluminum pipe and subjecting the outer surface of the aluminum pipe to sand blast anodization. In order to ensure developing performance, the voltage applied from the power source 7 may be a voltage which consists of a d.c. voltage superimposed on an a.c. voltage.

The layer forming member 3 is made by bonding a contact member (which consists of Si or EPDM rubber having conductive powder dispersed therein) to a stainless leaf spring having a thickness of about 0.03 to 0.3 mm through use of a curing agent. A contact pressure exerted on the developing powder carrier 2 is set to about 5 to 100 g/cm, and rubber having a hardness of 20 to 80 degrees can be used for the contact member. Preferably, rubber having a hardness of 30 to 60 degrees is suitable for the contact member. A toner layer is formed on the developing powder carrier 2 to a thickness of about 5 to 30 $\mu$m by pressing the toner against the developing powder carrier 2.

The electric charge imparting member 5 is cylindrically formed and is supported so as to be rotatable around the axis. The electric charge imparting member 5 is formed from an ion-conductive material or rubber having conductive fine particles mixed therein, either of which has a volume resistivity of about $10^5$ to $10^{10}$ Ω·cm. A particularly desirable volume resistivity is around $10^7$ to $10^8$ Ω·cm.

The electrification control member 6 is made of a mesh member of stainless steel having a line size of 50 $\mu$m and a line pitch of 127 $\mu$m and is formed into a cylindrical shape having a diameter larger than that of the electric charge imparting member 5. The electric charge imparting member 5 is housed in the electrification control member 6. This electrification control member 6 is sandwiched between the electric charge imparting member 5 and the developing powder carrier 2 and rotates while the developing powder carrier 2 is opposite to the electric charge imparting member 5 with a part of the electrification control member 6 sandwiched between them. At this time, the electrification control member 6 is rotatively driven to follow the rotation of the developing powder carrier 2.

To negatively electrify the toner on the developing powder carrier 2, an electric field is produced so as to commence electric discharge between the electric charge imparting member 5 and the electrification control member 6. Specifically, an electric field is formed so as to have a gradient which is sufficiently small to prevent electric discharge between the electrification control member 6 and the developing powder carrier 2, in such a direction as to attract negative electric charges toward the developing powder carrier 2. To this end, a relationship of electric potential between the electrification control member 6 and the developing powder carrier 2 is maintained at the following relationship.

(Electric potential of the developing powder carrier)−(Electric potential of the electrification control member)=100 V A relationship of electric potential between the electric charge imparting member 5 and the electrification control member 6 is maintained at the following relationship (Electric potential of the electrification control member)−(Electric potential of the electric charge imparting member)=1000 V The electric potentials of these members are determined depending on the pitch between the electric charge imparting member 5 and the developing powder carrier 2 and the structure and thickness of the electrification control member 6, as required. If the electric charge imparting member 5, the electrification control member 6, and the developing powder carrier 2 are provided at intervals, the electric potentials are determined in consideration of these intervals. In the embodiment, a voltage of −200 V is applied to the developing powder carrier 2 from the power source 7, and a voltage of −300 V is applied to the electrification control member 6 from the power source 9. A voltage of −1300 V is applied to the shaft of the electric charge imparting member 5 from the power source 8.

Developing powder used in the photographic developing apparatus is one-component toner. The developing powder is formed by dispersing a polarization suppressing agent such as pigments or metal-complex azo dyes into various types of elastic resin such as styrene resin, acrylic resin or polyester resin and is pulverized and classified into a size ranging from 3 to 20 μm (a mean granular size of 7 μm). A charge control agent is added to the thus-produced developing powder, so that the developing powder is imparted with negative electric charges. Fine particles having a size of 0.1 μm or less such as silica, alumina, or titanium, all of which are processed to be hydrophobic, are used as the charge control agent. Of these elements, hydrophobic silica is most desirable, and a fluid assistant for use with toner is applied to the outside of the developing powder particles.

Selenium-based photosensitive materials or organic photosensitive materials are used for the image carrier 1, and the image carrier 1 may be in contact with the developing powder carrier 2. Alternatively, they may be positioned so as to be opposite to each other with a gap of about 100 to 400 μm between them.

In this photographic developing apparatus, toner stored in the housing 1 is stirred by rotation of the stirring-and-supply member 4, and the thus-stirred toner is fed to the developing powder carrier 2. Toner in the vicinity of the surface of the developing powder carrier 2 is carried to the position where the developing powder carrier 2 is opposite to the layer forming member 3 by rotation of the developing powder carrier 2. A toner layer is formed on the developing powder carrier 2 by a pressing force of the layer forming member 3. Subsequently, the toner layer is carried to the position where the developing powder carrier 2 is opposite to the electric charge imparting member 5 and the electrification control member 6. At this time, the previously-described voltages are applied to the gap between the electric charge imparting member 5 and the electrification control member 6 and the gap between the electrification control member 6 and the developing powder carrier 2, respectively. Electric fields are produced in these gaps. A state in which toner provided on the developing powder carrier 2 is electrified will be described with reference to FIGS. 2 and 3.

Figure 2:
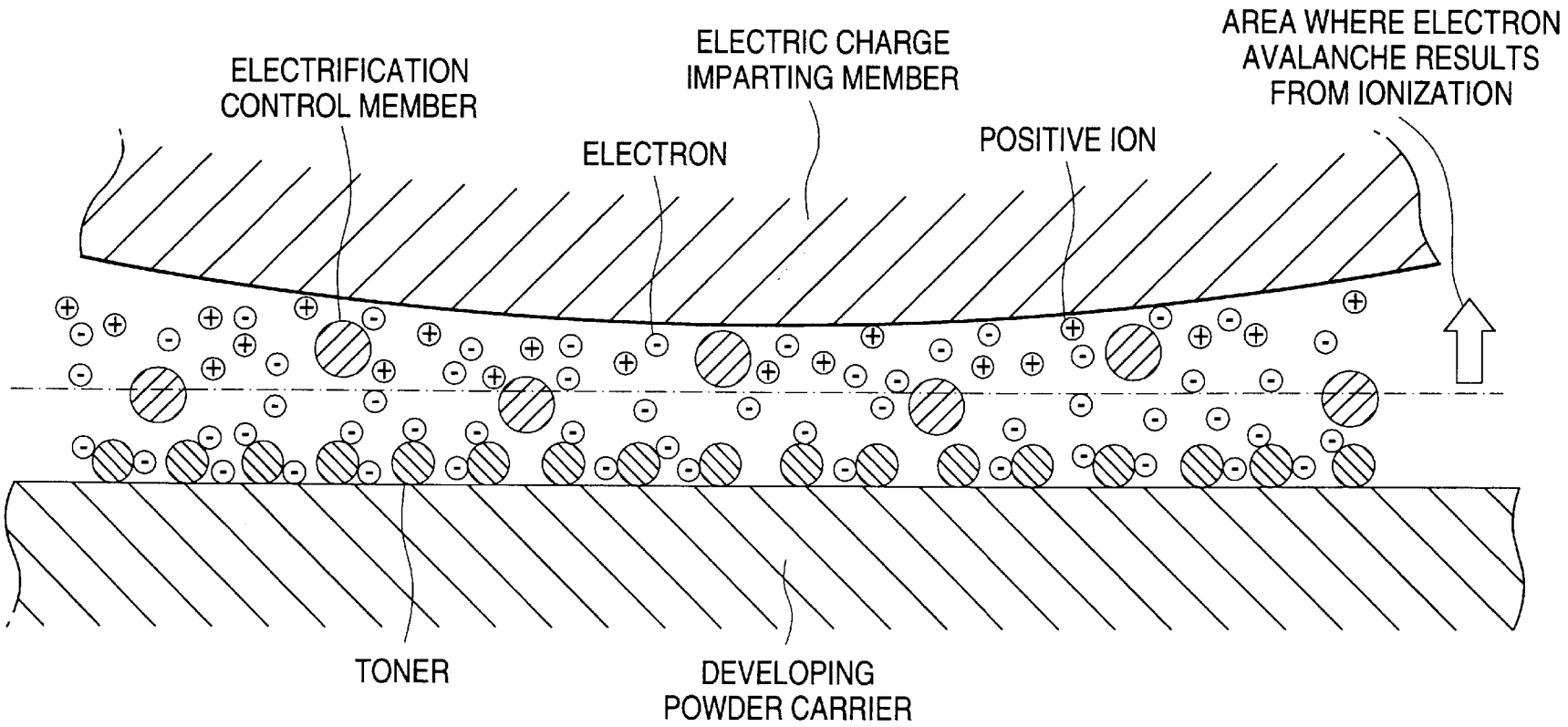
FIG. 2 is a schematic representation illustrating the mechanism of electrification of developing powder on a developing powder carrier in the photographic developing apparatus.
Figure 3B:
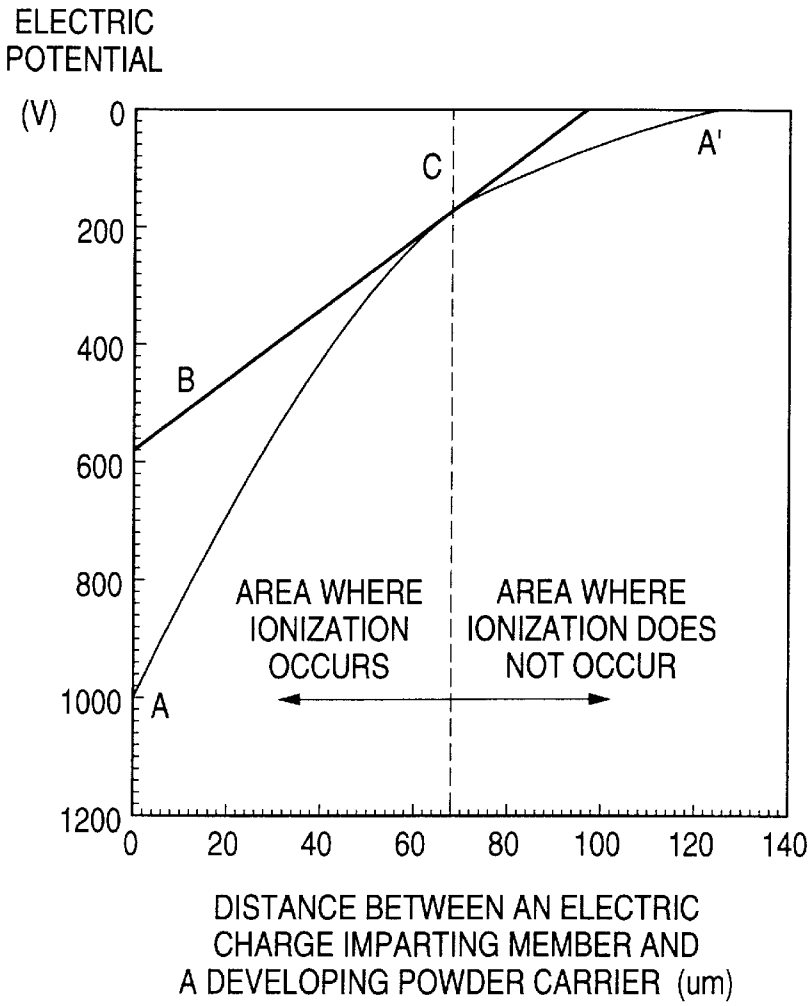
FIGS. 3A and 3B are diagrams illustrating the profile of electric potential between the electric charge imparting member and the developing powder carrier of the photographic developing apparatus.
Figure 3A:
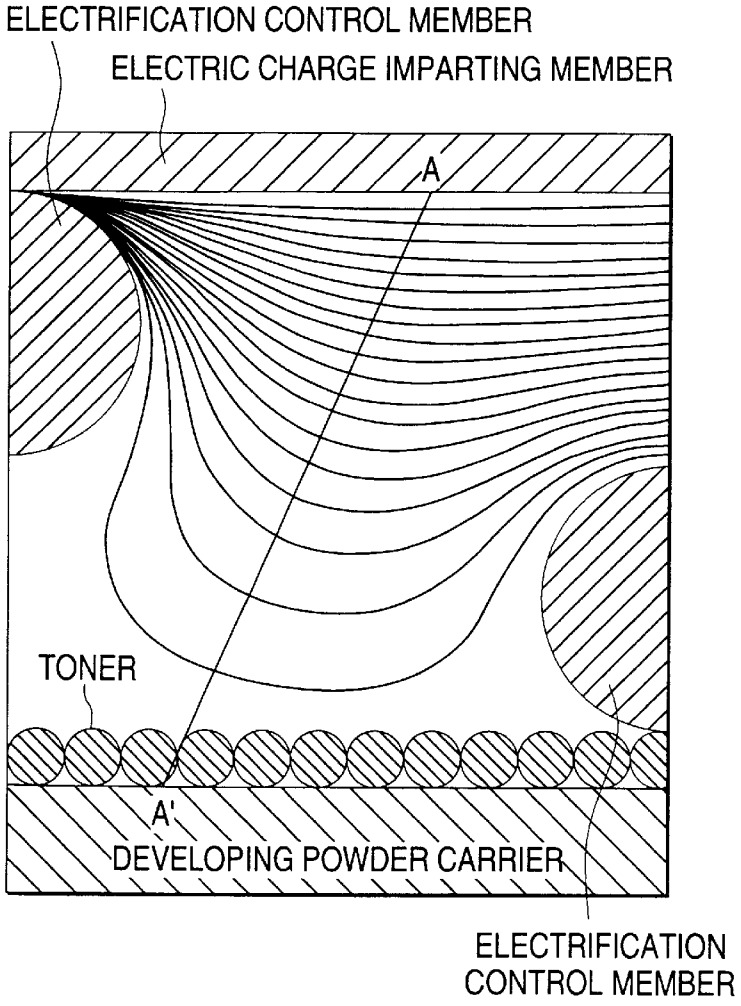

The profile of electric potential obtained without placing the electrification control member 6 between the electric charge imparting member 5 and the developing powder carrier 2 results in a substantially uniform electric field in the gap. In contrast, if the electrification control member 6 is provided between the electric charge imparting member 5 and the developing powder carriers 2, and if a voltage is applied to the electrification control member 6, a resultant electric field becomes unevenly distorted as illustrated in FIG. 3A. FIG. 3B is a plot showing variations in the electric potential taken across line A—A' in FIG. 3A, and a gradient B of the discharge starting electric field according to Paschen series is superposed on the curve of variations. Only the area of the electric charge imparting member 5 having an electric field larger than contact point C is dischargeable, and the electric field developing in the vicinity of the developing powder carrier 2 is smaller than the discharge start electric field and hence does not cause ionization. Accordingly, as shown in FIG. 2, positive ions occur in the vicinity of the electric charge imparting member 5 as a result of ionization associated with electric discharge in addition to negative ions or electrons. However, ionization does not occur in the vicinity of the developing powder carrier 2, and negative ions or electrodes are attracted toward the developing powder carrier 2 by the action of an electric field occurred between the electrification control member 6 and the developing powder carrier 2. The electric charges are adhered to the toner provided on the developing powder carrier 2, and the toner is then electrified. Consequently, positive ions resulting from ionization are present only in the vicinity of the electric charge imparting member 5 and attracted toward the electric charge imparting member 5. However, the positive ions are not adhered to the toner provided on the developing powder carrier 2. In this way, as a result of the mesh-shaped electrification control member 6 being placed between the electric charge imparting member 5 and the developing powder carrier 2, an ionization area is limited to the position away from the toner. Therefore, occurrence of reversely-polarized toner is suppressed.

As a result of rotation of the developing powder carrier 2, the toner layer thus uniformly imparted with electric charges is carried to a developing area where it is positioned so as to be opposite to the image carrier 1. The toner is transferred to the latent image formed on the image carrier 1 by means of the developing electric field produced between the developing powder carrier 2 and the image carrier 1, whereby photographic developing operations are performed.

In this photographic developing apparatus, it has been acknowledged that the toner is electrified to −7 μC/g to −12 μC/g, and the amount of toner of the opposite polarity constitutes 0.1% by weight or less. In this way, the toner is electrified in a superior manner.

In the foregoing photographic developing apparatus, the electrification control member 6 may axially move as it rotates. To prevent the axial movement of the electrification control member 6, the diameter of the longitudinal center area of the electric charge imparting member 5 may be increased. Alternatively, a tension roller may be provided in contact with the electrification control member 6 such that the tension roller is opposite to the developing powder carrier 2 with the electrification control member 6 interposed between them. The diameter of the longitudinal center area of the tension roller may be increased.

Figure 4A:
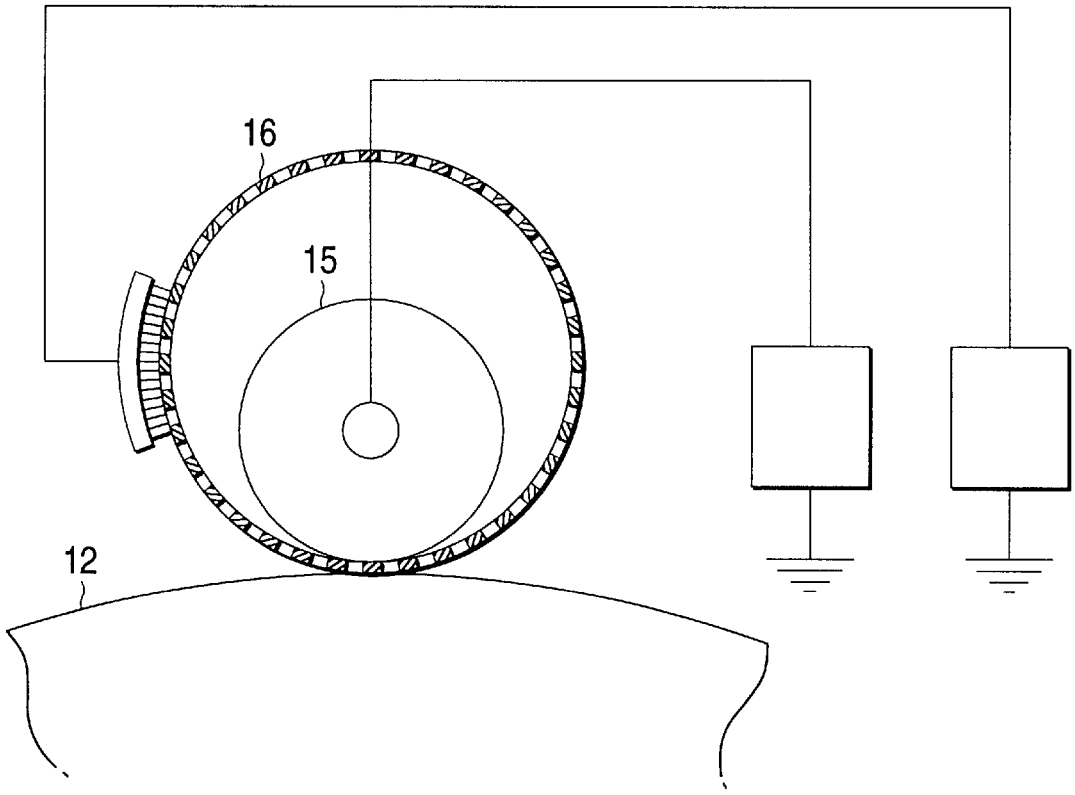
FIGS. 4A and 4B are segmentary views showing the construction of an electric charge imparting member and an electrification control member of a photographic developing apparatus according to another embodiment of the present invention.
Figure 4B:
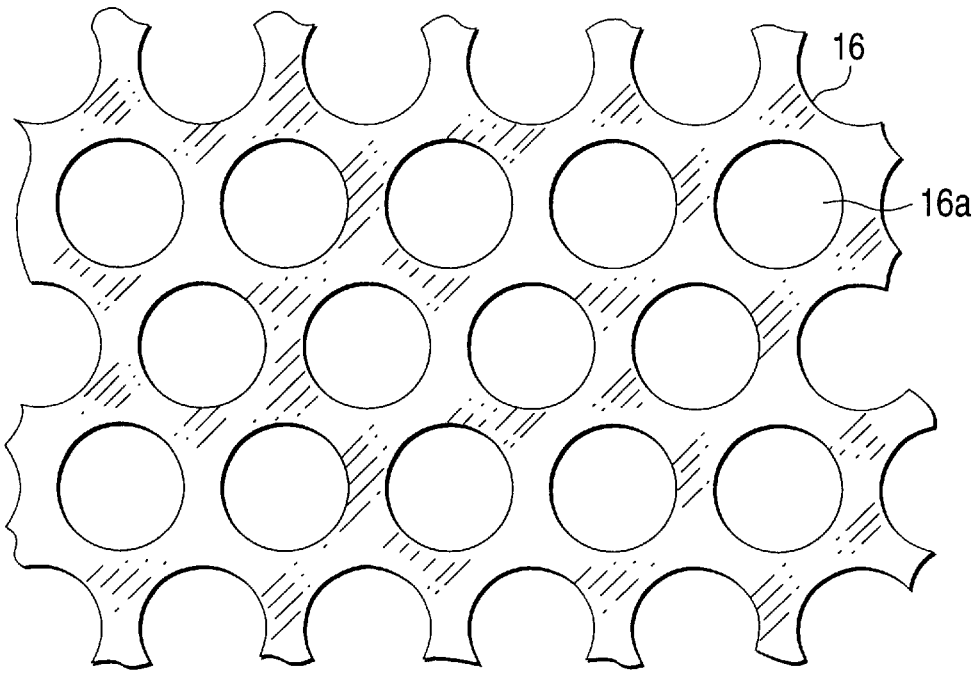

FIGS. 4A and 4B are enlarged views showing the structure of a photographic developing apparatus in the vicinity of its electrification control member according to another embodiment of the present invention of any one of aspects 1, 4, and 5.

The photographic developing apparatus is substantially the same in structure as that of the photographic developing apparatus shown in FIG. 1. As illustrated in FIG. 4B, the electrification control member 16 is formed from a conductive film having a plurality of pores 16*a* by photoetching, electroforming, or laser beam machining. The electrification control member 16 comes into contact with the developing powder carrier 12 and reversely rotates so as to follow the rotation of the developing powder carrier 12. The electric charge imparting member 15 rotates in association with the rotation of the electrification control member 16.

In other respects, the photographic developing apparatus is the same in structure as that shown in FIG. 1.

In this photographic developing apparatus, electric discharge is caused by the electric field developing between the electric charge imparting member 15 and the electrification control member 16, whereby positive ions and negative ions or electrodes occur. Further, the negative ions or electrons are attracted by the developing powder carrier 12 by means of the electric field developing between the electrification control member 16 and the developing powder carrier 12. As a result, negative electric charges are imparted to the toner formed on the developing powder carrier 2, thereby uniformly electrifying the toner.

In this photographic developing apparatus, the electrification control member 16 is cylindrical and capable of continually rotating to thereby enable efficient electrification of the developing powder. The electrification control member 16 is in contact with only a part of the electric charge imparting member 15, and therefore electric discharge does not arise in the area of the electrification control member 16 which is out of contact with the developing agent; namely, in the area of the electrification control member 16 which does not contribute to electrification of the developing powder. As a result, in terms of the overall photographic developing apparatus, the amount of electric discharge is reduced. For this reason, there is required only a small amount of electric currents, enabling a reduction in the size and cost of the photographic developing apparatus. Further, the quantity of electric discharge is small, which in turn makes it possible to reduce the amount of materials resulting from electric discharge; e.g., ozone. The electric discharge required for electrification of the developing powder is sufficiently ensured by the contact between the electric charge imparting member 15 and the electrification control member 16 or in the vicinity of the contact area. For this reason, the electrifying capability of the developing powder is not impaired.

In this photographic developing apparatus, a test on the electrification of toner was performed on condition that the voltage applied to the electrification control member 16 is set to −300 V; the voltage applied to the electric charge imparting member 15 is set to −1300 V; and the voltage applied to the developing powder 12 is set to −200 V. As a result of the test, it has been acknowledged that the toner of the opposite polarity constitutes 0.1% by weight or less, and the toner is properly electrified.

Figure 5A:
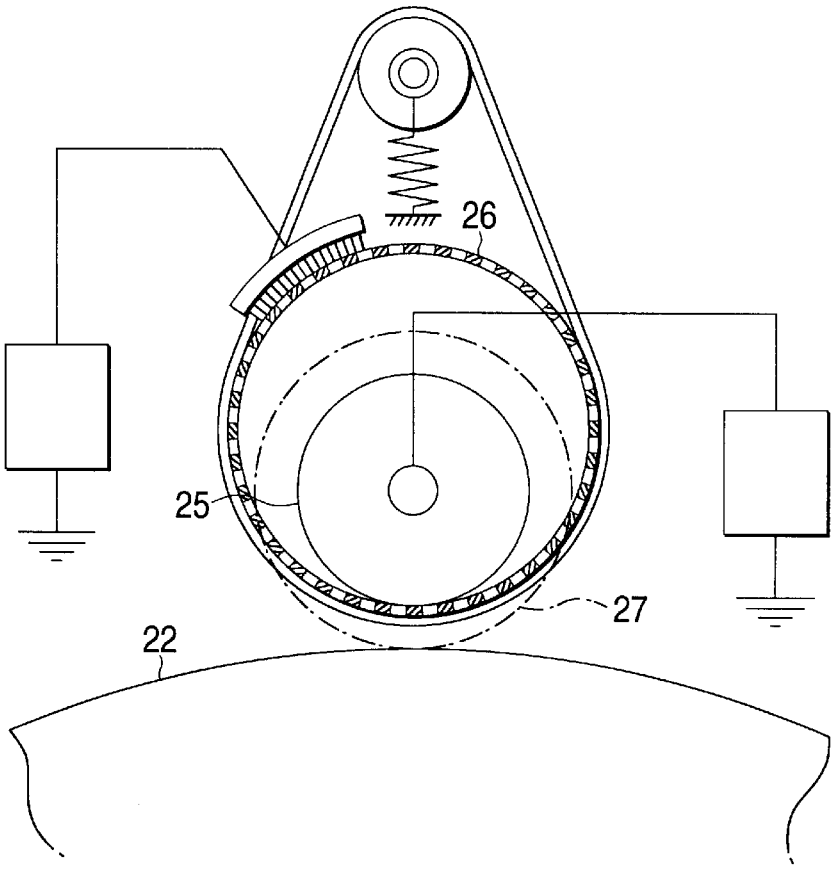
Figure 5B:
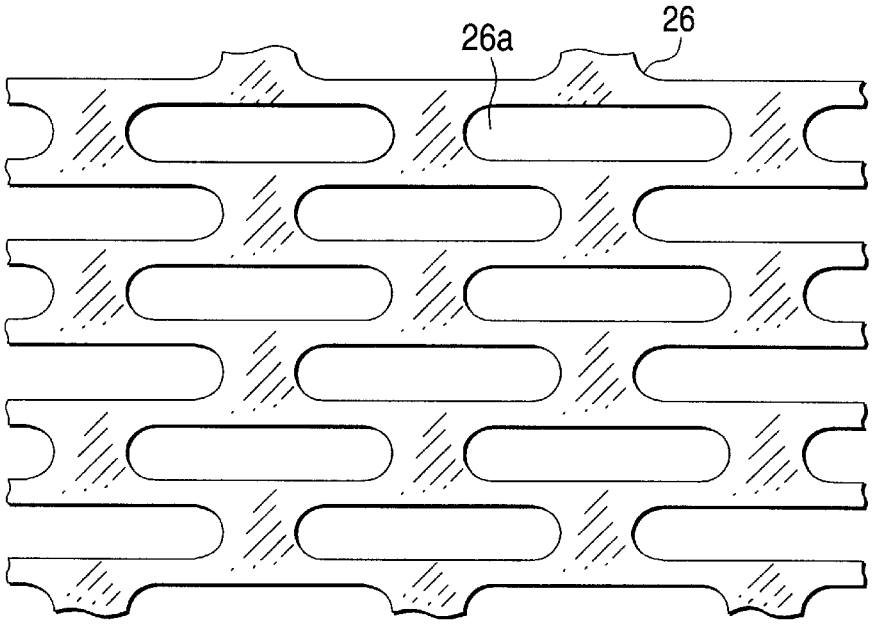

FIGS. 5A and 5B are enlarged views showing the structure of a photographic developing apparatus in the vicinity of its electrification control member according to another embodiment of the present invention of any one of aspects 1, 4, and 6.

In the photographic developing apparatus, as shown in FIG. 5A, an electric charge imparting member 25 is made of a cylindrical semi-conductive material and is supported by tracking rollers 27 provided at both ends of the electric charge imparting member 25 so as to be spaced a minute gap away from a developing powder carrier 22. As shown in FIG. 5B, an electrification control member 26 is made of a conductive film which has a plurality of elongated pores 26*a* formed therein in a longitudinal direction of the film. The electrification control member 26 is formed so as to have a diameter larger than that of the electric charge imparting member 25 and houses the electric charge imparting member 25. The electrification control member 26 is forced in the direction opposite to the developing powder carrier 22 by means of spring members provided at both longitudinal ends of the electrification control member 26 so as to prevent it from coming into contact with the developing powder carrier 22. Consequently, a part of the internal circumferential surface of the electrification control member 26 is in contact with the electric charge imparting member 25, and the electrification control member 26 rotates in association with the rotation of the electric charge imparting member 25. At this time., the electrification control member 26 is rotatively driven so as to differ from the developing powder carrier 22 in terms of circumferential speed.

In other respects, the photographic developing apparatus of this embodiment is the same as that shown in FIG. 1.

In this photographic developing apparatus, the electrification control member 26 can rotate while being spaced away from the developing powder carrier 22 and moves relatively to the surface of the developing powder carrier 22 by means of the difference in circumferential speed between the electrification control member 26 and the developing powder carrier 22. As a result, it is possible to reduce uneven electrification of the developing powder carrier 22 due to the geometry of openings formed in the electrification control member 26. Further, the electrification control member 26 is rotatively driven so as to differ from the developing powder carrier 22 in terms of circumferential speed. An electrode portion and pores of the electrification control member 26 are opposite to the surface of the developing powder carrier 22, enabling developing powder to be substantially uniformly electrified.

Figure 6:
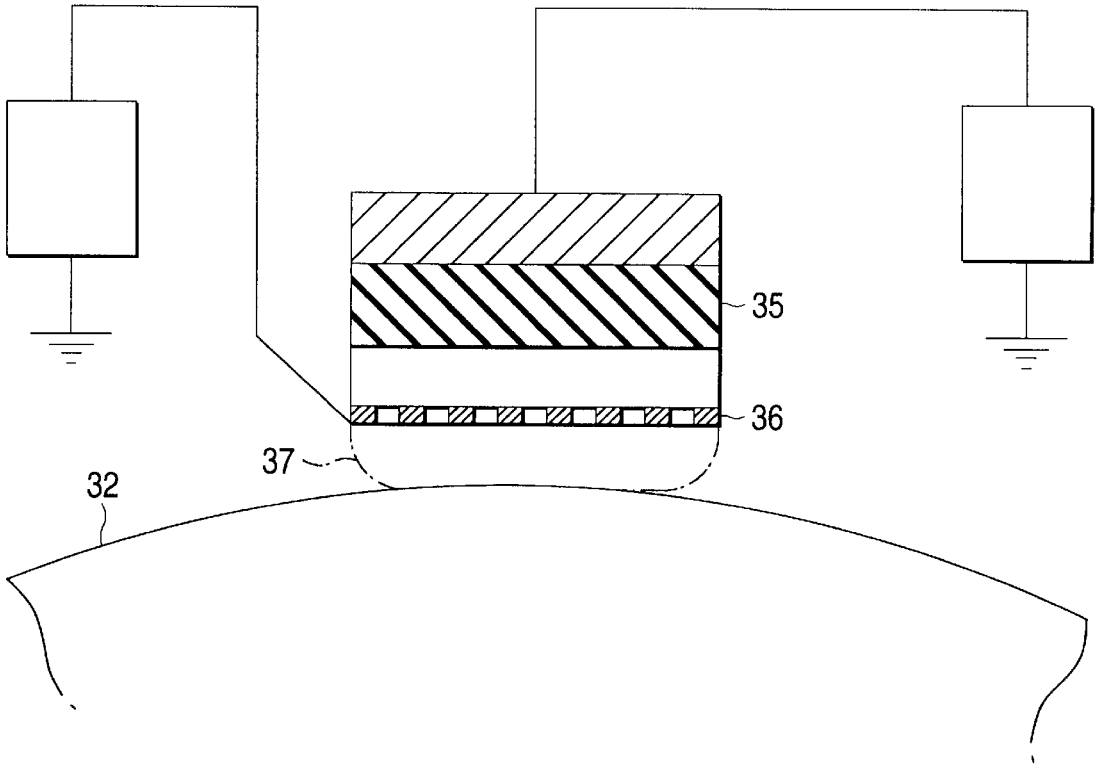
FIG. 6 is a segmentary view showing an electric charge imparting member and an electrification control member of a photographic developing apparatus according to still another embodiment of the present invention.

FIG. 6 is an enlarged view showing the structure of a photographic developing apparatus in the vicinity of its electrification control member according to still another embodiment of the present invention.

In this photographic developing apparatus, an electrification control member 36 is made of a porous conductive thin plate. An electric charge imparting member 35 is made of a plate-like electrode having substantially the same area as that of the electrification control member 36. This electrification control member 36 is supported by tracking members 37 provided at both ends of the electrification control member 36 so as to be spaced a minute interval away from the electric charge imparting member 35 as well as to be in close proximity to and opposite to a developing powder carrier 32.

In this photographic developing apparatus, a pore formed in the electrification control member 36 has a diameter of about 80 $\mu$m, and pores which serve as an electrode are formed in the electrification control member 36 so as to have the minimum offset pitch of about 30 $\mu$m. A voltage is set so as not to cause electric discharge in the vicinity of the developing powder carrier 32 even if the electric charge imparting member 35 is opposite to the developing powder carrier 32.

In other respects, the photographic developing apparatus of this embodiment is the same as that shown in FIG. 1.

In such a photographic developing apparatus, electric discharge can be produced across a minute gap between the electric charge imparting member 35 and the electrification control member 36. Only electrons or negative ions resulting from the electric charges are imparted to the toner formed on the developing powder carrier 32, whereby the toner is electrified. In this photographic developing apparatus, since the electric charge imparting member 35 and the electrification control member 36 are supported by means of a simple structure, the size and cost of the overall photographic developing apparatus can be reduced.

Although the electrification control member 36 is supported by the tracking members 37 so as to maintain the gap between the electrification control member 36 and the electric charge imparting member 35, it may be supported by positioning members attached to the photographic developing apparatus.

Figure 7A:
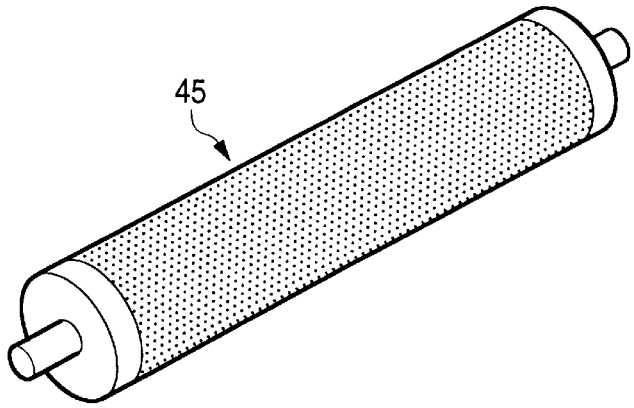
FIGS. 7A to 7C are schematic representations showing the structure of an electrification control member of a photographic developing apparatus according to an embodiment of the invention.
Figure 7B:
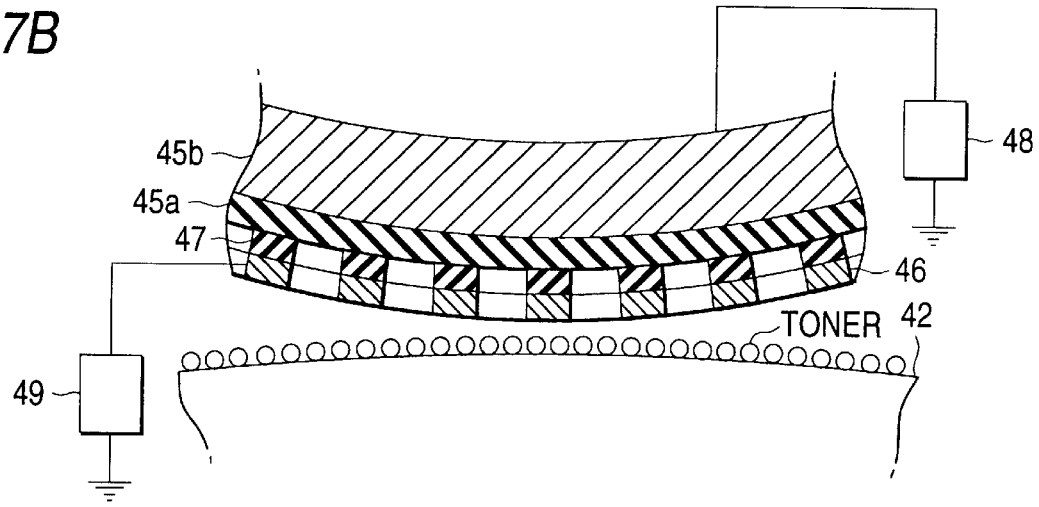
Figure 7C:
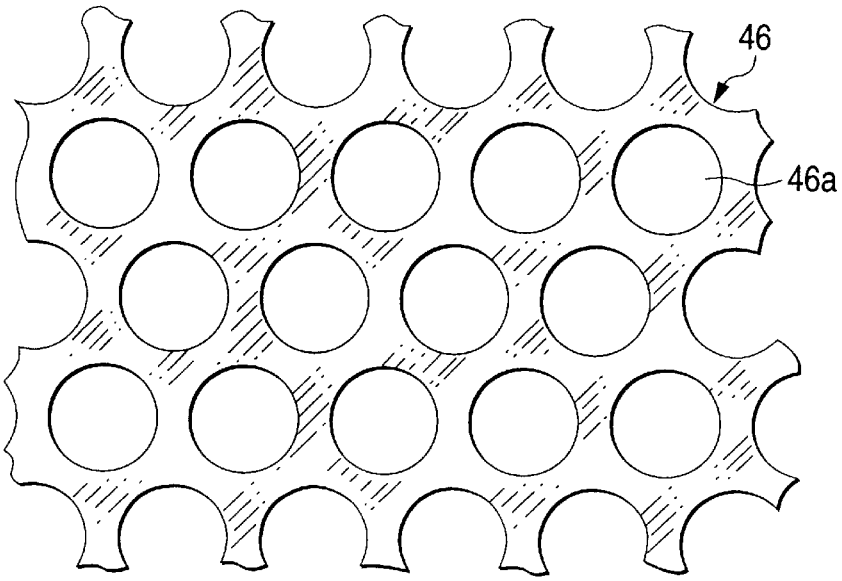

FIGS. 7A to 7C are enlarged schematic representations showing the structure of a photographic developing apparatus in the vicinity of its electrification control member according to a first embodiment.

In this photographic developing apparatus, an electric charge imparting member 45 is a cylindrical member as shown in FIG. 7A, and a semi-conductive film 45*a* is formed over the circumferential surface of the electric charge imparting member 45. As shown in FIG. 7B, an electrification control member 46 is formed by a conductive layer stacked on the surface of the semi-conductive film layer 45*a* via an insulating layer 47. A conductive layer having a plurality of pores 46*a* as shown in FIG. 7C is formed on the electrification control member 46 by electroless plating or laser beam machining. A voltage of about −300 V is applied to the conductive layer from a power source 49. A feeding member 45*b* is provided on the reverse side of a semiconductor film layer 45*a*, and a voltage of about −1300 V is applied to the semiconductor film layer 45*a* from the power source 48 via the feeding member 45*b*. The electrification control member 46 is not limited to the foregoing member having circular pores but may be a member which has a conductive layer formed into a stripe pattern or various modifications.

In other respects, the photographic developing apparatus of this embodiment is the same as that shown in FIG. 1.

In this photographic developing apparatus, electric discharge is produced across a space between the electric charge imparting member 45 having a semi-conductive film layer and the electrification control member 46 stacked on the electric charge imparting member 45 via the insulating layer 47. Electrons or negative ions and positive ions result from the electric discharge. Of these products, only the electrons or negative ions are attracted by an electric field developing in the gap between the electrification control member 46 and the developing powder carrier 42 and eventually imparted to the toner produced on the developing powder carrier 42.

In this photographic developing apparatus, since the insulating layer 47 is interposed between the electric charge imparting member 45 and the electrification control member 46, leakage of electric charges, a reduction in the surface potential of the electric charge imparting member 45, the flow of an excessive electric current between the electric charge imparting member 45 and the electrification control member 46 can be prevented. Further, the electric-discharge area between the electric charge imparting member 45 and the electrification control member 46 can be extended, enabling improvements in the efficiency of electrification of developing powder.

As a result of the electrifying test being made on this photographic developing apparatus, it has been acknowledged that the toner of the opposite polarity constitutes 0.1% by weight, and the toner is electrified in a superior manner. Further, since the electric charge imparting member 45 and the electrification control member 46 are formed into one unit, thereby enabling simplification of the photographic developing apparatus and a reduction in the cost of the same. Further, in this photographic developing apparatus, the semi-conductive film layer 45*a* of the electric charge imparting member 45 may be a semi-conductive rubber layer.

Figure 8:
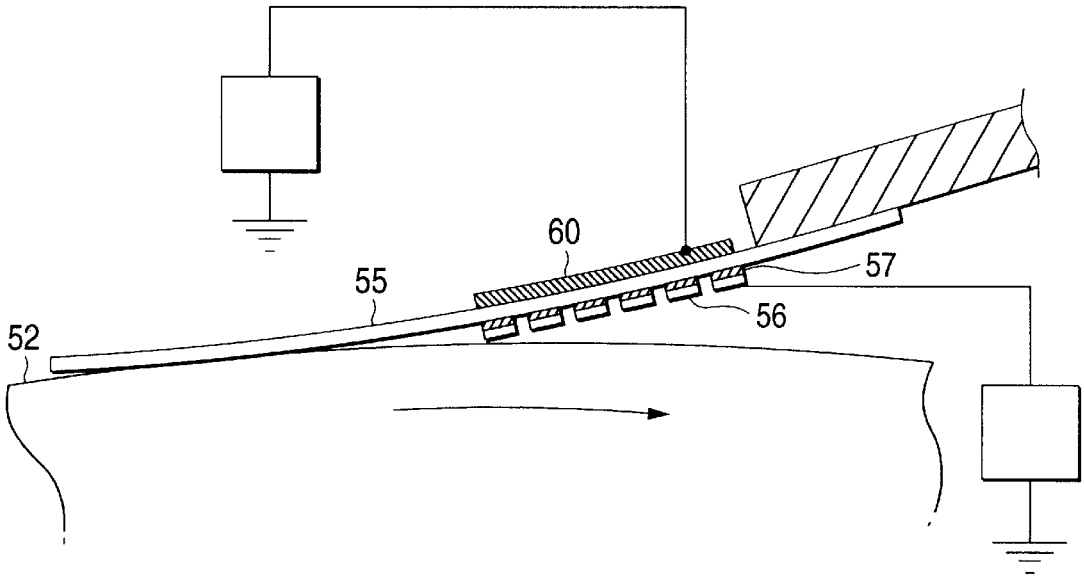
FIG. 8 is a segmentary view illustrating the construction of an electric charge imparting member and an electrification control member of a photographic developing apparatus according to a second embodiment of the present invention.

FIG. 8 is an enlarged schematic representation illustrating the structure of a photographic developing apparatus in the vicinity of its electrification control member according to a second embodiment of the present invention.

In this photographic developing apparatus, a charge imparting member 55 is formed from a semi-conductive film and is supported so as to be fixed at one end and to come into contact with the surface of a developing powder carrier 52 at the other end. As is the case with the electrification control member shown in FIGS. 7A to 7C, an electrification control member 56 is stacked on the surface of an electric charge imparting member 55 via an insulating layer 57 and is positioned so as to be in close proximity to and opposite to the developing powder carrier 52. A feeding member 60 which applies a voltage to the electric charge imparting member 55 is provided on the reverse side of the electric charge imparting member 55.

In other respects, the photographic developing apparatus of this embodiment is the same as that shown in FIG. 1.

In this photographic developing apparatus, ionization occurs between the electric charge imparting member 55 and the electrification control member 56 as a result of electric discharge. Only electrons or negative ions are attracted by the developing powder carrier 52 by action of the electric field developing between the electrification control member 56 and the developing powder carrier 52. As a result, toner provided on the developing powder carrier 52 can be substantially uniformly electrified. Further, the electric charge imparting member 55 and the electrification control member 56 are formed into a single unit, enabling simplification of the photographic developing apparatus and a reduction in the cost of the same.

Figure 9:
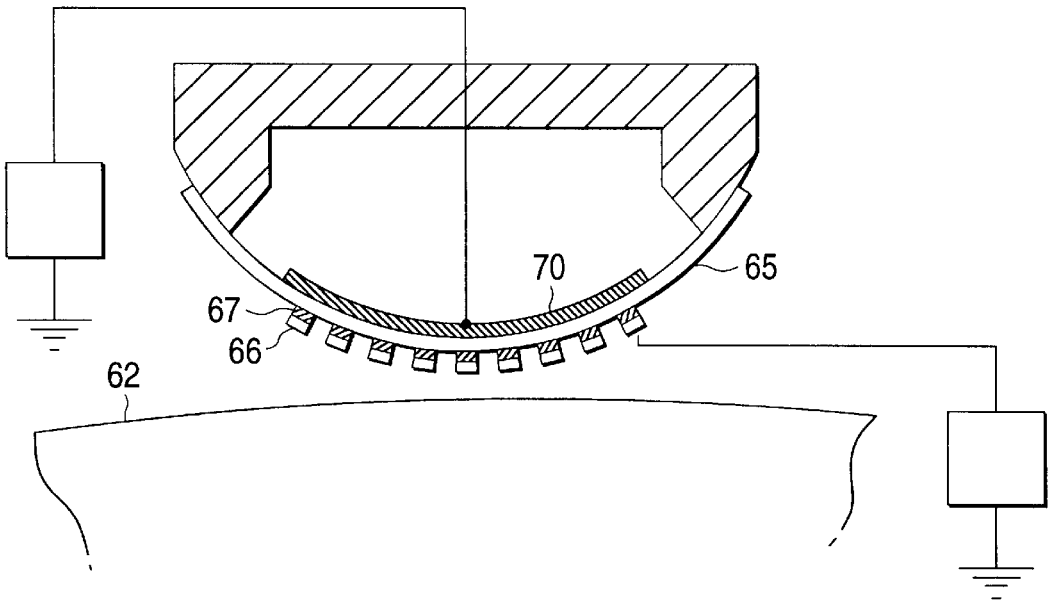
FIG. 9 is a segmentary view illustrating the construction of an electric charge imparting member and an electrification control member of a photographic developing apparatus according to a third embodiment of the present invention.

FIG. 9 is an enlarged view illustrating a photographic developing apparatus in the vicinity of an electrification control member according to a third embodiment of the present invention.

In this photographic developing apparatus, an electric charge imparting member 65 is formed from a semi-conductive film and is fixedly supported at each end. An electrification control member 66 is stacked on the surface of the electric charge imparting member 65 via an insulating layer 67. The electrification control member 66 is supported so as to be spaced a minute interval away from the developing powder carrier 62. A feeding member 70 is provided on the reverse side of the electric charge imparting member 65.

In other respects, the photographic developing apparatus of this embodiment is the same as that shown in FIG. 1.

As is the case with the foregoing photographic developing apparatus, the toner provided on the developing powder carrier 62 can be uniformly electrified. The electric charge imparting member 65 and the electrification control member 66 are simple in structure and is supported by means of a simple construction, enabling a reduction in the size and cost of the photographic developing apparatus.

Figure 10:
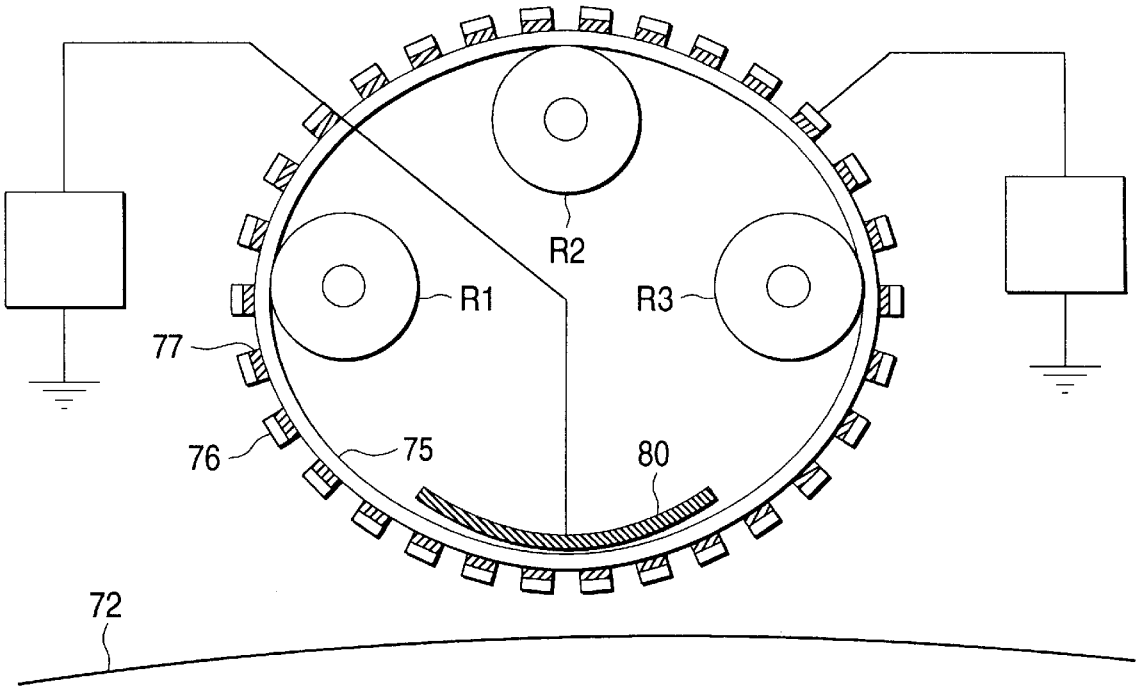
FIG. 10 is a segmentary view illustrating the construction of an electrification control member of a photographic developing according to another embodiment of the present invention.

FIG. 10 is an enlarged schematic representation illustrating the structure of a photographic developing apparatus in the vicinity of its electrification control member according to another embodiment of the present invention.

In this photographic developing apparatus, an electric charge imparting member 75 is cylindrically formed from an elastic semi-conductive film. An electrification control member 76 consisting of a conductive layer is stacked on the circumferential surface of the electric charge imparting member 75 via an insulating layer 77. A feeding member 80 is provided on the internal circumferential surface of the electric charge imparting member 75 so as to be opposite to a developing powder carrier 72. The feeding member 80 is in contact with the electric charge imparting member 75 to thereby provide a predetermined electric potential. Three support rollers $R_1$, $R_2$, and $R_3$ are provided so as to come into contact with the internal surface of the electric charge imparting member 75 and rotatively support the electric charge imparting member 75. The electric charge imparting member 75 is driven so as to differ from the developing powder carrier 72 in terms of circumferential speed.

In other respects, the photographic developing apparatus of this embodiment is the same as that shown in FIG. 1.

In this photographic developing apparatus, since the electric charge imparting member 75 is rotatively supported, variations in electrification of the developing powder carrier 72 due to the geometry of the electrification control member 76 are eliminated, enabling electrification of developing powder to a preferable electric potential. Further, since the electric charge imparting member 75 is driven so as to differ from the developing powder carrier 72 in terms of circumferential speed, the surface areas of the developing powder carrier 72 which are opposite to electrode portions and non-electrode portions are shifted, as a result of which the developing powder can be uniformly electrified.

In the photographic developing apparatus, although the electrification control member 76 and the developing powder carrier 72 are supported without contact, they may be supported while remaining in contact with each other. At this time, since the electric charge imparting member 75 has elasticity, enabling a reduction in mechanical stress exerted on the developing powder when the electric charge imparting member 75 comes into contact with the developing powder carrier 72. In a case where the electric charge imparting member 75 is brought into contact with the developing powder carrier 72, it is better to place on the surface of the electrification control member 76 a protective film having minute pores smaller than the size of a toner particle formed therein. Preferably, the protective film is formed from material having superior mold-release characteristics. For example, fluororesin may be used for the protective film. In this case, toner can be prevented from sticking to the electrification control member 76, resulting in uniform electrification of the toner.

Figure 11A:
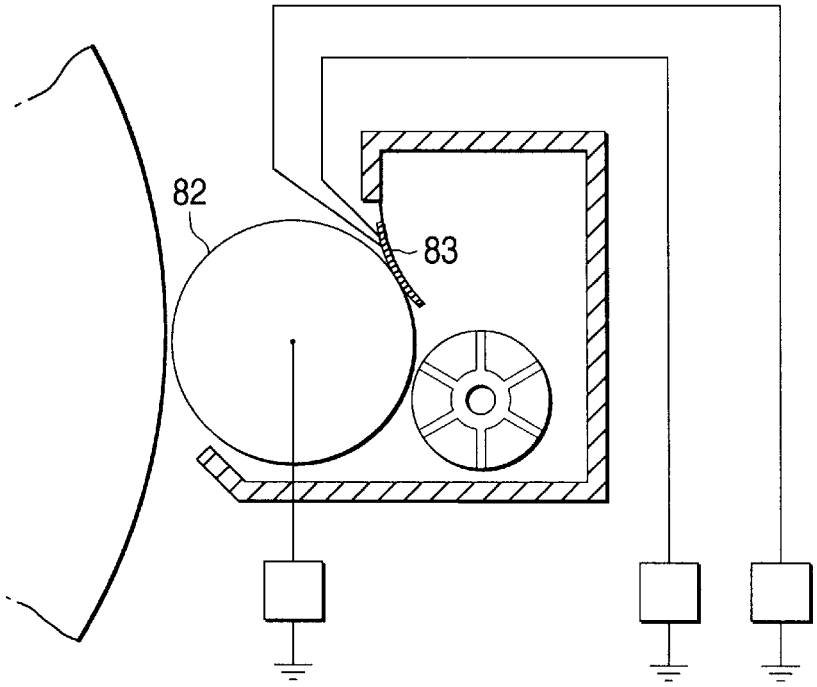
Figure 11B:
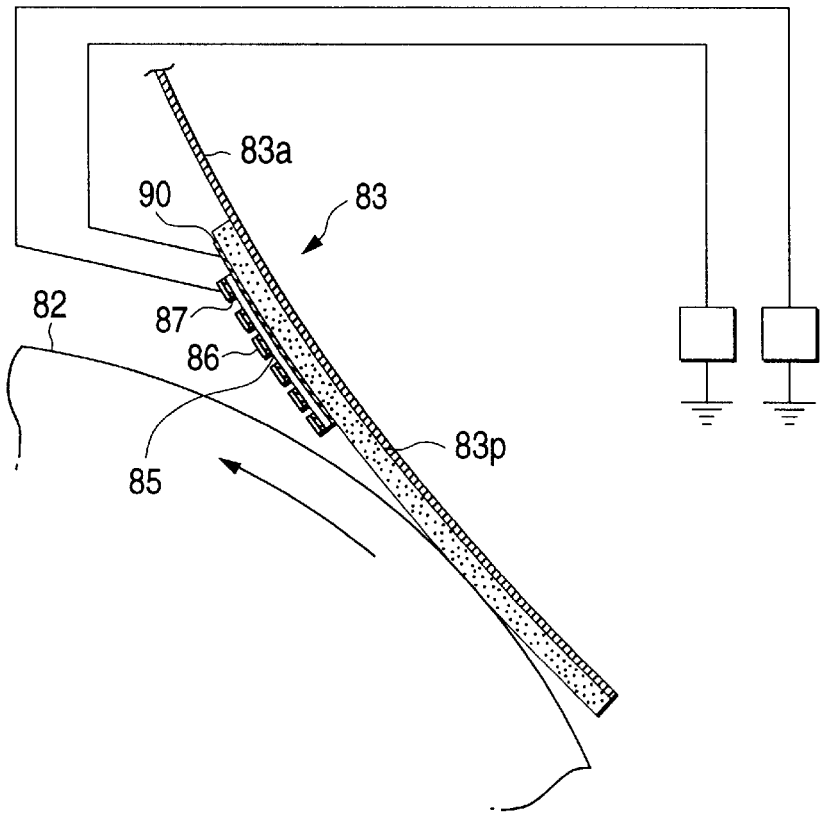

FIGS. 11A and 11B are schematic representations illustrating a photographic developing apparatus according to the first embodiment of the present invention.

In this photographic developing apparatus, a layer forming member 83 for forming a toner layer on a developing powder carrier 82 and an electric charge imparting member 85 are assembled into one unit. A feeding member 90 is bonded to the surface of the layer forming member 83, and the electric charge imparting member 85 is placed on the feeding member 90. An insulating layer 87 is formed on the surface of the electric charge imparting member 85, and a conductive electrification control member 86 is stacked on the electric charge imparting member 85 with the insulating layer 87 between them.

The layer forming member 83 has a plate-like retaining member 83*a* and a resilient member 83*b* bonded thereto and is supported so as to be pressed against the developing powder carrier 82. The front end of the layer forming member 83 is directed upstream with respect to the direction in which the developing powder carrier 82 rotates. The amount of toner is regulated by passage of toner formed on the developing powder carrier 82 through a nipping section where the layer forming member 83 is pressed against the developing powder carrier 82.

The electric charge imparting member 85 and the electrification control member 86 are formed in the surface area of the layer forming member 83 closer to its supported end with reference to the nipping section where the resilient member comes into contact with the developing powder carrier 82. The electrification control member 86 is placed so as to be spaced away from and opposite to the developing powder carrier 82.

In other respects, the photographic developing apparatus of this embodiment is the same as that shown in FIG. 1.

In this photographic developing apparatus, toner passes through the nipping section between the developing powder carrier 82 and the layer forming member 83 as a result of rotation of the developing powder carrier 82, and a toner layer is formed on the photographic developing member 82. The toner layer passes through an area where it becomes opposite to the electrification control member 86, thereby causing electric discharge. Of negative and positive ions resulting from the electric discharge developing between the electric charge imparting member 85 and the electrification control member 86, only electrons or negative ions are imparted to the toner by means of an electric field developing between the developing powder carrier 82 and the electrification control member 86.

The toner-electrifying capability of such a photographic developing apparatus was ascertained. The toner of the opposite polarity constitutes 0.1% by weight or less and superior results are acknowledged. The electric charge imparting member 85 and the layer forming member 83 are supported in the form of one unit, enabling a reduction in the size and cost of the photographic developing apparatus.

Figure 12:
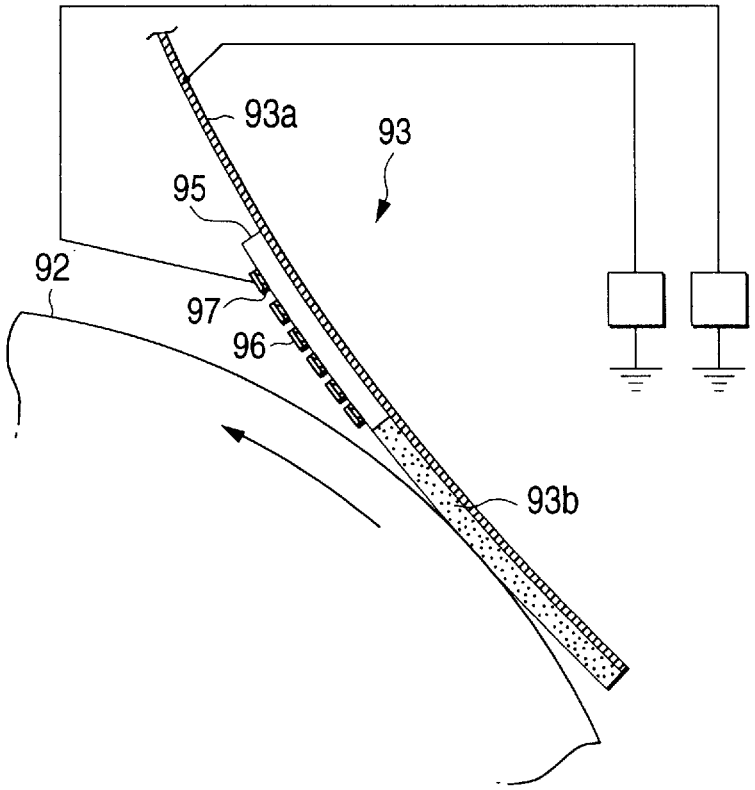
FIG. 12 is an enlarged view illustrating the construction of an electric charge imparting member and an electrification control member of a photographic developing apparatus according to the second embodiment of the present invention.

FIG. 12 is an enlarged view illustrating a photographic developing apparatus in the vicinity of an electrification control member according to the second embodiment of the present invention.

In this photographic developing apparatus, a feeding member doubles as a retaining member 93*a* of a layer forming member 93, and an electric charge imparting member 95 consisting of semi-conductive material and a resilient member 93*b* are formed side by side. An insulating layer 97 is formed on the surface of the electric charge imparting member 95, and a conductive electrification control member 96 is stacked on the electric charge imparting member 95 via the insulating layer 97. The electrification control member 96 is provided so as to be spaced away from and opposite to a developing powder carrier 92.

In other respects, the photographic developing apparatus of this embodiment is the same as that shown in FIG. 1.

In this photographic developing apparatus, a toner layer is formed on the developing powder carrier 92 by the layer forming member 93, and the thus-formed toner layer passes through a position where it becomes opposite to the electrification control member 96. Of negative and positive ions resulting from electric discharge developing between the electric charge imparting member 95 and the electrification control member 96, only electrons or negative ions are imparted to toner by means of the electric field developing between the developing powder carrier 92 and the electrification control member 96. As a result, the toner can be substantially uniformly electrified.

Figure 13:
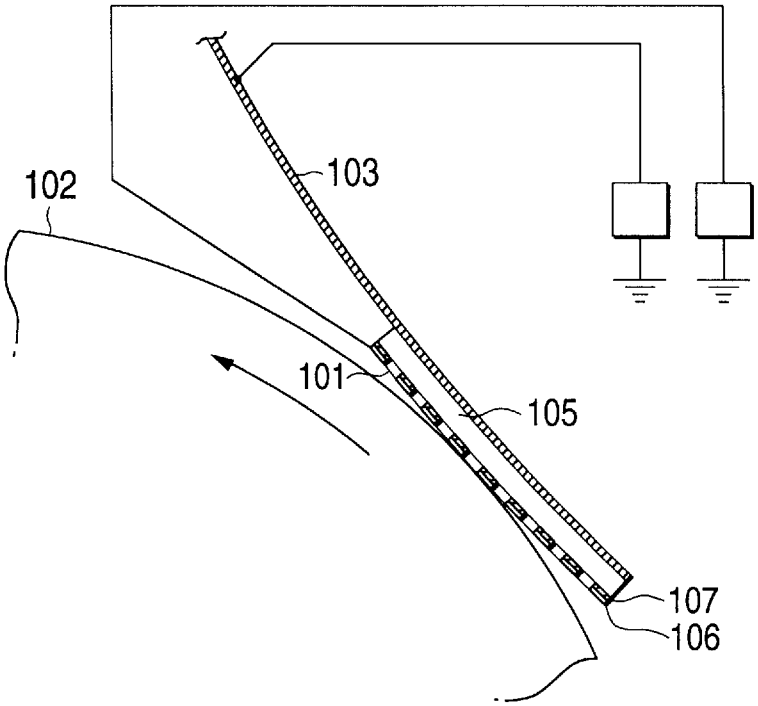
FIG. 13 is an enlarged view illustrating an electric charge imparting member and an electrification control member of a photographic developing apparatus according to the third embodiment of the present invention.
Figure 14:
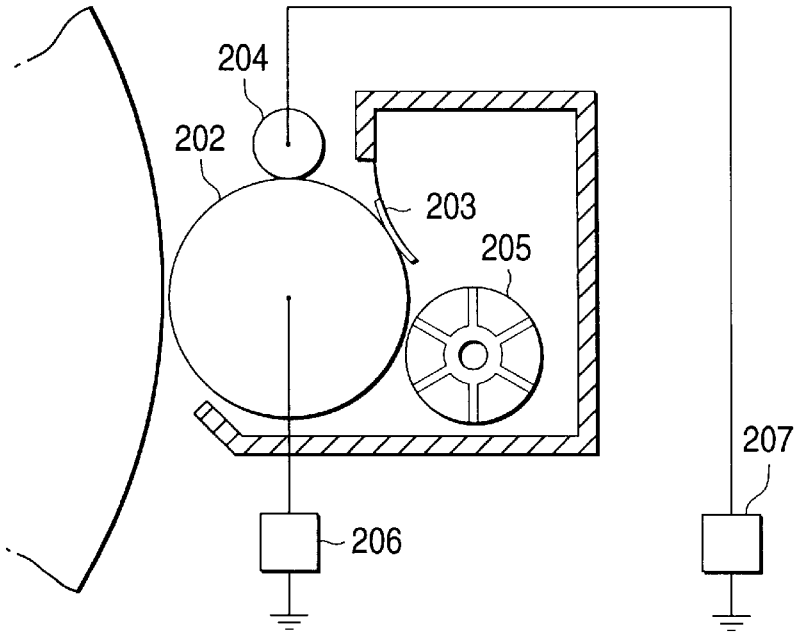
FIG. 14 PRIOR ART
FIG. 14 is a schematic representation illustrating one example of a conventional photographic developing apparatus.
Figure 15:
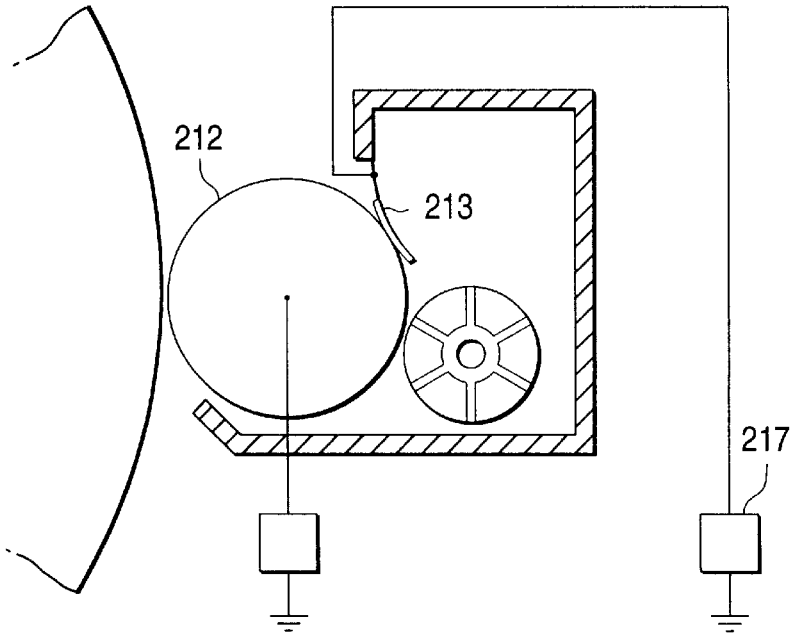
FIG. 15 PRIOR ART
FIG. 15 is a schematic representation illustrating another example of the conventional photographic developing apparatus.
Figure 16:
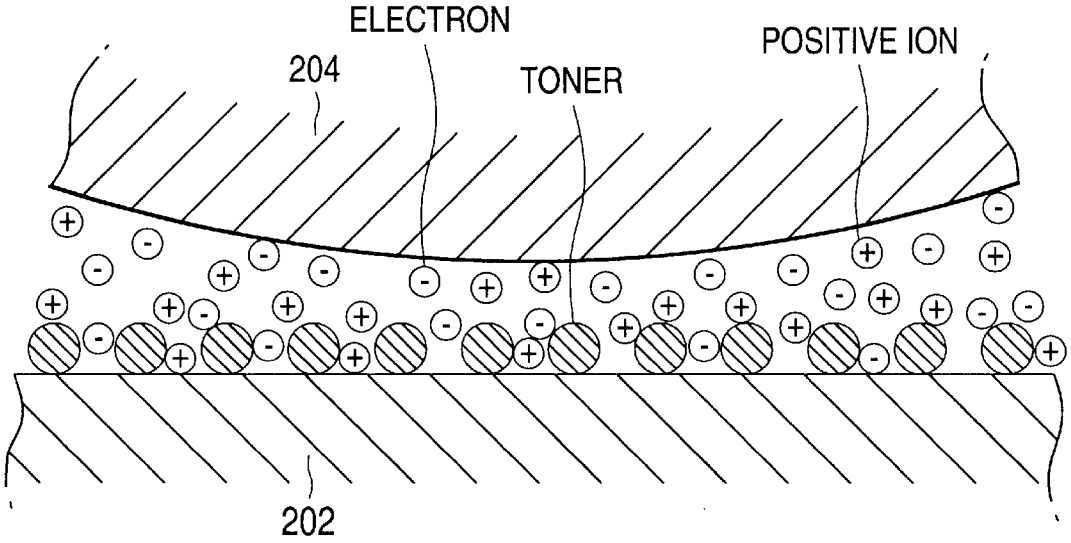
FIG. 16 PRIOR ART
FIG. 16 is a schematic representation illustrating the electrification of developing powder formed on a developing powder carrier of the conventional photographic developing apparatus.
Figure 17:
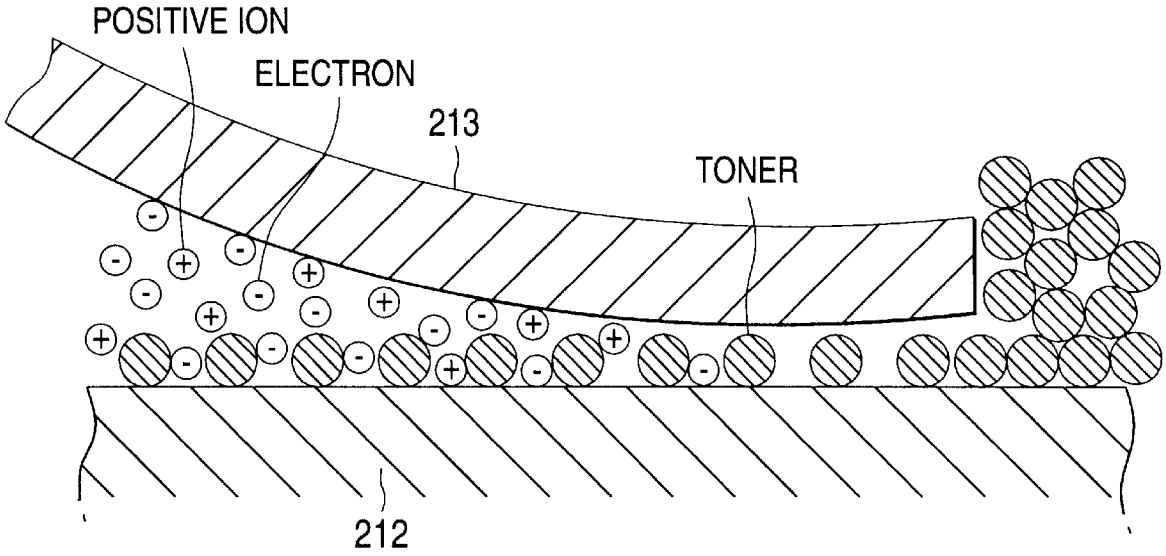
FIG. 17 PRIOR ART
FIG. 17 is a schematic representation illustrating the electrification of developing powder formed on a developing powder carrier of the conventional photographic developing apparatus.
Figure 18A:
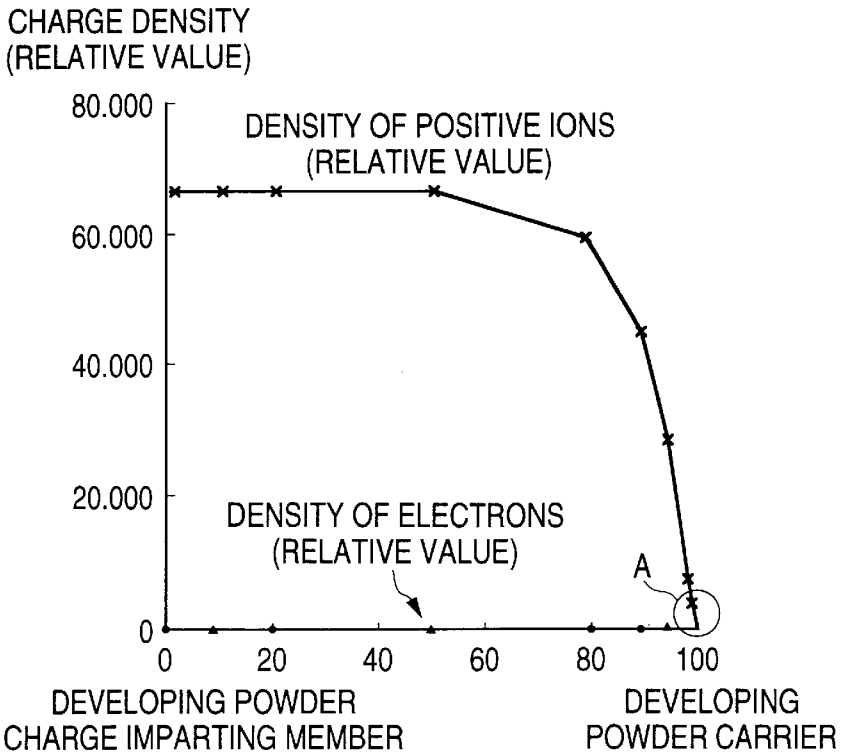
FIGS. 18A and 18B are plots illustrating the density of electric charge between a developing powder electrifying member and the developing powder carrier of the photographic developing apparatus.
Figure 18B:
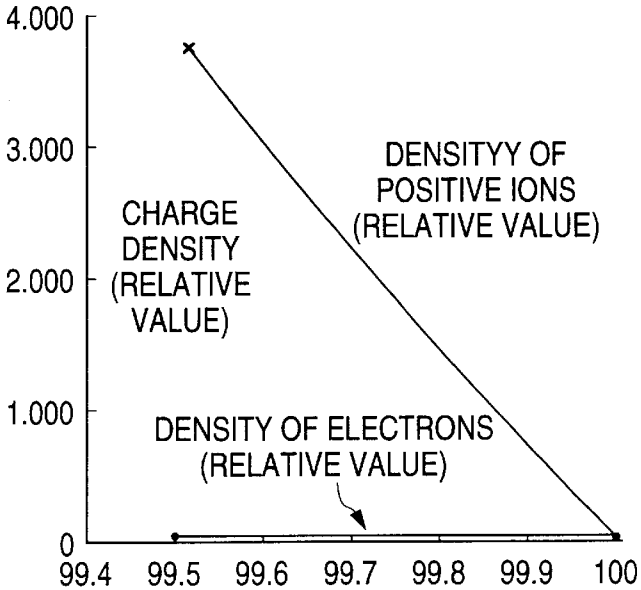

FIG. 13 is an enlarged view illustrating a photographic developing apparatus in the vicinity of an electrification control member according to the third embodiment of the present invention.

In this photographic developing apparatus, an electric charge imparting member 105 consisting of a plate-like semi-conductive material is bonded to the front end of a conductive retaining member 103 and also doubles as a toner layer forming member. A conductive electrification control member 106 is stacked on the surface of the electric charge imparting member 105 via an insulating layer 107. A protective film 101 having minute pores smaller than the size of a toner particle formed therein is provided on the surface of the electrification control member 106. For example, fluororesin is used for this protective film 101.

In other respects, the photographic developing apparatus of this embodiment is the same as that shown in FIG. 1.

In this photographic developing apparatus, the electric charge imparting member 105 is pressed against a developing powder carrier 102 to thereby form a toner layer thereon. Of negative and positive ions resulting from electric discharge developing between the electric charge imparting member 105 and the electrification control member 106, only electrons or negative ions are imparted to the toner layer. As a result, the toner can be electrified with a substantially uniform polarity. The protective film 101 is formed on the surface of the electrification control member 106, enabling prevention of the toner from sticking to the electrification control member 106 and, hence, resulting in uniform electrification of the toner.

In the photographic developing apparatus of the foregoing embodiments, if the conductive electrification control member comes into direct contact with the electric charge imparting member or the developing powder carrier, a insulting coat may be provided on the surface of the electric charge imparting member. Variations in the potential of the electric charge imparting member and leakage of electric charges can be reduced, enabling electrification of toner in a more uniform manner.

[EXAMPLE]

To ascertain the toner-electrifying capability of the photographic developing apparatus of the present invention, a print test was carried out for a long period of time under the following conditions. A photographic developing apparatus identical to the photographic developing apparatus shown in FIG. 4 was used in this test.

Image carrier: Negatively-charged organic photosensitive material

Electrification control member: A cylindrical film which consists of conductive material having a thickness of 100 $\mu$m, and minute pores having a diameter of 80 $\mu$m are formed in the film at a hole-area rate of 80%.

Electric charge imparting member: Roll member having a diameter of 10 mm.

Material of a layer covering the circumferential surface of the electric charge imparting member: Silicon rubber having conductive particles mixed therein Rubber hardness: 60 degrees Volume resistivity: $10^8$ Ω·cm Developing powder carrier: Having a diameter of 20 mm Roll having a surface rubber layer ($10^6$ Ω·cm)

Stirring-and-supply member: Having a diameter of 10 mm

Roll consisting of a semi-conductive sponge material

Layer forming member: A leaf spring which is made of SUS 303 and has a thickness of 0.12 mm, and EPDM rubber having a thickness of 1 mm is bonded to the leaf spring.

Bonding pressure is about 30 gf/cm.

Volume resistivity of $10^5$ Ω·cm, and

Rubber hardness of 50 degrees

Electric potential of a latent image: −100 V

Electric potential of a background: −350 V

As a result of the print test having been made under the foregoing conditions, there was found neither background fog nor splashing of toner to the inside of the photographic developing apparatus due to the toner of the opposite polarity. It is acknowledged that the photographic developing apparatus has superior persistency.

Embodiments of the present invention will be described with reference to the accompanying drawings.

Figure 19:
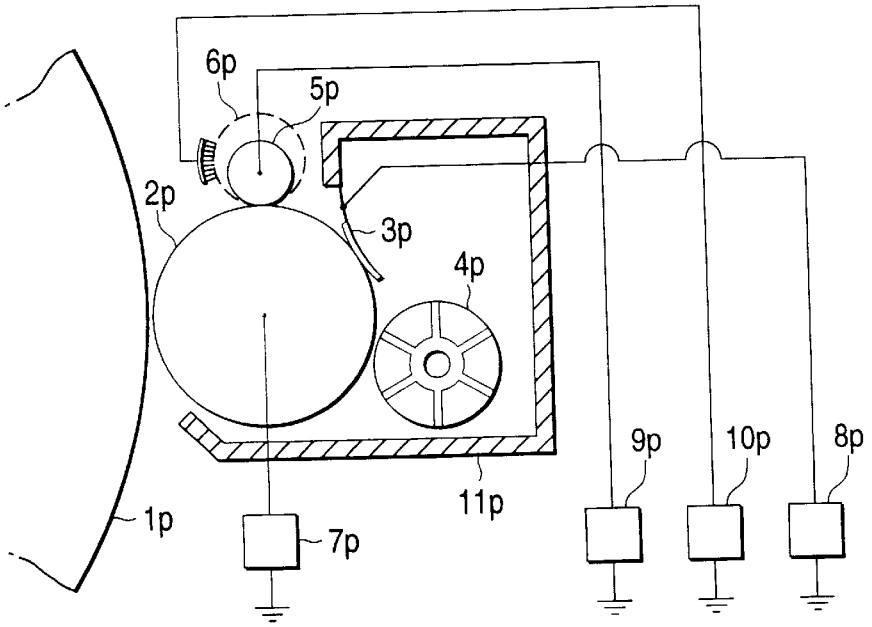
FIG. 19 is a schematic diagram illustrating a photographic developing apparatus according to one (p) embodiment of the present invention.

FIG. 19 is a schematic diagram illustrating a photographic developing apparatus which is one (p) embodiment of the present invention.

This photographic developing apparatus is placed so as to be opposite to an image carrier 1*p* capable of forming a latent image thereon by means of a charge potential difference. A housing 11*p* contains a developing powder carrier 2*p* which is positioned in close proximity to and opposite the image carrier 1*p* and carries toner while the toner is adhered to the surface of the developing powder carrier 2*p*; a layer forming member 3*p* which forms a layer of toner by limiting the toner on the developing powder carrier; a stirring-and-supply member 4*p* which stirs the toner and supplies it to the developing powder carrier 2*p*; an electric charge imparting member 5*p* which is positioned so as to be opposite to the developing powder carrier 2*p* and produces electric discharge between the gap between the electric charge imparting member. 5*p* and the developing powder carrier 2*p*; and an electrification control member 6*p* which is interposed between the electric charge imparting member 5*p* and the developing powder carrier 2*p* and limits an ionization area caused by the electric discharge developing between them. Further, the photographic developing apparatus comprises a developing power source 7*p* which applies a voltage for developing purposes between the developing powder carrier 2*p* and the image carrier 1*p*; a charge reducing power source 8*p* for applying to the layer forming member 3*p* a voltage used for reducing the amount of electric charges of toner provided on the developing powder carrier 2*p*; a toner electrifying power source 9*p* which applies between the developing powder carrier 2*p* and the electric charge imparting member 5*p* a voltage used for electrifying toner; and an electrification control power source 10*p* which applies to the electrification control member 6*p* a voltage used for limiting an ionization area.

The developing powder carrier 2*p* is rotatively supported, and a d.c. current of about −200 V having the same polarity as that of the toner is applied to the developing powder carrier 2*p* from the developing power source 7*p*. As a result, an electric field is formed between the developing powder carrier 2*p* and the image carrier 1*p*, and the toner is transferred to the latent image formed on the image carrier 1*p*. Irregularities having Ra=about 0.1 to 5.0 $\mu$m are formed in the developing powder carrier 2*p* by cutting a round bar or pipe of aluminum or stainless steel, and subjecting the outer surface of the thus-cut bar or pipe to chemical etching or machining such as sand blasting, liquid honing or emery polishing. Alternatively, the developing powder carrier may be formed by cutting a round bar or pipe of aluminum or stainless steel, and coating the surface of the bar or pipe with a resin layer having conductive powder dispersed therein. The developing powder carrier 2*p* of the present embodiment has a diameter of 20 mm and is formed to have irregularities of Ra=0.5 μm or thereabouts by cutting an aluminum pipe and subjecting the outer surface of the aluminum pipe to sand blast anodization. In order to ensure developing performance, the voltage applied from the power source 7*p* may be a voltage which consists of a d.c. voltage superimposed on an a.c. voltage.

The layer forming member 3*p* is made by placing a contact member (which consists of silicon rubber including ion-conductive material and having a volume resistivity of $10^4$ to $10^{10}$ Ω·cm or thereabouts) on a leaf spring of stainless steel having a thickness of 0.1 mm via a conductive adhesive in a doctored manner. In order to improve the abrasion resistance of the layer forming member 3*p* required at the time of formation of a toner layer, the surface of the layer forming member 3*p* is cured. Since it is not necessary for the layer forming member 3*p* to frictionally electrify toner, the minimum linear load which permits the limitation of layer thickness is set to 15 to 17 g/cm$^2$. Rubber having a hardness of 20 to 80 degrees can be used for the contact member, and rubber having a hardness of 30 to 60 degrees is suitable for the contact member. A toner layer is formed on the developing powder carrier 2*p* to a thickness of about 5 to 30 μm by pressing the toner against the developing powder carrier 2*p*.

Figure 20:
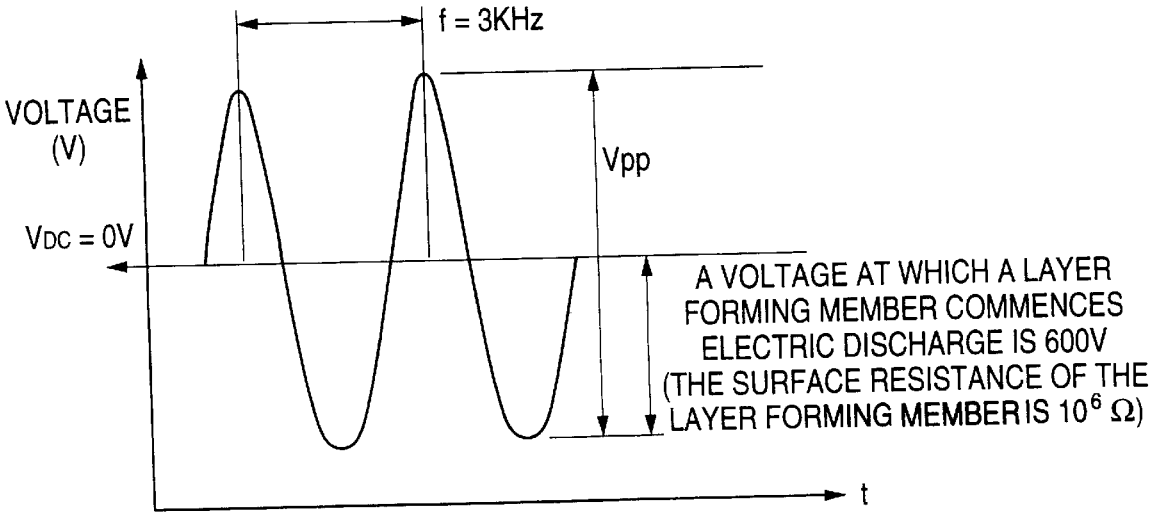
FIG. 20 is a schematic representation showing a charge reducing voltage applied to a layer forming member of the photographic developing apparatus.

As shown in FIG. 20, voltage applied to the layer forming member 3*p* from the charge reducing power source 8*p* is set to an a.c. voltage having a d.c. offset voltage of 0, a frequency "f" of 3 kHz, and a peak-to-peak voltage of 1200 V which is double as large as a discharge start voltage of 600 V required for the layer forming member. If the peak-to-peak voltage is greater than 3 kV, electric charge becomes apt to escape by means of a high voltage. For this reason, it is desirable to prevent the peak-to-peak voltage from exceeding 3 kV. The frequency "f" is set into the range in which toner does not travel back and forth between the layer forming member 3*p* and the developing powder carrier 2*p* pursuant to the frequency. The reason to set the applied voltage to this range will be described later.

The electric charge imparting member 5*p* is cylindrically formed and is supported so as to be rotatable around the axis. The electric charge imparting member 5*p* is formed from an ion-conductive material or rubber having conductive fine particles mixed therein, either of which has a volume resistivity of about $10^5$ to $10^{10}$ Ω·cm. A particularly desirable volume resistivity is around $10^7$ to $10^8$ Ω·cm. Further, a semi-conductive silicon rubber roller having conductive particles mixed therein may be used for the electric charge imparting member 5*p*.

The electrification control member 6*p* is made of a mesh member of stainless steel having a line size of 50 μm and a line pitch of 127 μm and is formed into a cylindrical shape having a diameter larger than that of the electric charge imparting member 5*p*. The electric charge imparting member 5*p* is housed in the electrification control member 6*p*. This electrification control member 6*p* is sandwiched between the electric charge imparting member 5*p* and the developing powder carrier 2*p* and rotates while the developing powder carrier 2*p* is opposite to the electric charge imparting member 5*p* with a part of the electrification control member 6*p* sandwiched between them. At this time, the electrification control member 6*p* is rotatively driven to follow the rotation of the developing powder carrier 2*p*.

To negatively electrify the toner on the developing powder carrier 2*p*, an electric field is produced so as to commence electric discharge between the electric charge imparting member 5*p* and the electrification control member 6*p*. Specifically, an electric field is formed so as to have a gradient which is sufficiently small to prevent electric discharge between the electrification control member 6*p* and the developing powder carrier 2*p*, in such a direction as to attract negative electric charge toward the developing powder carrier 2*p*. To this end, a relationship of electric potential between the electrification control member 6*p* and the developing powder carrier 2*p* is maintained at the following relationship.

(Electric potential of the developing powder carrier)−(Electric potential of the electrification control member)=100 V A relationship of electric potential between the electric charge imparting member 5*p* and the electrification control member 6*p* is maintained at the following relationship (Electric potential of the electrification control member)−(Electric potential of the electric charge imparting member)=1000 V The electric potentials of these members are determined depending on the pitch between the electric charge imparting member 5*p* and the developing powder carrier 2*p* and the structure and thickness of the electric control member 6*p*, as required. If the electric charge imparting member 5*p*, the electrification control member 6*p*, and the developing powder carrier 2*p* are provided at intervals, the electric potentials are determined in consideration of these intervals. In the embodiment, a voltage of −200 V is applied to the developing powder carrier 2*p* from the power source 7*p*, and a voltage of −300 V is applied to the electrification control member 6*p* from the power source 7*p*. A voltage of −1300 V is applied to the shaft of the electric charge imparting member 5*p* from the power source 9*p*.

Developing powder used in the photographic developing apparatus is one-component toner. The developing powder is formed by dispersing a polarization suppressing agent such as pigments or metal-complex azo dyes into various types of elastic resin such as styrene resin, acrylic resin or polyester resin and is pulverized and classified into a size ranging from 3 to 20 μm (a mean granular size of 7 μm). A charge control agent is added to the thus-produced developing powder, so that the developing powder is imparted with negative electric charge. Fine particles having a size of 0.1 μm or less such as silica, alumina, or titanium, all of which are processed to be hydrophobic, are used as the charge control agent. Of these elements, hydrophobic silica is most desirable, and a fluid assistant for use with toner is applied to the outside of the developing powder particles.

Selenium-based photosensitive materials or organic photosensitive materials are used for the image carrier 1*p*, and the image carrier 1*p* may come into contact with the developing powder carrier 2*p*. Alternatively, they may be positioned so as to be opposite to each other with a gap of about 100 to 400 μm between them.

In this photographic developing apparatus, toner stored in the housing 1*p* is stirred by rotation of the stirring-and-supply member 4*p*, and the thus-stirred toner is fed to the developing powder carrier 2*p*. Toner placed in the vicinity of the surface of the developing powder carrier 2*p* is carried to the position where the developing powder carrier 2*p* is opposite to the layer forming member 3*p* by rotation of the developing powder carrier 2*p*. A toner layer is formed on the developing powder carrier 2*p* by a pressing force of the layer forming member 3*p*. At this time, a.c. voltage is applied to the layer forming member 3*p* from the power source 8*p*, and a vibrating electric field is formed in the area where the layer forming member 3*p* is opposite to the developing powder carrier 2*p*. A large potential difference then arises between the layer forming member 3*p* and the developing powder carrier 2*p*, thereby causing electric discharge between the minute gap between them. The amount of electric charges of the toner particles provided on the developing powder carrier 2*p* is reduced by the electric discharge caused by the vibrating electric field and converges on the vicinity of 0V. For this reason, even if the toner placed on the developing powder carrier 2*p* includes both the toner still remaining on the developing powder carrier 2*p* after passage of the developing area and the toner newly supplied by the stirring-and-supply member 4*p*, the amount of electric charges of these toner particles is reduced to a substantially uniform quantity.

Figure 21:
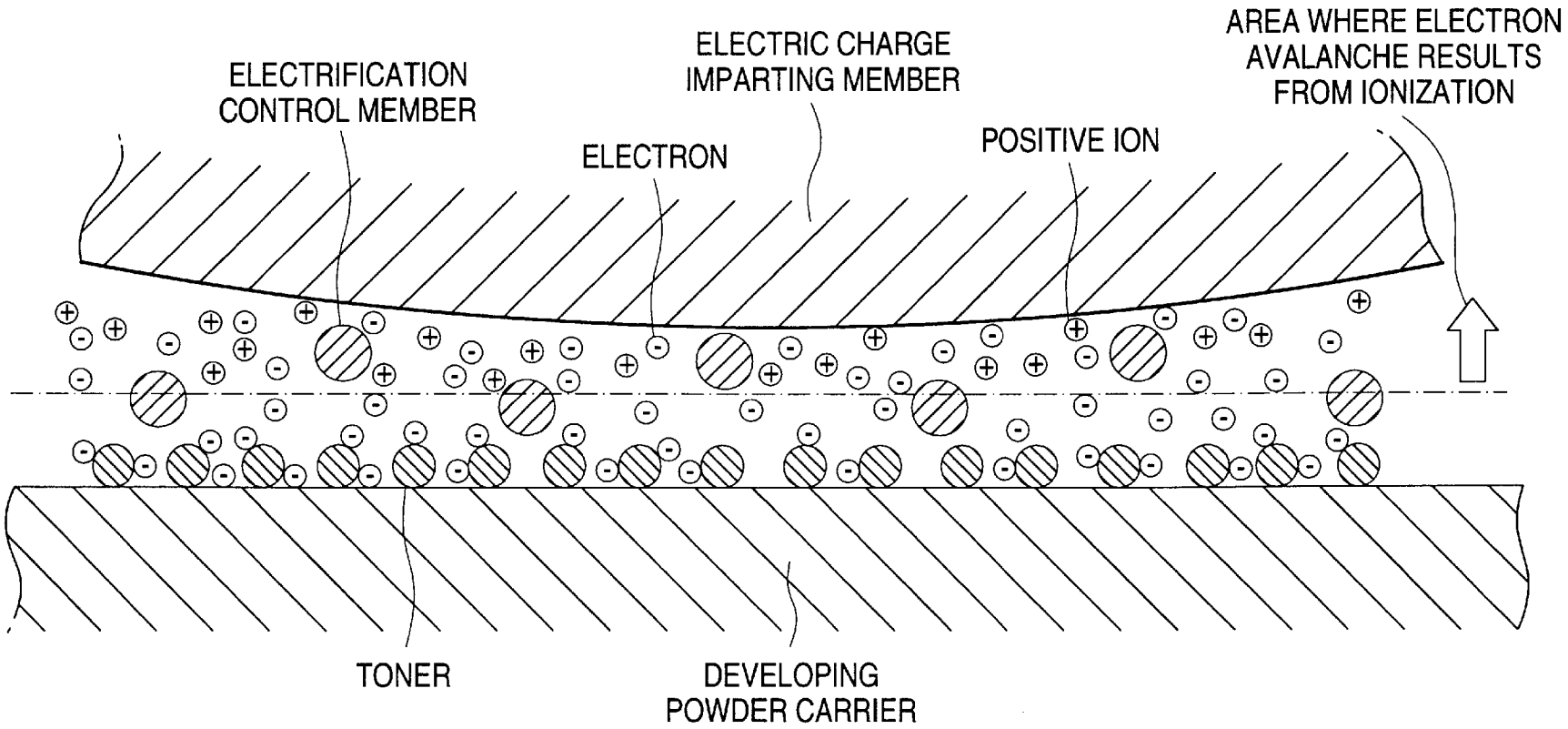
FIG. 21 is a schematic representation illustrating the mechanism of electrification of developing powder on a developing powder carrier in the photographic developing apparatus.

Subsequently, the toner layer is carried to the position where the developing powder carrier 2*p* is opposite to the electric charge imparting member 5*p* and the electrification control member 6*p*. At this time, the previously-described voltages are applied to the gap between the electric charge imparting member 5*p* and the electrification control member 6*p* and the gap between the electrification control member 6*p* and the developing powder carrier 2*p*, respectively. Electric fields are produced in these gaps. These electric fields permit only the electric charge imparting member having an electric field greater than the discharge start electric field to cause electric discharge, and the electric field of the developing powder carrier 2*p* which is smaller than the discharge start electric field does not cause ionization. Accordingly, as shown in FIG. 21, positive ions are produced in the vicinity of the electric charge imparting member 5*p* as a result of ionization associated with the electric discharge in addition to the negative ions or electrons. In contrast, ionization does not occur in the vicinity of the developing powder carrier 2*p*, and negative ions or electrons are attracted toward the developing powder carrier 2*p* by the action of the electric field occurred between the electrification control member 6*p* and the developing powder carrier 2*p*. The electric charges adhere to the toner provided on the developing powder carrier 2*p*, so that the toner is electrified. As a result, the positive ions resulting from ionization are only present in and attracted toward the electric charge imparting member 5*p* and are prevented from sticking to the toner provided on the developing powder carrier 2*p*. For this reason, the toner of the opposite polarity is prevented.

The toner layer thus uniformly imparted with electric charge is conveyed to the developing area where it becomes opposite to the image carrier 1*p* by rotation of the developing powder carrier 2*p*. The toner is transferred to the latent image formed on the image carrier 1*p* by a developing electric field formed between the developing powder carrier 2*p* and the image carrier 1*p*, whereby photographic developing operations are performed.

Subsequently, the toner still remaining on the developing powder carrier 2*p* is returned to the photographic developing apparatus as a result of rotation of the developing powder carrier 2*p*, and toner is newly supplied to the developing powder carrier 2*p* by the stirring-and-supply means 4*p* in addition to the residual toner. The toner again passes through the position where it becomes opposite to the layer forming member 4*p* to thereby form a toner layer on the developing powder carrier 2*p*. The amount of electric charges of the toner particles is reduced to a substantially uniform quantity by the a.c. voltage applied from the power source 8*p*. As a result, the toner can be electrified once the amount of electric charges of the toner has been reduced, enabling electrification of toner to a substantially uniform electric potential.

An explanation will be given of the result of measurement of the electric potential of the toner layer on the developing powder carrier 2*p* performed after application of a charge reducing voltage to the layer forming member 3*p* in this photographic developing apparatus.

Figure 22:
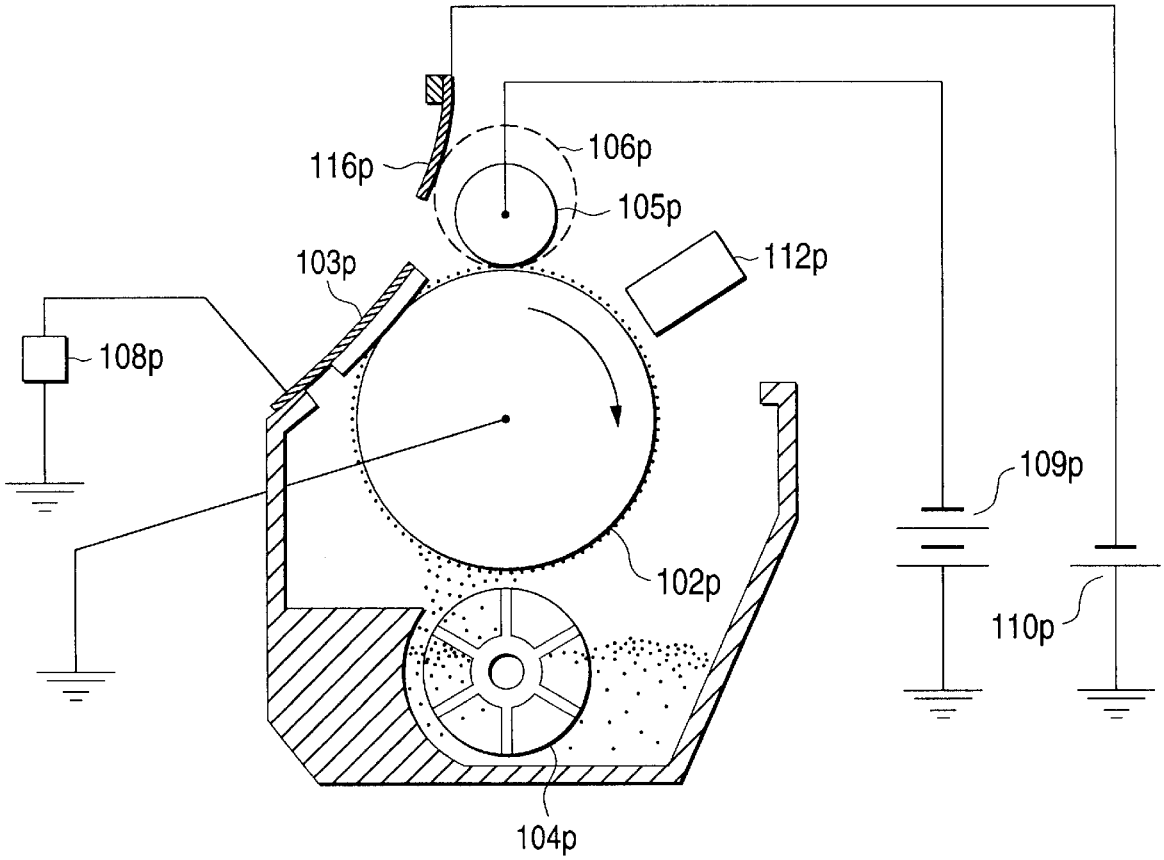
FIG. 22 is a schematic representation showing a device for measuring the electric potential of the toner provided on the developing powder carrier.

A potential measurement apparatus as shown in FIG. 22 is used for measuring the electric potential of the toner layer.

As is the case with the foregoing photographic developing apparatus, the photographic developing apparatus is comprised of a developing roller 102*p*, a layer forming member 103*p*, a stirring-and-supply member 104*p*, an electric charge imparting member 105*p*, and an electrification control member 106*p*. Further, the photographic developing apparatus is comprised of a power source 108*p* for applying to the layer forming member 103*p* a.c. voltage used for reducing the electric charge of toner; a charge imparting member power source 109*p*; and a power source 110*p* for applying a voltage to the electrification control member 106*p* via a conductive feeding member 116*p*. A potential measuring device (ESV) 112*p* for measuring the electric potential of the toner is provided downstream from the position where the developing roller 102*p* is opposite to the electric charge imparting member 105*p*. After the amount of electric charges of the toner layer formed on the developing roller 102*p* has been reduced by the layer forming member 103*p*, desired electric charge is applied to the toner by the electric charge imparting member 105*p* and the electrification control member 106*p*. After that, the amount of electric charges of the toner is measured by the potential measuring device 112*p*.

From the potential of the toner on the developing roller 102*p* measured through use of the potential measuring device 112*p*, it is ascertained that the toner is electrified to −7 $\mu$C/g to −12 $\mu$C/g. At this time, the toner of the opposite polarity constitutes 0.1% by weight or less, and the toner is electrified with a uniform polarity.

The result of the study on the relationship between the number of rotations of the developing powder carrier and the electric potential of the toner is now explained.

Figure 23A:
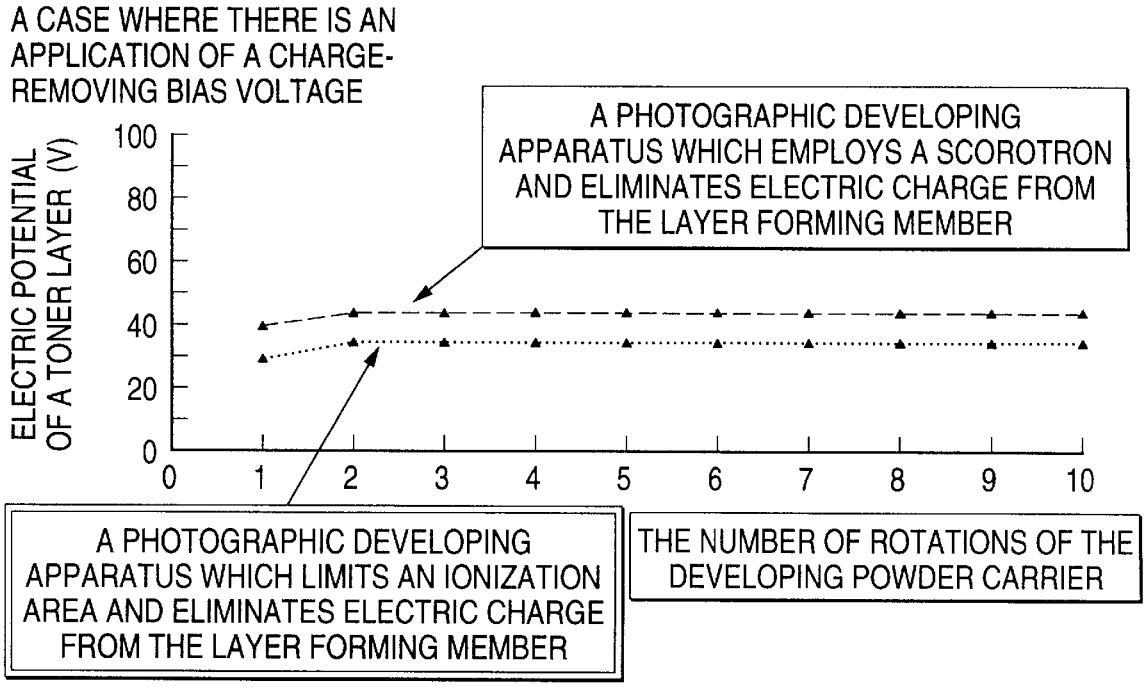
FIGS. 23A and 23B are plots illustrating the comparison between the photographic developing apparatus of the present invention and a conventional photographic developing apparatus with regard to the relationship between the number of rotations of the developing powder carrier and the electric potential of a developing powder layer formed on the developing powder carrier.
Figure 23B:
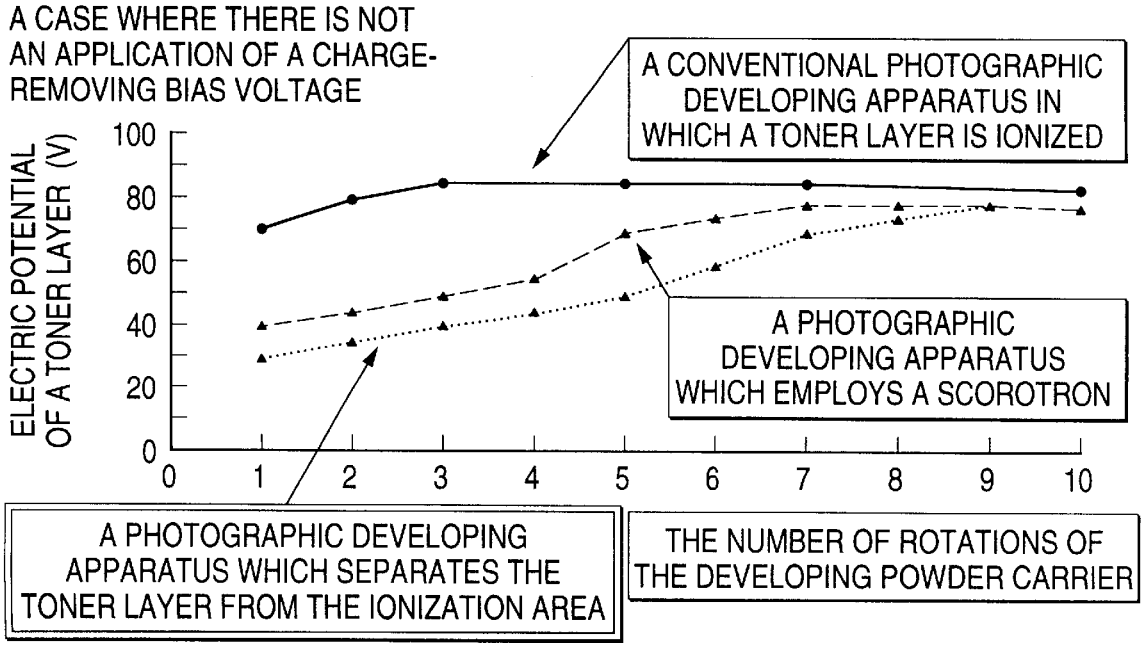
FIG. 23B PRIOR ART

FIG. 23A is a plot showing the relationship between the number of rotations of the developing powder carrier and the electric potential of the toner layer laid on the developing powder carrier obtained when the charge reducing voltage is applied to the developing powder carrier in the previously-described photographic developing apparatus. FIG. 23B is a plot showing the relationship when there is no application of the charge reducing voltage.

As shown in FIG. 23A, when the charge reducing voltage is applied to the developing powder carrier, a stable quantity of electric charge of the toner is obtained from the first cycle of the developing processing. In contrast, as shown in FIG. 23B, when the charge reducing voltage is not applied to the developing powder carrier, it is seen that the amount of electric charges of the toner gradually increases from the first cycle and finally becomes stable in the tenth cycle. Therefore, it is understood that there is an obvious difference due to cyclic characteristics between the case where there is an application of the charge reducing voltage and the case where there is no application of the charge reducing voltage in terms of the amount of electric charges of the toner. It is also ascertained that the stable cyclic characteristics as shown in FIG. 23A do not depend on the rotating speed of the developing powder carrier.

As shown in FIG. 23B, when the photographic developing apparatus that does not apply the charge reducing voltage to the developing powder carrier is compared to the conventional photographic developing apparatus, it is understood that the electrifying capability of the photographic developing apparatus is too low to electrify the toner layer on the developing powder carrier to saturation in one cycle. The reason for this is that the photographic developing apparatus of the present invention takes only negative ions out of the ionization area. Therefore, compared to the conventional-electrifying type photographic developing apparatus which ionizes the toner layer without use of the electrification control member, the photographic developing apparatus of the present invention has a lower degree of electrifying capability. If the electric charge of the toner is removed during the formation of the toner layer, the electric charge imparted to the toner in the first cycle naturally continues in the following cycles. The electric charge of the toner has a disposition to increase as the potential difference between the electric charge imparting member 5*p*, the electrification control member 6*p*, and the developing powder carrier 2*p*. The amount of electric charges of the toner can be controlled to an arbitrary quantity by correctly setting a bias voltage to be applied.

The foregoing photographic developing apparatus can also employ a scorotron as an electric charge imparting mechanism in lieu of the electric charge imparting member 5*p* and the electrification control member 6*p*.

According to the test, even in the case of the photographic developing apparatus which uses the scorotron, the toner of the opposite polarity does not occur at the time of electrification of the toner on the developing powder carrier. Further, as shown in FIG. 23A, when the charge reducing voltage is applied to the layer forming member, it is ascertained that a stable quantity of electric charge of the toner is obtained in the first cycle. In contrast, as shown in FIG. 23B, it is understood that if there is no application of the charge reducing voltage, the amount of electric charges of the toner gradually increases from cycle to cycle and becomes stable after passage of several cycles. Thus, even in the case of the photographic developing apparatus that uses the scorotron, the toner can be uniformly electrified in the same manner as previously described. However, in this case, a large amount of ozone occurs, and hence this photographic developing apparatus is not preferable from the viewpoint of environment.

Figure 24:
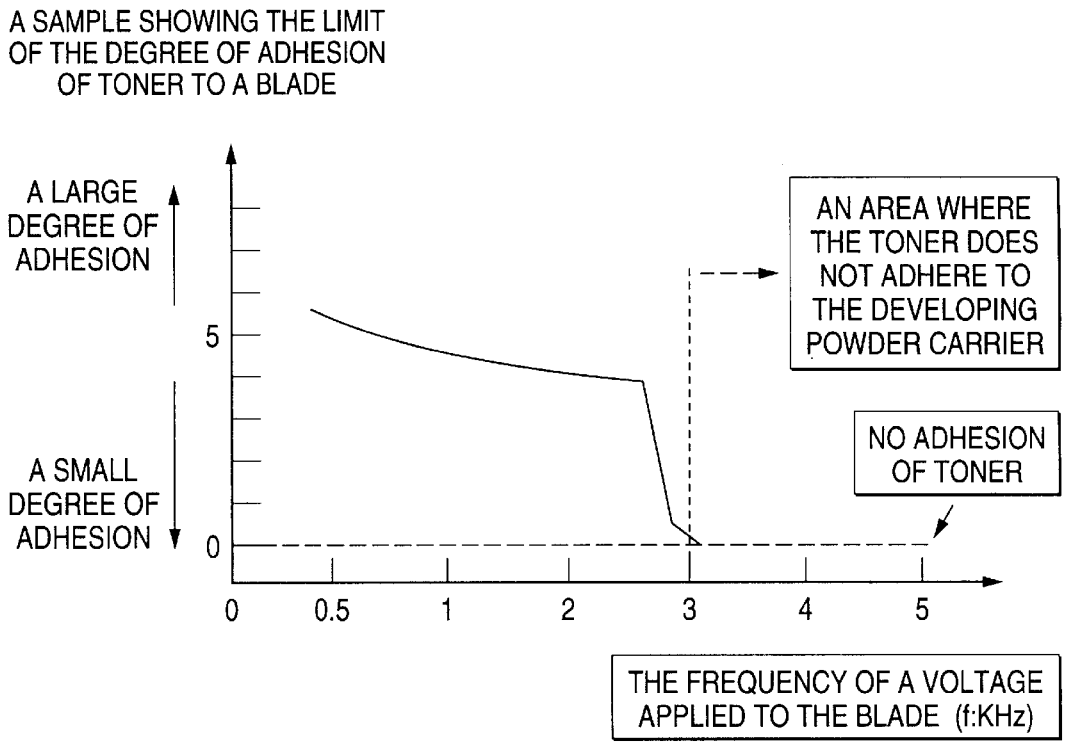
FIG. 24 is a plot showing the relationship between the frequency of a.c. voltage and the degree of adhesion of toner to the layer forming member in the photographic developing apparatus.

FIG. 24 is a plot showing the relationship between the frequency "f" of the a.c. voltage applied to the layer forming member and the degree of adhesion of the toner to the layer forming member.

It has been acknowledged that there is no substantial amount of toner adhered to the layer forming member at a frequency of more than f=3 kHz. The reason for this is that the toner becomes difficult to travel back and forth pursuant to the frequency and hence difficult to stick to the layer forming member.

Figure 25:
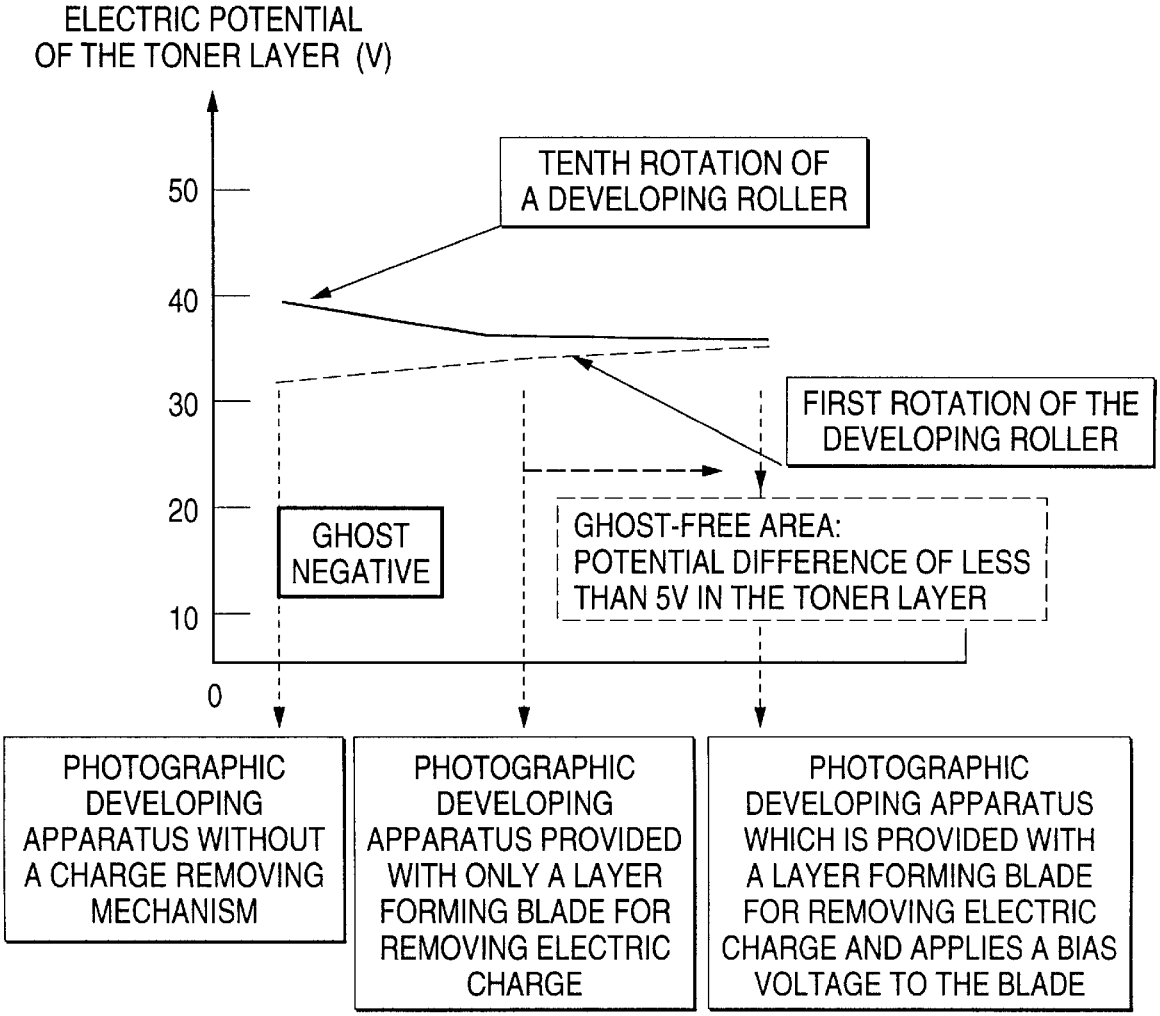
FIG. 25 is a plot showing the comparison between a conventional photographic developing apparatus whose layer forming member is grounded and a photographic developing apparatus which is not provided with a charge reducing mechanism with regard to the state of occurrence of ghost.

FIG. 25 is a plot showing the result of the study on the occurrence of ghosts with regard to a photographic developing apparatus which applies the charge reducing voltage to the layer forming member, a photographic developing apparatus in which the layer forming member is grounded, and a conventional photographic developing apparatus which is not provided with the charge reducing mechanism (the contact member is formed from insulating material).

In the case of the conventional photographic developing apparatus which is not provided with the charge reducing mechanism, there is a potential difference of more than 5V between the first and tenth cycles with regard to the amount of electric charges of the toner, thereby resulting in visible ghosts. In contrast, in the case of the photographic developing apparatus which applies the charge reducing voltage to the layer forming member, there is no substantial difference in the amount of electric charges of the toner between cycles.

Further, even in the case of a photographic developing apparatus in which the layer forming member is grounded, the difference in the amount of electric charges between cycles is reduced. However, it is understood that a more stable quantity of electric charge is achieved by the photographic developing apparatus that applies the charge reducing voltage to the layer forming member.

In addition to the foregoing effects, the photographic developing apparatus of the present embodiment can prevent the flow of an excessive discharge current to the developing powder carrier which would otherwise be caused by local electric discharge. Therefore, the amount of electric charges of the toner is not increased to such an extent that the toner would not be able to contribute to developing treatment. For this reason, an increase in the amount of toner to be transferred can be avoided.

The photographic developing apparatus can also employ a roller or a trimming machine in lieu of the blade which is used as the layer forming member to be pressed against the developing powder carrier.

Figure 26A:
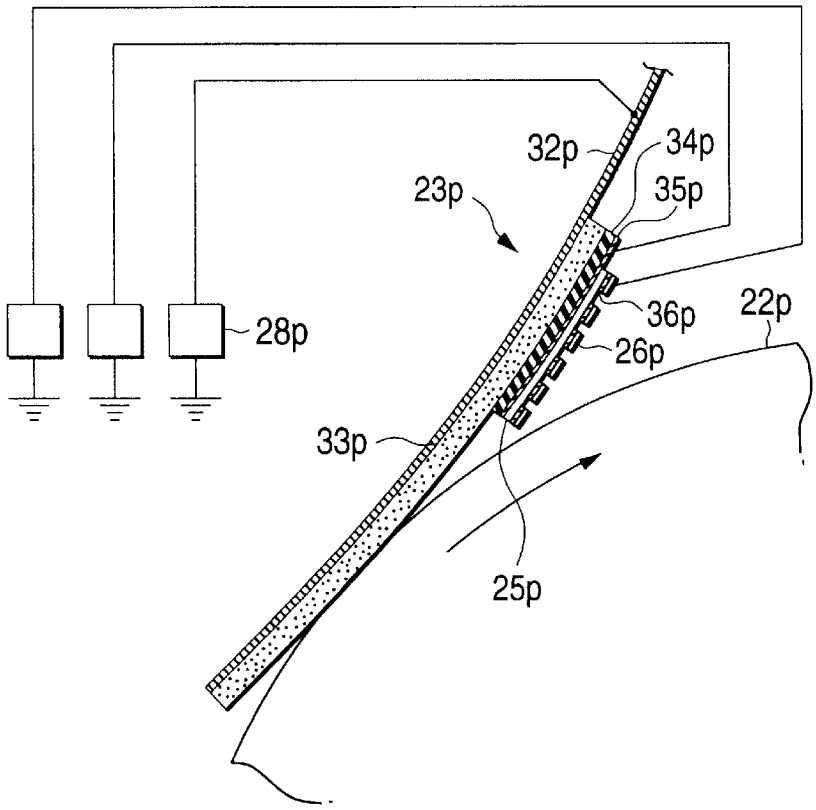
FIGS. 26A and 26B are segmentary views showing the structure of the layer forming member of a photographic developing apparatus according to a second (p) embodiment of the present invention.
Figure 26B:
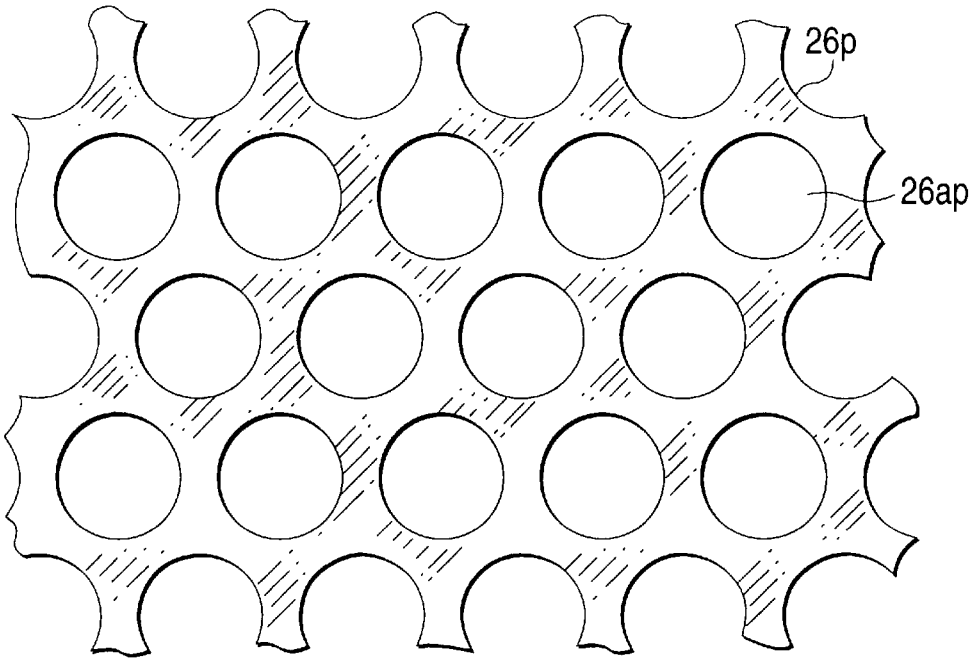

FIGS. 26A and 26B are segmentary views showing the structure of a photographic developing apparatus according to one embodiment of the present invention.

In this photographic developing apparatus, a layer forming member 23*p* for forming a toner layer on a developing powder carrier 22*p* and an electric charge imparting member 25*p* are supported so as to be integral with each other. A conductive feeding member 35*p* is attached to the surface of the layer forming member 23*p* via an insulating layer 34*p*, and the electric charge imparting member 25*p* is provided on the surface of the feeding member 35*p*. An insulating layer 36*p* is formed on the surface of the electric charge imparting member 25*p*, and an electrification control member 26*p* is stacked on the surface of the electric charge imparting member 25*p* via the insulating layer 36*p*.

The layer forming member 23*p* has a semi-conductive resilient member 33*p* bonded to a plate-like conductive feeding member 32*p*, and the resilient member 33*p* is supported so as to be pressed against the developing powder carrier 22*p*. The front end of the layer forming member 23*p* is directed upstream in the direction of rotation of the developing powder carrier 22*p*. The quantity of toner is regulated as result of passage of a nipping area where the layer forming member 23*p* is pressed against the developing powder carrier 22*p*. Further, a.c. voltage similar to the voltage applied to the layer forming member shown in FIG. 19 is applied to the feeding member 32*p* from the power source 28*p*.

The electric charge imparting member 25*p* and the electrification control member 26*p* are formed in the area of the resilient member 33*p* close to its supported end in relation to the contact area where the resilient member 33*p* comes into contact with the developing powder carrier 22*p*. The electrification control member 26*p* is provided so as to be spaced a distance away from and opposite to the developing powder carrier 22*p*. As shown in FIG. 26B, the electrification control member 26*p* is formed from an electrode in which a plurality of pores 26*ap* are formed by electroless plating or laser beam machining.

In other respects, the photographic developing apparatus of this embodiment is the same as that shown in FIG. 19.

In this photographic developing apparatus, the toner passes through the nipping section between the developing powder carrier 22*p* and the layer forming member 23*p* as a result of rotation of the developing powder carrier 22*p*, and a toner layer is formed on the photographic developing member 22*p*. At this time, the charge reducing voltage is applied to the layer forming member 23*p* from the power source 28*p*, thereby reducing the amount of electric charges of the toner particles. The toner layer passes through an area where it becomes opposite to the electrification control member 26*p*, thereby causing electric discharge between the electric charge imparting member 25*p* and the electrification control member 26*p*. Of negative and positive ions resulting from the electric discharge, only electrons or negative ions are imparted to the toner by means of an electric field developing between the developing powder carrier 22*p* and the electrification control member 26*p*.

The toner-electrifying capability of such a photographic developing apparatus was ascertained. It is acknowledged that there is no difference in the amount of electric charges of the toner between developing cycles, and there is obtained a ghost-free picture. Further, the toner of the opposite polarity constitutes 0.1% by weight or less, and the image is superior without any degradation of picture quality such as fog. The electric charge imparting member 25*p* and the layer forming member 23*p* are supported in the form of one unit, enabling a reduction in the size and cost of the photographic developing apparatus.

Figure 27A:
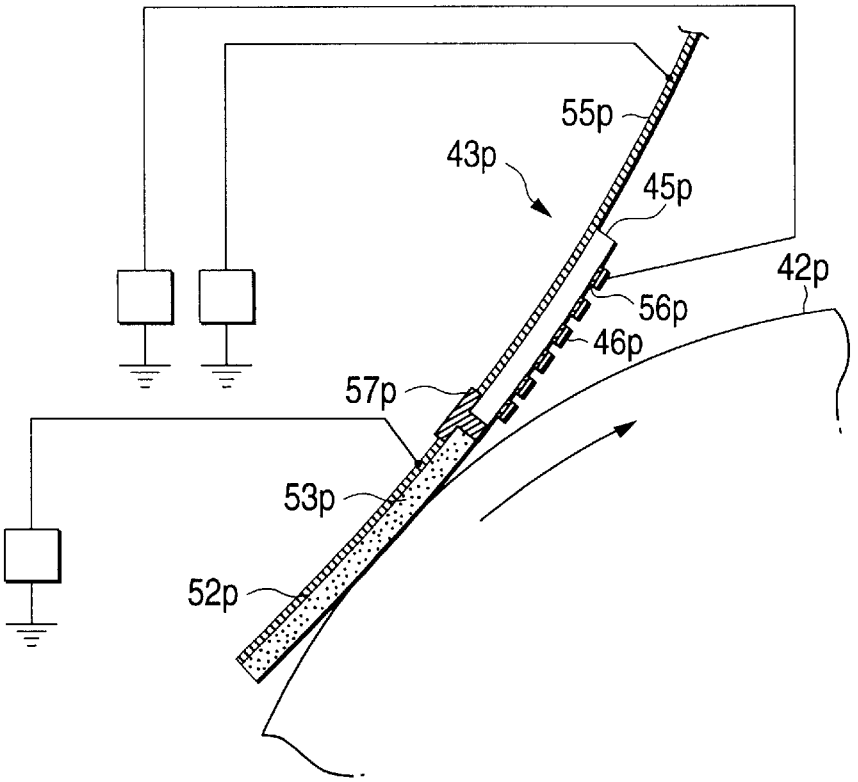
FIGS. 27A and 27B are segmentary views showing the structure of the layer forming member of a photographic developing apparatus according to a third (p) embodiment of the present invention.
Figure 27B:
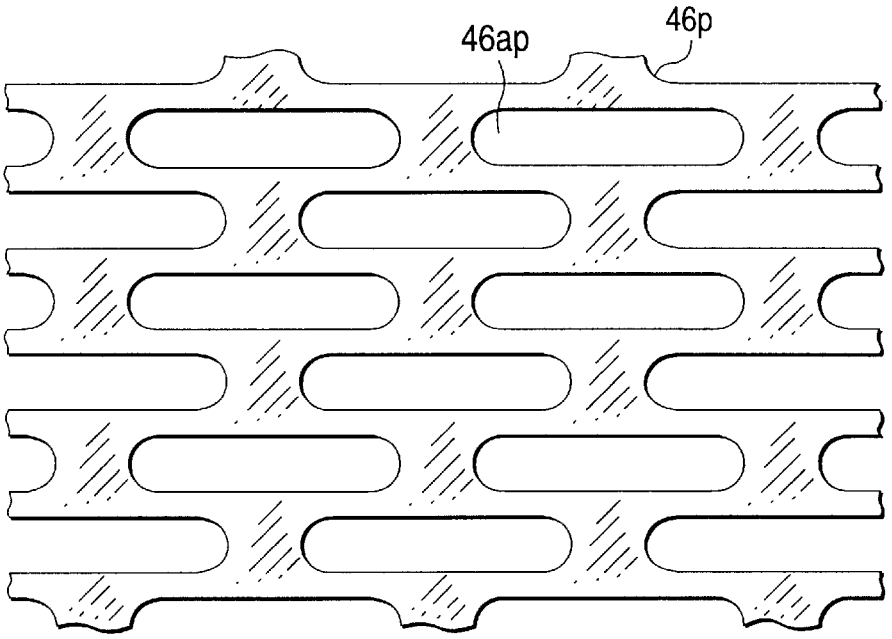
Figure 28:
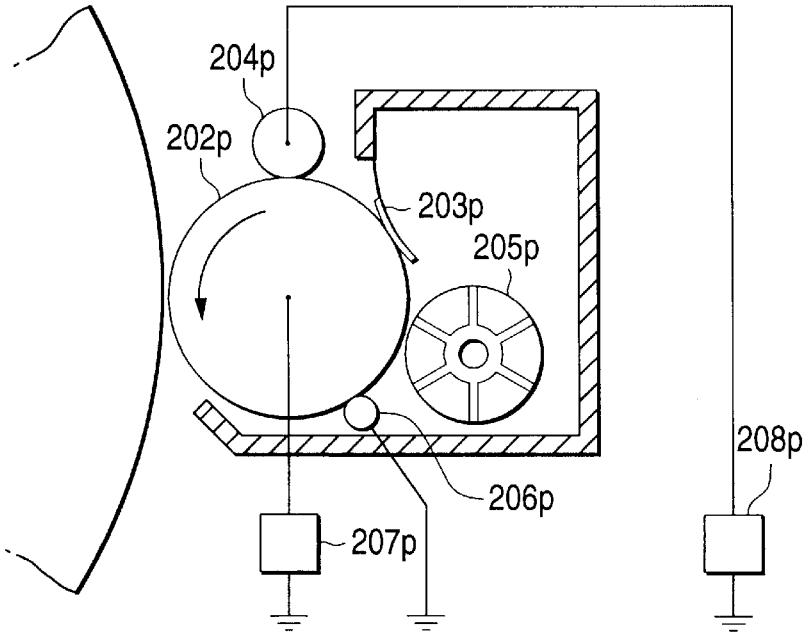
FIG. 28 PRIOR ART
FIG. 28 is a schematic representation showing one example of the conventional photographic developing apparatus.
Figure 29:
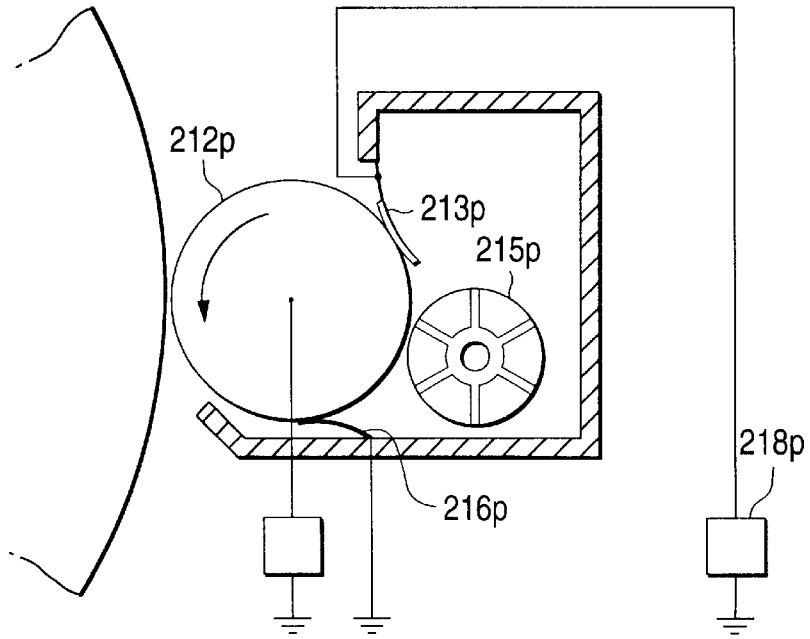
FIG. 29 PRIOR ART
FIG. 29 is a schematic representation showing another example of the conventional photographic developing apparatus.
Figure 30:
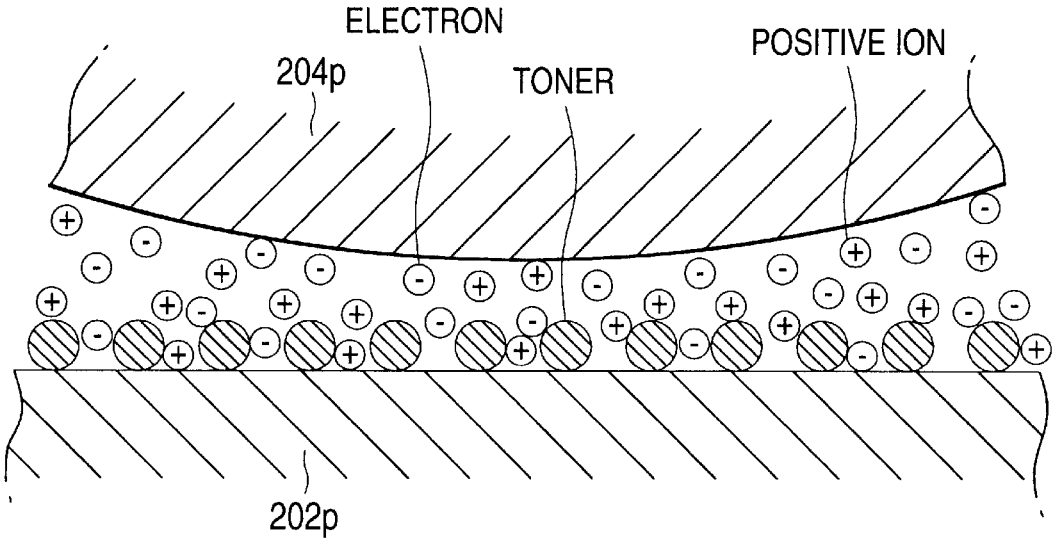
FIG. 30 PRIOR ART
FIG. 30 is a schematic representation illustrating the mechanism of electrification of occurrence of the toner of the opposite polarity in the photographic developing apparatus.
Figure 31:
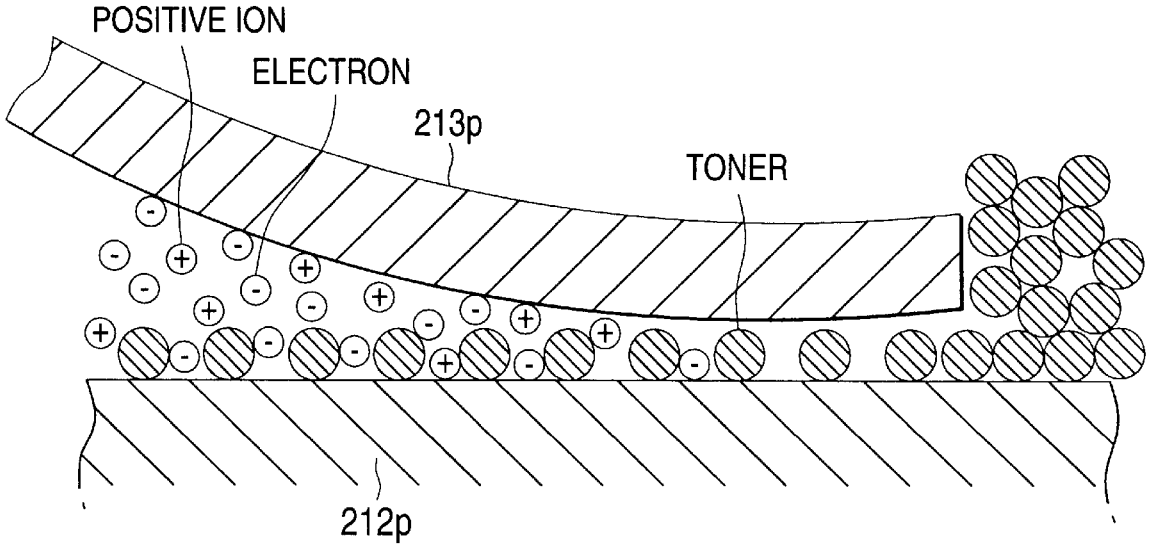
FIG. 31 PRIOR ART
FIG. 31 is a schematic representation illustrating the mechanism of generation of the toner of the opposite polarity in the photographic developing apparatus.

FIGS. 27A and 27B are segmentary views illustrating the layer forming member of a photographic developing apparatus according to another embodiment of the present invention.

In this photographic developing apparatus, an electric charge imparting member 45*p* consisting of semi-conductive material and a resilient member 53*p* are formed side by side on the front end of a layer forming member 43*p* via an insulating member 57*p* between them. A feeding member of the electric charge imparting member 45*p* doubles as a retaining member 55*p* of the layer forming member 43*p*. A feeding member 52*p* is provided on the reverse side of a resilient member 53*p* via the retaining member 55*p* and the insulating member 57*p*, and a charge reducing voltage is applied to the feeding member 52*p*. An insulating layer 56*p* is formed on the surface of the electric charge imparting member 45*p*, and a conductive electrification control member 46*p* is stacked on the surface of the electric charge imparting member 45*p* via the insulating layer 56*p*. The electrification control member 46*p* is provided so as to be spaced away from and opposite to a developing powder carrier 42*p*. As shown in FIG. 27B, the electrification control member 46*p* is formed into an electrode having a plurality of elongated pores 46*ap* longitudinally formed therein.

In other respects, the photographic developing apparatus of this embodiment is the same as that shown in FIG. 19.

In this photographic developing apparatus, a toner layer is formed on the developing powder carrier 42*p* by the layer forming member 43*p*, and the amount of electric charges of toner particles is reduced by application of the charge reducing voltage to the layer forming member 43*p*. The thus-formed toner layer passes through a position where it becomes opposite to the electrification control member 46*p*. Of negative and positive ions resulting from electric discharge developing between the electric charge imparting member 45*p* and the electrification control member 46*p*, only electrons or negative ions are imparted to the toner by means of the electric field developing between the developing powder carrier 42*p* and the electrification control member 46*p*. As a result, the toner can be electrified after the difference in the amount of electric charges of the toner between developing cycles has been reliably reduced. Therefore, the toner can be substantially uniformly electrified without causing the difference in the amount of electric charges between the developing cycles, enabling production of a ghost-free superior image.

[EXAMPLE]

To ascertain the toner-electrifying capability of the photographic developing apparatus of the present invention, a print test was carried out for a long period of time under the following conditions. A photographic developing apparatus identical to the photographic developing apparatus shown in FIG. 19 was used in this test.

- Image carrier: Negatively-charged organic photosensitive material
- Processing speed: 200 mm/sec.
- Electrification control member: A cylindrical film which consists of conductive material having a thickness of 100 $\mu$m, and minute pores having a diameter of 80 $\mu$m are formed in the film at a hole-area rate of 80%.
- Charge imparting member: Roll member having a diameter of 10 mm.
  - Material of a layer covering the circumferential surface of the charge imparting member: Silicon rubber having ion-conductive particles mixed therein
  - Rubber hardness: 60 degrees
  - Volume resistivity: $10^8$ Ω·cm
- Developing powder carrier: Having a diameter of 20 mm Roll having a surface rubber layer ($10^6$ Ω·cm)
- Stirring-and-supply member: Having a diameter of 10 mm Roll consisting of a semi-conductive sponge material
- Layer forming member: A leaf spring which is made of SUS 303 and has a thickness of 0.12 mm, and silicon rubber which contains ion-conductive material and has a thickness of 1 mm is bonded to the leaf spring with an conductive adhesive.
- Bonding pressure is about 15 to 120 gf/cm.
- Volume resistivity of $10^4$ to $10^{10}$ Ω·cm, and
- Rubber hardness of 60 degrees, and the surface of the rubber is cured.
- Electric potential of a latent image: −100 V
- Electric potential of a background: −350 V As a result of the print test having been made under the foregoing conditions, the uniform quantity of electric charge of toner was achieved. Further, it was possible to reduce the degree of ghosts, background fog, and splashing of toner to the inside of the photographic developing apparatus due to the toner of the opposite polarity to a very small extent.

Embodiments of the present invention will be described with reference to the accompanying drawings.

(First Embodiment)

Figure 32A:
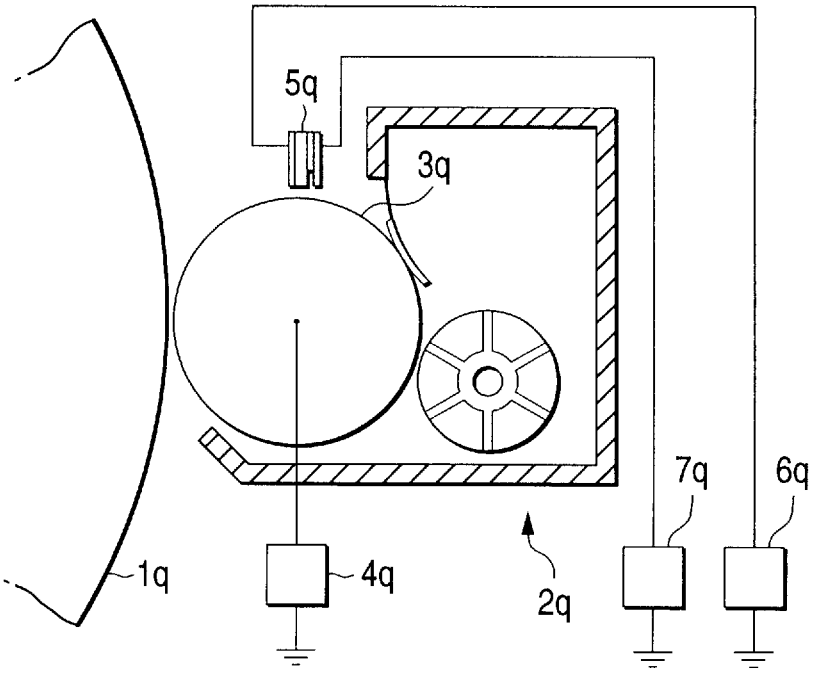
FIG. 32A is a schematic representation showing a photographic developing apparatus which uses an electrifying apparatus according to a first embodiment of and FIG. 32B is a schematic representation showing the electrifying apparatus.
Figure 32B:
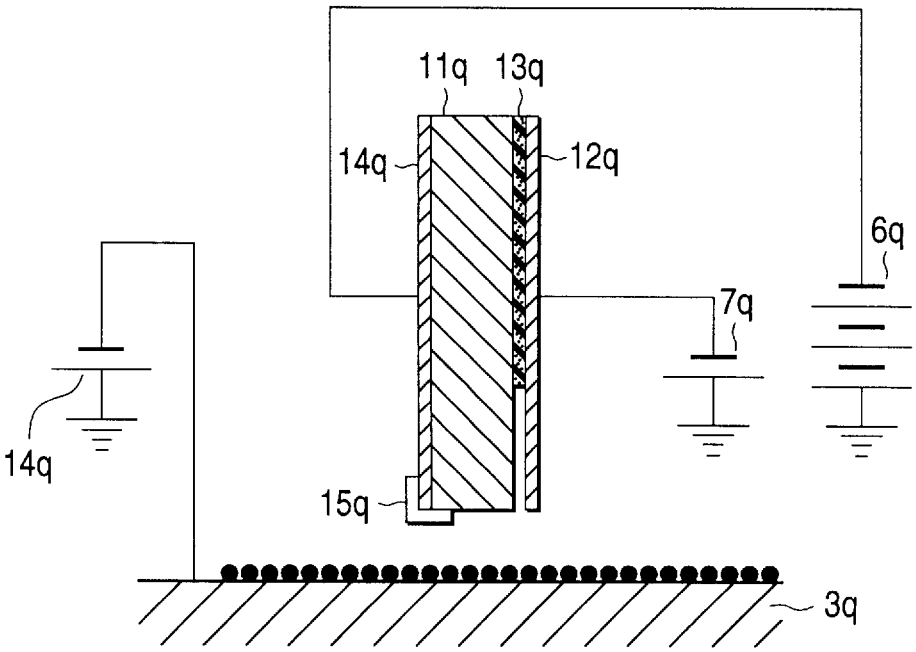

FIG. 32A is a schematic representation showing a photographic developing apparatus which uses an electrifying apparatus according to a first embodiment; and FIG. 32B is a schematic representation showing the electrifying apparatus.

A photographic developing apparatus 2*q* which uses the electrifying apparatus visualizes a latent image formed on an image carrier 1*q* by selectively transferring toner to the image carrier 1*q* in an electrophotographic apparatus or an electrostatic image recorder. The photographic developing apparatus 2*q* is provided with a developing roller 3*q*. This developing roller 3*q* rotates while holding a thin layer of toner fixed on its circumferential surface and transfers the toner to the image carrier 1*q* in a developing area where the toner layer becomes opposite to the image carrier 1*q*. A bias voltage is applied to the developing roller 3*q* from a power source 4*q*, and an electric field is formed between the image carrier 1*q* and the developing roller 3*q*, thereby transferring the electrified toner to the image carrier. Accordingly, the toner is required to have a suitable electric charge. An electrifying apparatus 5*q* of the first embodiment is used as a device for electrifying the toner so that each toner particle can retain a suitable electric charge.

As shown in FIG. 32A, the electrifying apparatus 5*q* is provided so as to be opposite to the developing roller 3*q*. As shown in FIG. 32B, the electrifying apparatus 5*q* is principally comprised of a first electrode 11*q* consisting of a resistor, a second electrode 12*q* consisting of a conductive material, a spacer 13*q* which consists of an insulating material and is adhesively sandwiched between the first and second electrodes 11*q* and 12*q*, and a feeding member 14*q* which is bonded to the reverse side of the first electrode.

The first electrode 11*q* is formed from a semi-conductive plate member which is made by dispersing and mixing conductive powder into silicon rubber. The volume resistivity of the first electrode 11*q* is about $10^8$ Ω·cm, and the first electrode 11*q* has a thickness of 1.5 mm. An SUS plate having a thickness of 0.2 mm is bonded to the reverse side of the first electrode 11*q* as the feeding member 14*q*. Reference numeral 15*q* in the drawing designates an insulating member attached to the electrifying apparatus 5*q* in order to prevent spark discharge from occurring between the feeding member 14*q* and the developing roller 3*q*. The second electrode 12*q* is formed from an SUS plate having a thickness of 0.2 mm and is bonded to the first electrode with the spacer 13*q* having a thickness of 70 μm between them. The end faces of both the first and second electrodes 11*q* and 12*q* are positioned so as to be spaced a distance of 500 μm away from and opposite to the circumferential surface of the developing roller 3*q*. The spacer 13*q* sandwiched between the first and second electrodes 11*q* and 12*q* is set back from the end faces of the first and second electrodes 11*q* and 12*q* by 2 mm. The electrifying apparatus 5*q* is opposite to the developing roller 3*q* and has a uniform cross section in the axial direction of the developing roller 3*q*, or over the entire area of the circumferential surface of the developing roller 3*q* in its widthwise direction.

A d.c. component of the bias voltage applied to the developing roller 3*q* consists of −400 V, and voltages are applied to the first and second electrodes 11*q* and 12*q* from the d.c. power sources 6*q* and 7*q*. The electric potential of the first electrode 11*q* is set to −2400 V, and the electric potential of the second electrode 12*q* is set to −400 V.

Figure 33:
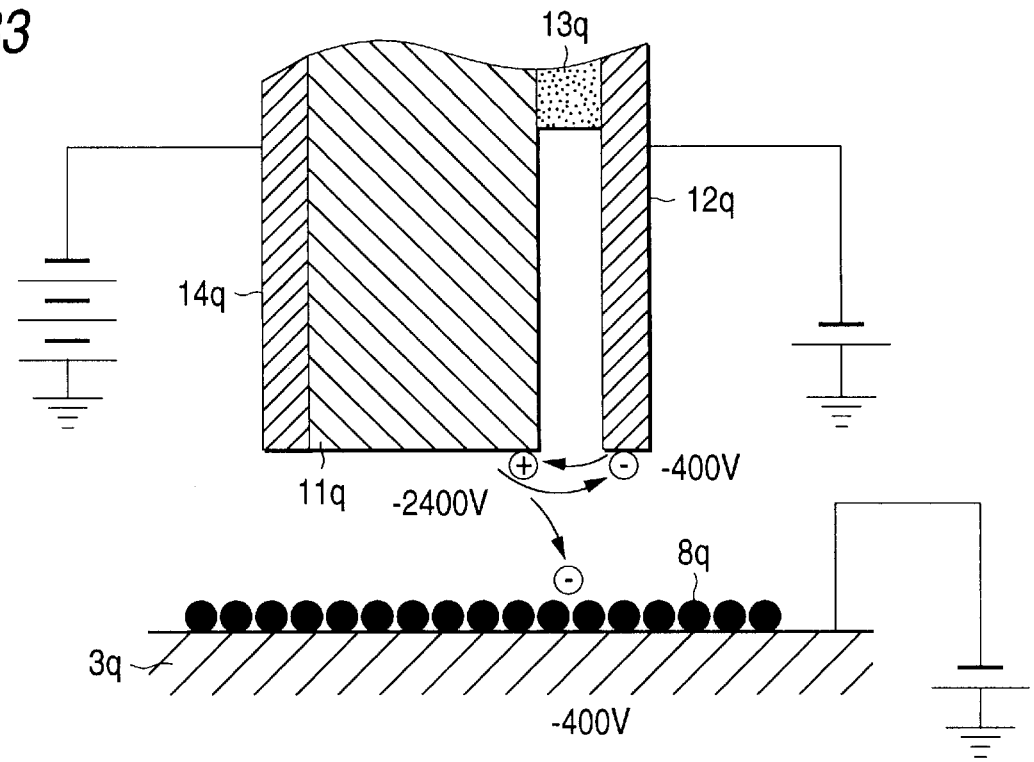
FIG. 33 is a schematic representation for explaining the function of the electrifying apparatus shown in FIG. 32.

As shown in FIG. 33, electric discharge continually occurs between the first and second electrodes 11*q* and 12*q* in the electrifying apparatus 5*q*, and electron avalanche rises between the first and second electrodes 11*q* and 12*q*. Ions and electrons are produced by ionization. The ions and electrons migrate between the first and second electrodes 11*q* and 12*q* along the electric field. Positive ions migrate from the second electrode 12*q* to the first electrode 11*q*, whereas negative ions and electrons migrate toward the second electrode 12*q*. At this time, part of the negative ions and electrons flow to the developing roller 3*q* along the electric field produced between the first electrode 11*q* and the developing roller 3*q*, thereby electrifying toner particles 8*q* retained in the form of a thin layer on the developing roller 3*q*. As described above, the electric charges migrating from the electrifying apparatus 5*q* to the developing roller 3*q* are limited to ions or electrons, and hence substantially the majority of the toner particles 8*q* remaining on the developing roller 3*q* are negatively electrified. As a result, there are very few toner particles electrified with the opposite polarity on the developing roller 3*q*.

The toner thus appropriately electrified toner is transferred to the image carrier 1*q* in the developing area. At this time, the toner has a sufficient amount of electric charges, and hence a suitable quantity of toner is transferred to the latent image formed on the image carrier 1*q*, thereby producing a superior image. Further, even if the toner of the opposite polarity is transferred to the background of the image, no fog occurs.

Next, the tests performed to acknowledge the operation of the electrifying apparatus will be described.

(First (q) Test)

Figure 34:
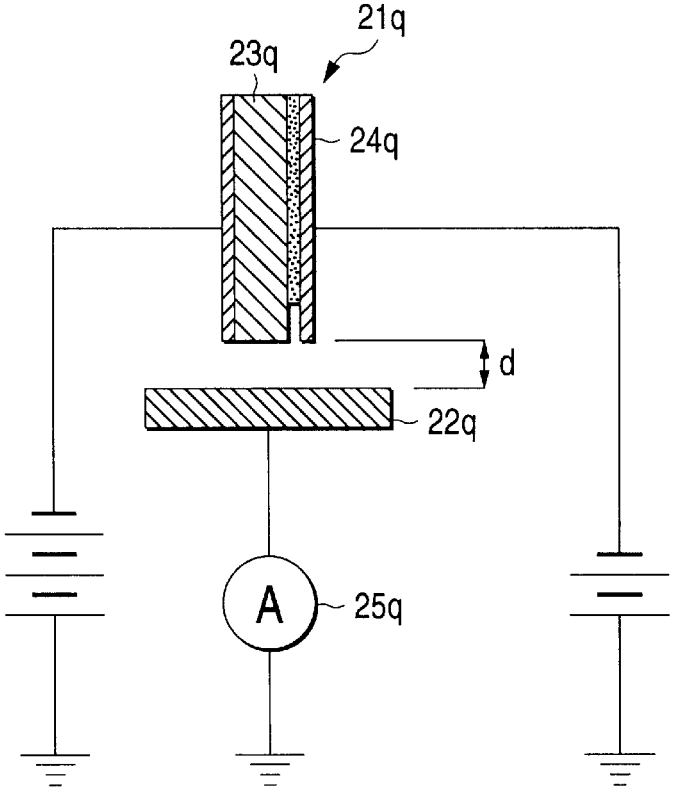
FIG. 34 is a schematic representation illustrating equipment used in a test for checking the function of the electrifying apparatus shown in FIG. 32.

In this test, as shown in FIG. 34, an electrifying apparatus 21*q* which is the same in construction as the electrifying apparatus of the first (q) embodiment is positioned so as to be opposite to an aluminum plate 22*q*, and first and second electrodes 23*q* and 24*q* are imparted with potentials. The aluminum plate 22*q* is grounded, and an ammeter 25*q* is provided for measuring the quantity of electrical currents flowing to earth. The components of the electrifying apparatus 21*q* used in this test are the same in material and thickness as those of the electrifying apparatus shown in FIG. 32. The depth of the electrifying apparatus 21*q* measures 17 mm (in the direction orthogonal to the drawing paper of FIG. 34).

Figure 35:
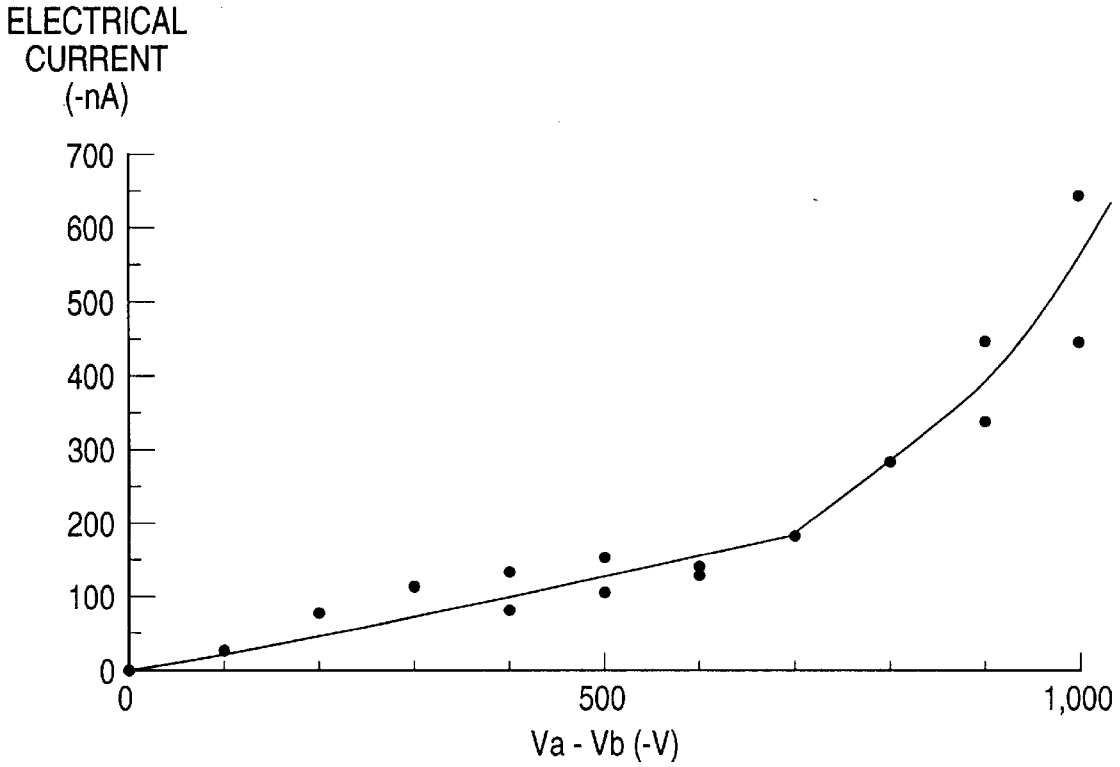
FIG. 35 is a plot showing the result of the test carried out through use of the equipment shown in FIG. 34, particularly the relationship between the potential difference between the first and second electrodes and the amount of electrical currents flowing between them.

To being with, as a preliminary test, a potential difference was produced between the first and second electrodes 23*q* and 24*q*, and the quantity of electrical current flowing between the electrodes was measured. The result of this preliminary test is provided in FIG. 35.

As shown in the drawing, the quantity of electrical current sharply increased after the potential difference (Va−Vb) between the potential Va of the first electrode 23*q* and the potential Vb of the second electrode 24*q* has passed a voltage of −700 V. In the range in which the quantity of electrical current increases, a glow was observed between the first and second electrodes 23*q* and 24*q* in the dark. Electric discharge was ascertained. A slight amount of electrical currents were observed even when the potential difference (Va−Vb) of the first and second electrodes 23*q* and 24*q* was smaller than −700 V. However, it is thought that this is caused by a very weak current flowing between the first and second electrodes 23*q* and 24*q* via the spacer or the like.

Figure 36:
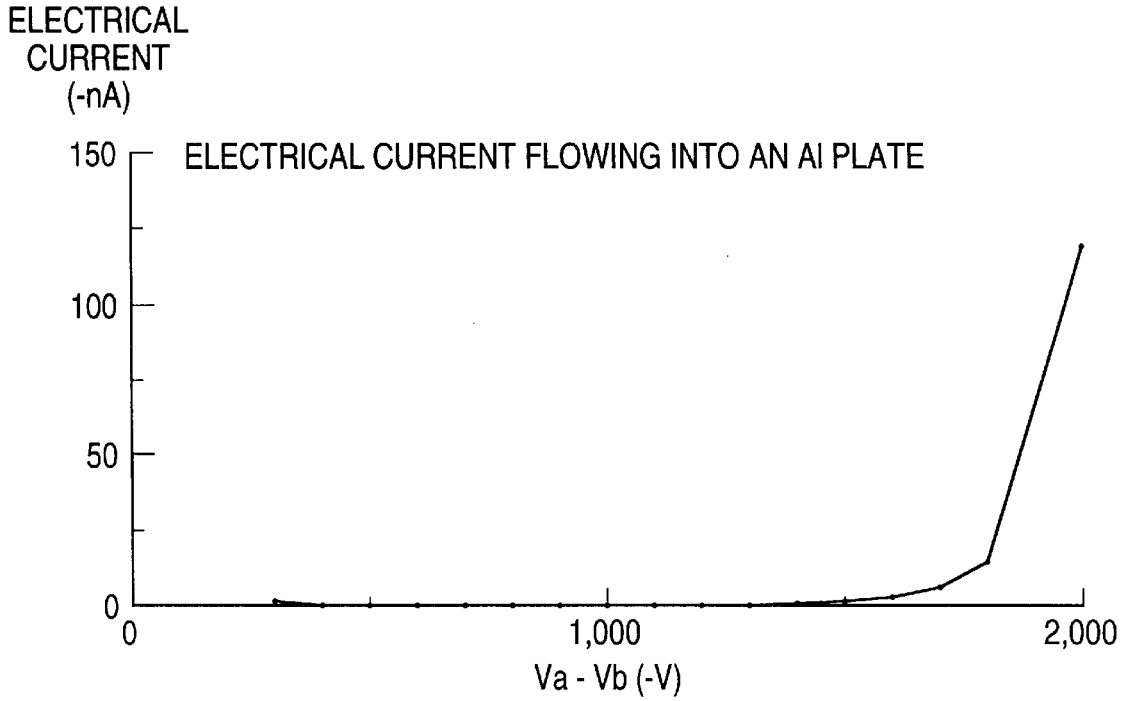
FIG. 36 is a plot showing the result of the test carried out through use of the equipment shown in FIG. 34, particularly the relationship between the potential difference between the first and second electrodes and the amount of electrifying currents flowing to an article to be electrified.

Provided that the potential Va of the first electrode 23*q* was set to −2000 V, and that the potential of the second electrode 24*q* is changed, the quantity of electrical current flowing to the aluminum plate 22*q* placed a distance of 500 μm away from the electrifying apparatus 21*q* was measured by the ammeter 25*q*. FIG. 36 provides the result of such measurement.

As shown in the drawing, if the potential of the second electrode 24*q* is gradually increased from −2000 V, there is no substantially electrical current flowing to the aluminum plate 22*q* by about −700 V (i.e., a potential difference between Va and Vb is about 1300 V). When the potential is increased to −300 to −200 V (i.e., the potential difference is 1700–1800 V), a large amount of electrical current flows to the aluminum plate 22*q*. Accordingly, it is understood that when there is strong electric discharge between the first and second electrodes 23*q* and 24*q*, an electrical current flows to the aluminum plate 22*q*.

The electrical current flowing to the aluminum plate 22*q* is not directly caused by the electric discharge produced between the first electrode 23*q* or second electrode 24*q* and the aluminum plate 22*q*. It is apparent from the fact that there is no substantial electrical current flowing to the aluminum plate 22*q* from the electrodes 23*q* and 24*q* when there is a much greater electric field between the two electrodes and the aluminum plate 22*q*.

If the first electrode 23*q* is replaced with the second electrode 24*q* in the test; namely, if the potential of the second electrode is set to −2000 V, and the potential of the first electrode 23*q* is changed, the same result will be obtained. Further, if both the first and second electrodes 23*q* and 24*q* are made of a resistor, the same result will be obtained.

(Second (q) Test)

In this test, the amount of electrical currents flowing to the aluminum plate 22*q* from the electrodes 23*q* and 24*q* is measured through use of the apparatus shown in FIG. 34 while a distance "d" between the first and second electrodes 23*q* and 24*q* and the aluminum plate 22*q* is changed.

Figure 37:
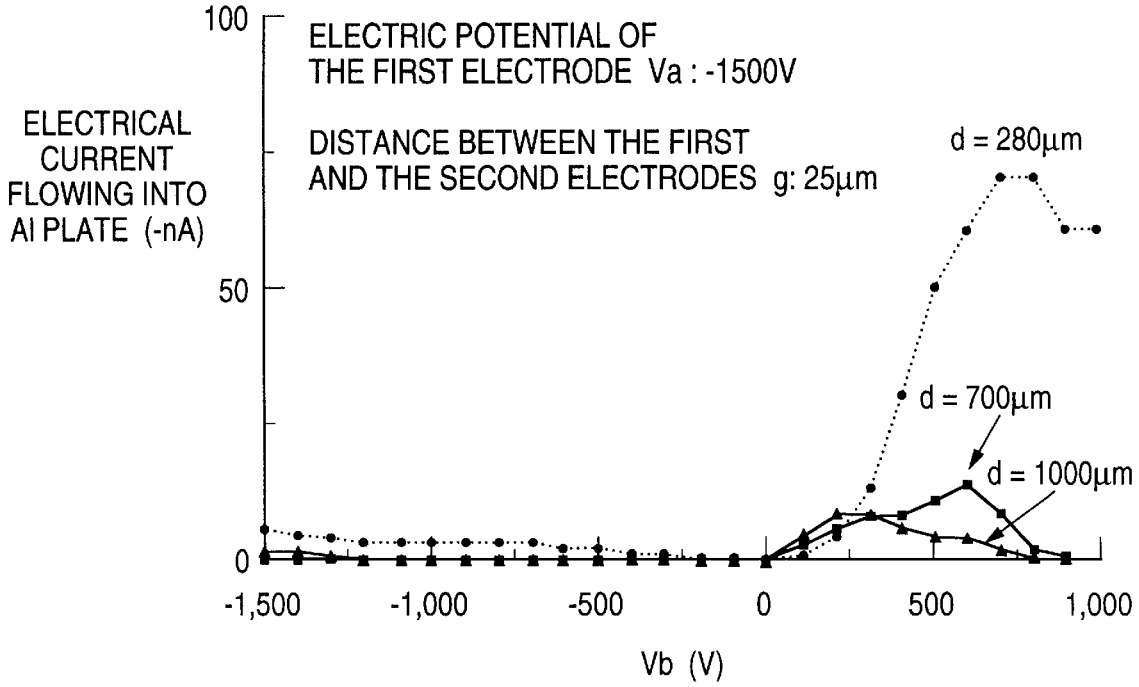
FIG. 37 is a plot showing the result of the test carried out through use of the equipment shown in FIG. 34, particularly the relationship between the distance between electrodes and an aluminum substrate and the amount of electrifying currents flowing to an article to be electrified.

The distance between the electrodes 23*q* and 24*q* and the aluminum plate 22*q* was set to three distances; namely, 280 μm, 700 μm, and 1000 μm. The amount of electrical currents was measured for each of these distances by gradually increasing the potential Vb of the second electrode 24*q* from −1500 V while the potential Va of the first electrode 23*q* is set to −1500 V. FIG. 37 shows the result of such measurement.

The distance between the first and second electrodes 23*q* and 24*q*; namely, the thickness of the spacer 22*q* is set to 25 μm.

As shown in the drawing, the migration of electric charges to the aluminum plate 22*q* is acknowledged for all of the cases where the distance between the electrodes 23*q* and 24*q* and the aluminum plate 22*q* is set to the foregoing three distances. However, it is understood that the amount of electrical currents is increased as the distance becomes smaller. Although the amount of electrical currents increases in accordance with increases in the potential Vb of the second electrode 24*q* and in the potential difference between the first and second electrodes 23*q* and 24*q*, it decreases if the potential Vb of the second electrode 24*q* increases further. The reason for this is thought that if the potential Vb of the second electrode 24*q* increases so as to become greater than the potential (0V) of the aluminum plate 22*q*, an electric field is formed between the second electrode 24*q* and the aluminum plate 22*q* in the opposite direction, which in turn makes it difficult to migrate electric charges to the aluminum plate 22*q*. Accordingly, either the potential Vb of the second electrode 24*q* or the potential of the aluminum plate 22*q* is greater than the other, the potentials should be set so as to prevent the creation of an electric field between them which would otherwise hinder migration of electric charges of desired polarity.

(Third (q) Test)

Figure 38:
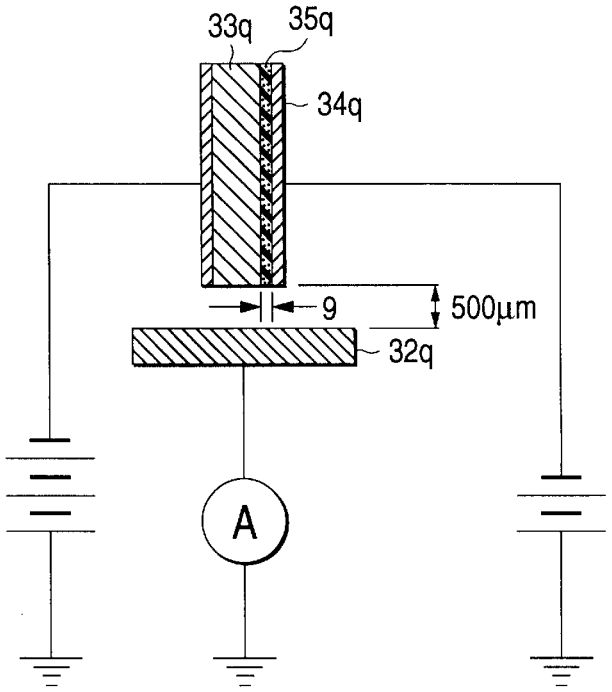
FIG. 38 is a schematic representation showing another equipment used in the test for checking the function of the electrifying apparatus shown in FIG. 32.

In this test, the amount of electrical currents flowing to an aluminum plate 32*q* from the first electrode 33*q* or second electrode 34*q* is measured through use of an apparatus shown in FIG. 38 while the distance between the electrodes is changed.

In the apparatus shown in FIG. 38, a spacer 35*q* is interposed as the electrifying apparatus between the first and second electrodes 33*q* and 34*q*, and the end face of the spacer 35*q* is brought into alignment with the end faces of the electrodes 33*q* and 34*q* which are opposite to the aluminum plate 32*q*. In other respects, the apparatus is identical with that shown in FIG. 34. A distance "g" between the first and second electrodes 33*q* and 34*q* is set to 25 μm, 70 μm, and 140 μm, and the thickness of the spacer 35*q* is changed.

Figure 39:
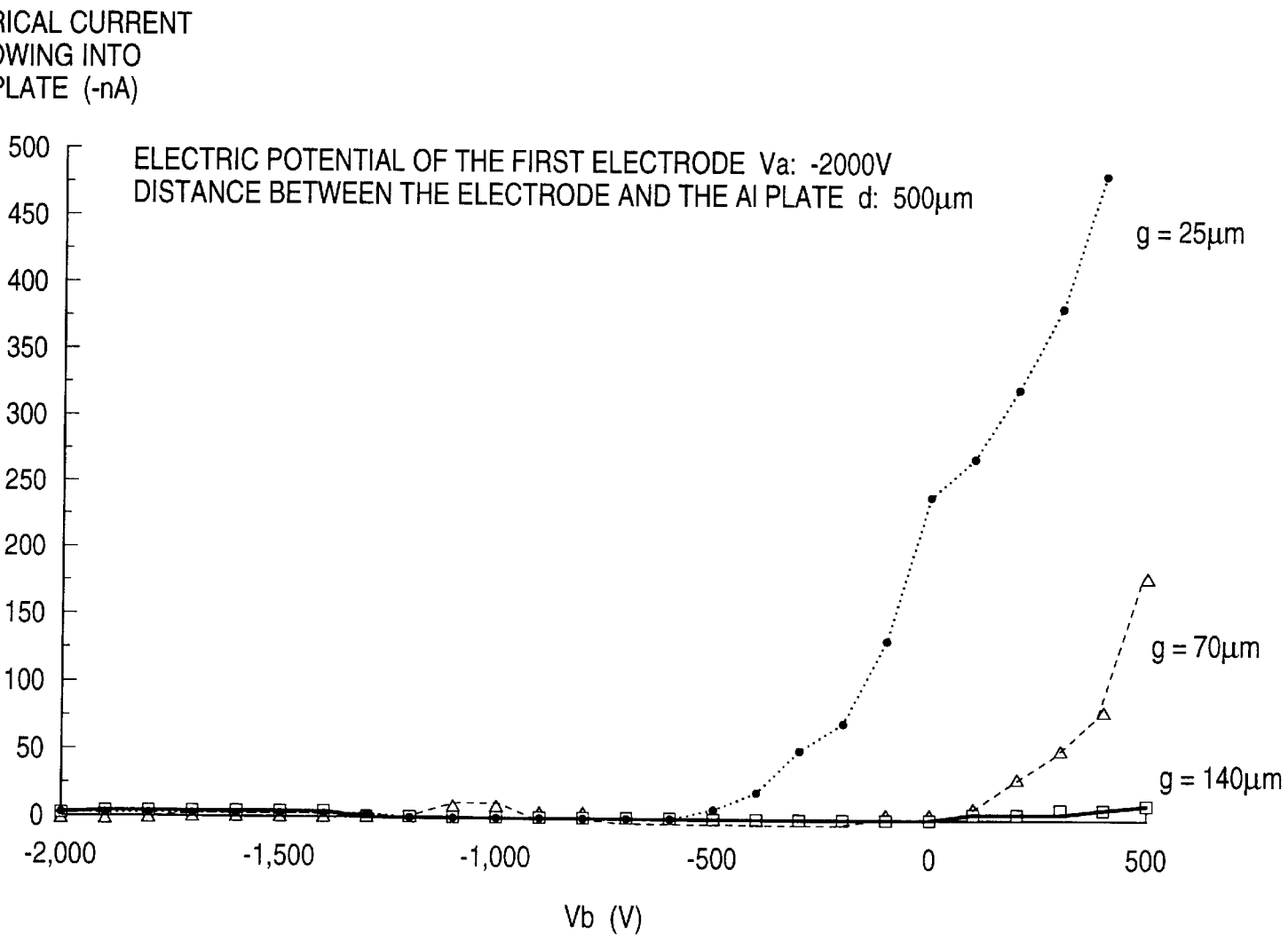
FIG. 39 is a plot showing the result of the test carried out through use of the equipment shown in FIG. 38, particularly the relationship between the distance between the first and second electrodes and the amount of electrifying currents flowing to an article to be electrified.

The result of the test is provided in FIG. 39. As can be seen from the drawing, although the first and second electrodes 33*q* and 34*q* are not directly opposite to each other, electric discharge is produced, so long as the end faces of the first electrode 33*q*, the second electrode 34*q*, and the spacer 35*q* are in alignment with each other. It is understood that electric charges migrate to the aluminum plate 32*q*. Further, the smaller the distance between the first and second electrodes 33*q* and 34*q*, the more frequently the electric charges migrate even if the potential difference between the electrodes 33*q* and 34*q* is small. The smaller the distance, the larger amount of electrical currents. Consequently, if the distance between the first and second electrodes 33*q* and 34*q* is set to a small value, there is required only a small potential difference applied between the electrodes 33*q* and 34*q*. In contrast, if the distance between the first and second electrodes 33*q* and 34*q* is increased, the potential difference must be increased. Eventually, the potentials of the electrodes must be set to large values. For this reason, spark discharge becomes apt to occur between the electrodes and a conductive substance in the vicinity of the electrodes.

(Fourth (q) Test)

Figure 40:
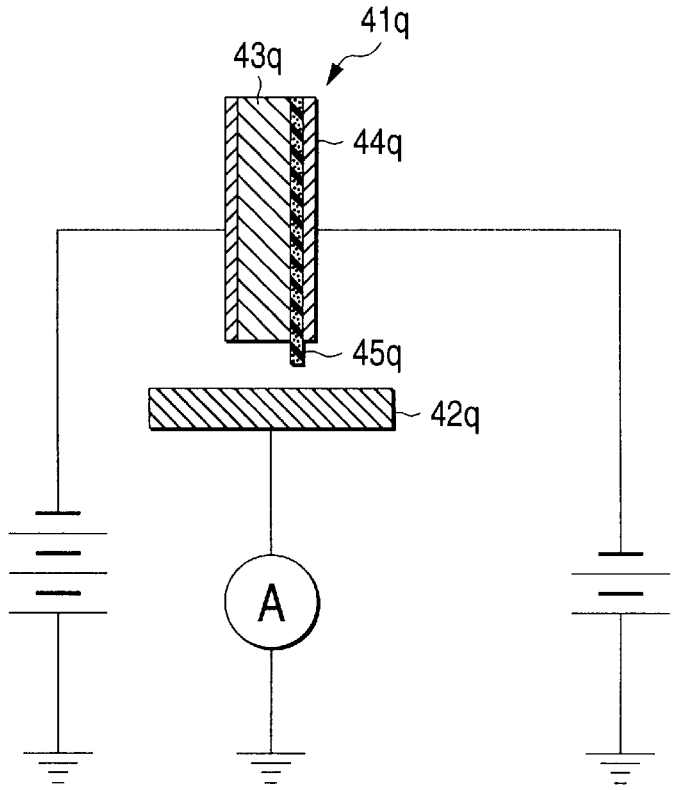
FIG. 40 is a schematic representation showing still another equipment used in the test for checking the function of the electrifying apparatus shown in FIG. 32.

In this test, the amount of electrical currents flowing to the aluminum plate 42*q* is measured through use of an apparatus shown in FIG. 40 while a potential difference is applied between the first and second electrodes 43*q* and 44*q*. In an electrifying apparatus 41*q* used in this test, a spacer 45*q* sandwiched between a first electrode 43*q* and a second electrode 44*q* protrudes from the end faces of the electrodes 43*q* and 44*q* toward an aluminum plate 42*q*.

As a result of the test which uses such an electrifying apparatus, an electrical current flowing to the aluminum plate 42*q* is not observed. The reason for this is thought that the path of the electric field between the first and second electrodes 43*q* and 44*q* is extended by projection of the spacer 45*q*, which in turn prevents generation of intensive electric discharge.

(Fifth (q) Test)

Figure 41:
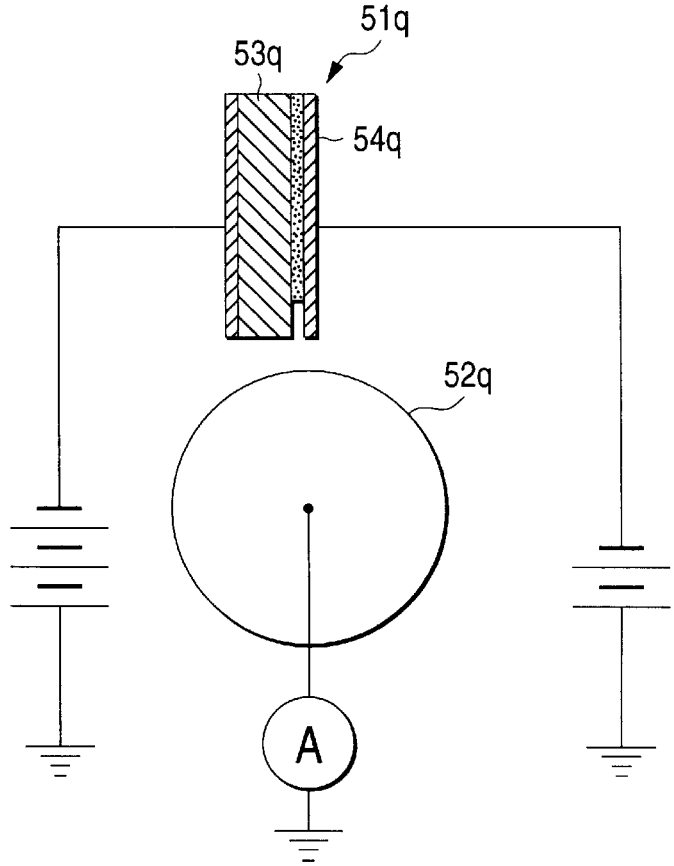
FIG. 41 is a schematic representation showing still another equipment used in the test for checking the function of the electrifying apparatus shown in FIG. 32.

In this test, a photosensitive drum 52*q* shown in FIG. 41 is positioned in place of the aluminum plate 22*q* of the apparatus shown in FIG. 34 so as to be opposite to an electrifying apparatus 51*q*. The circumferential surface of this photosensitive drum 52*q* is practically electrified, and the potential of this photosensitive drum is measured.

In the test, the following two types of voltage were applied to the first and second electrodes 53*q* and 54*q*.

(1) First electrode −1800 V

Second electrode 0 V.

(2) First electrode −1500 V (d.c.) +1000 Vp-p, 400 Hz (a.c.)

Second electrode 0 V

Figure 42:
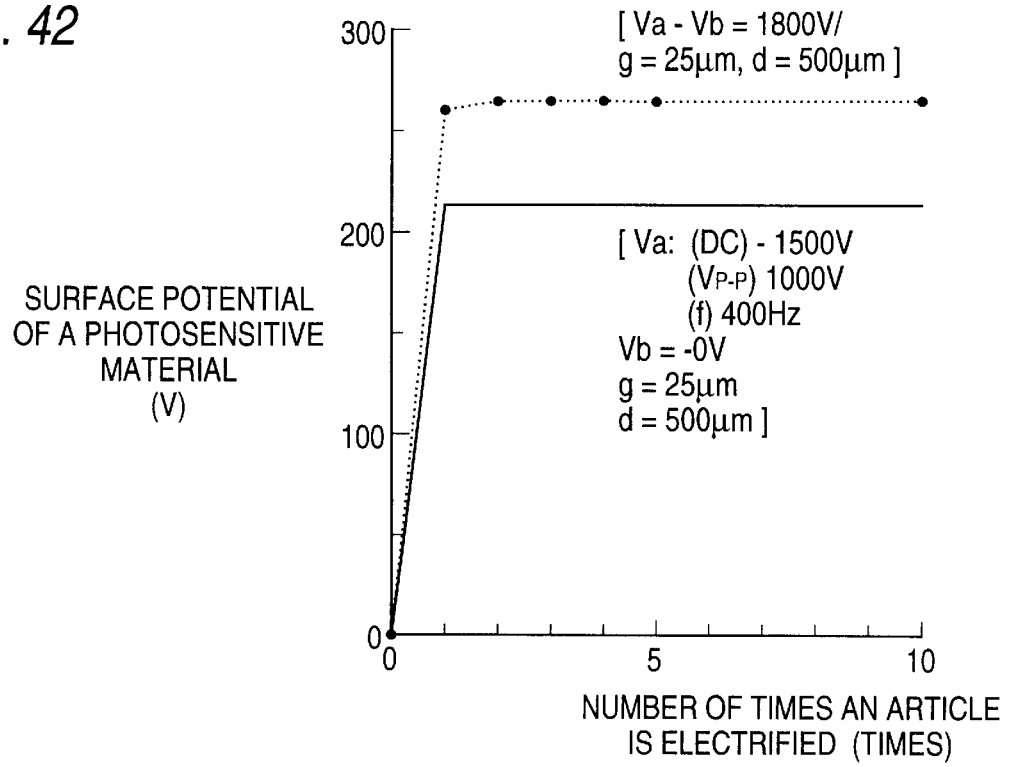
FIG. 42 is a plot showing the result of the test carried out through use of the equipment shown in FIG. 41, particularly the electric potential of an electrified photosensitive material.

As shown in FIG. 42, the result of the test shows that the circumferential surface of the photosensitive drum 52*q* is electrified substantially to saturation during the first electrifying operation. The same result is obtained even when the voltages having a.c. voltage superposed thereon are applied to the electrodes.

(Sixth (q) Test)

In this test, a developing roller is positioned in place of the photosensitive drum 52*q* so as to be opposite to the electrifying apparatus 52*q*. A thin layer of toner formed on this developing roller is electrified. Even in this test, two types of voltage were applied to the first electrode; namely, d.c. voltage and d.c. voltage having a.c. voltage superposed thereon. The voltages are as follows:

(1) First electrode −2000 V

Second electrode 0 V (2) First electrode −2000 V (d.c.) +2000 Vp-p, 400 Hz (a.c.)

Second electrode 0 V

Figure 43:
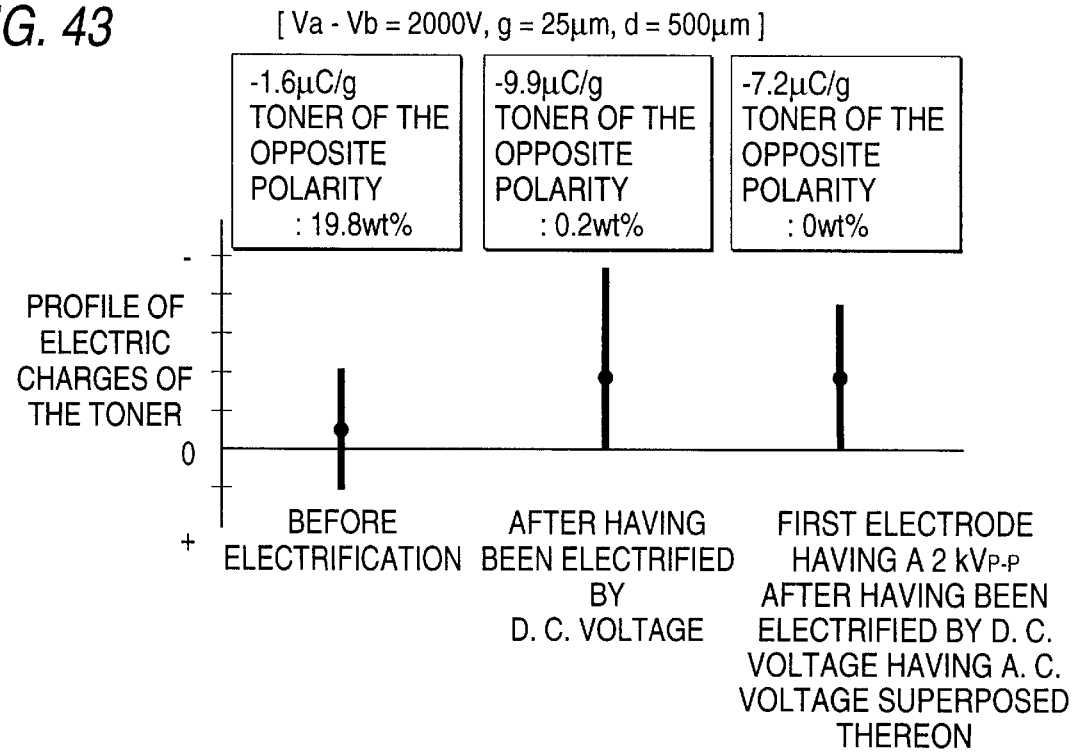
FIG. 43 is a plot showing the result of the test carried out through use of the equipment shown in FIG. 41, particularly the profile of electric charges of electrified toner.

FIG. 43 shows the result of the measurement of the electric charge of the toner electrified in this test. It is understood that the toner of the opposite polarity is eliminated as a result of use of the electrifying apparatus of the present invention, and that the most of toner particles are electrified with desired polarity. Further, it is understood that the width of an electrification profile of toner particles is reduced by applying to the electrodes the voltage having a.c. voltage superposed thereon, and that toner particles can be electrified appropriately.

Although a.c. voltage is superposed on the voltage applied to the first electrode 53*q* in the foregoing test, the same result will be obtained even when a.c. voltage is applied to the substrate of an article to be electrified, or the developing roller, so long as each of the mean voltages is set under suitable conditions.

(Second Embodiment)

Figure 44:
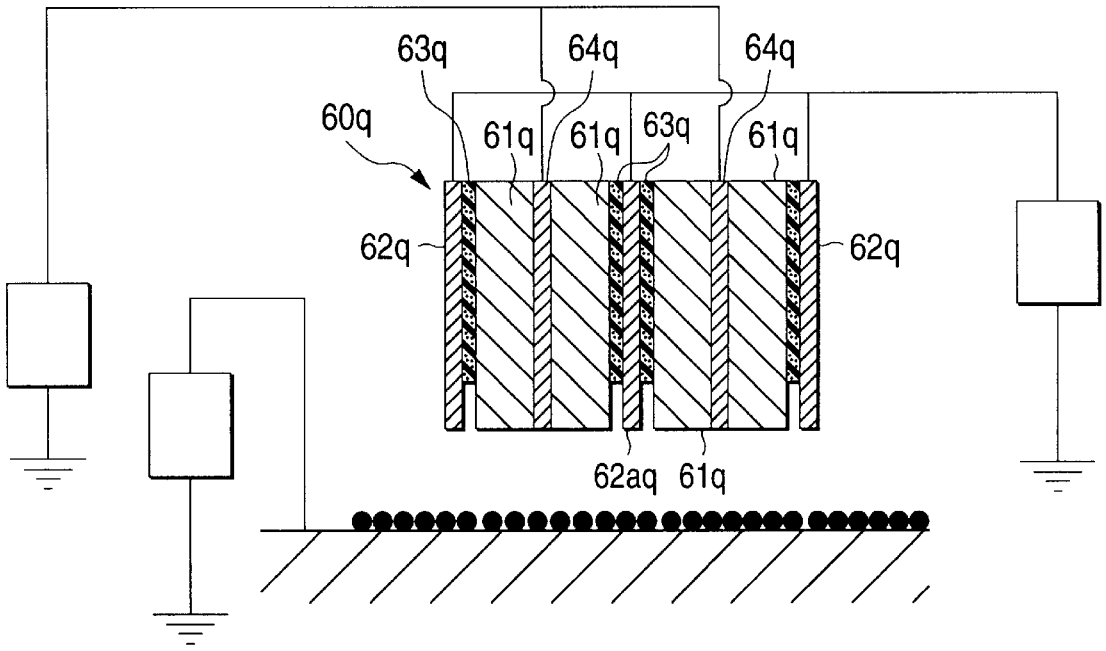
FIG. 44 is a schematic representation showing an electrifying apparatus according to a second embodiment.

FIG. 44 is a schematic representation illustrating an electrifying apparatus according to a second embodiment of the present invention.

An electrifying apparatus 60*q* is formed by stacking a plurality of electrifying apparatus shown in FIG. 32 and bonded them together. Feeding members 64*q* bonded to the reverse side of first electrodes 61*q* and second electrodes 62*q* consisting of a conductive plate are also used to feed power to discharging sections provided on both sides of each of these electrodes. Specifically, the first electrode 61*q* consisting of semi-conductive material is bonded to each side of the feeding member 64*q*, and the first electrode 61*q* is opposite to the second electrodes 62*q* via a spacer 63*q*. The first electrode 61*q* is opposite to each side of a second electrode 62*aq* positioned at the center of the electrifying apparatus 60*q* via the spacer 63*q*. Electric discharge is produced between this second electrode 62*aq* and the first electrodes 61*q* provided on both sides of it.

In this electrifying apparatus, a plurality of discharging areas are provided in a side-by-side configuration. Therefore, even if the area of the article cannot be sufficiently electrified in one discharging area, it may be appropriately electrified in another discharge area.

(Third Embodiment)

Figure 45A:
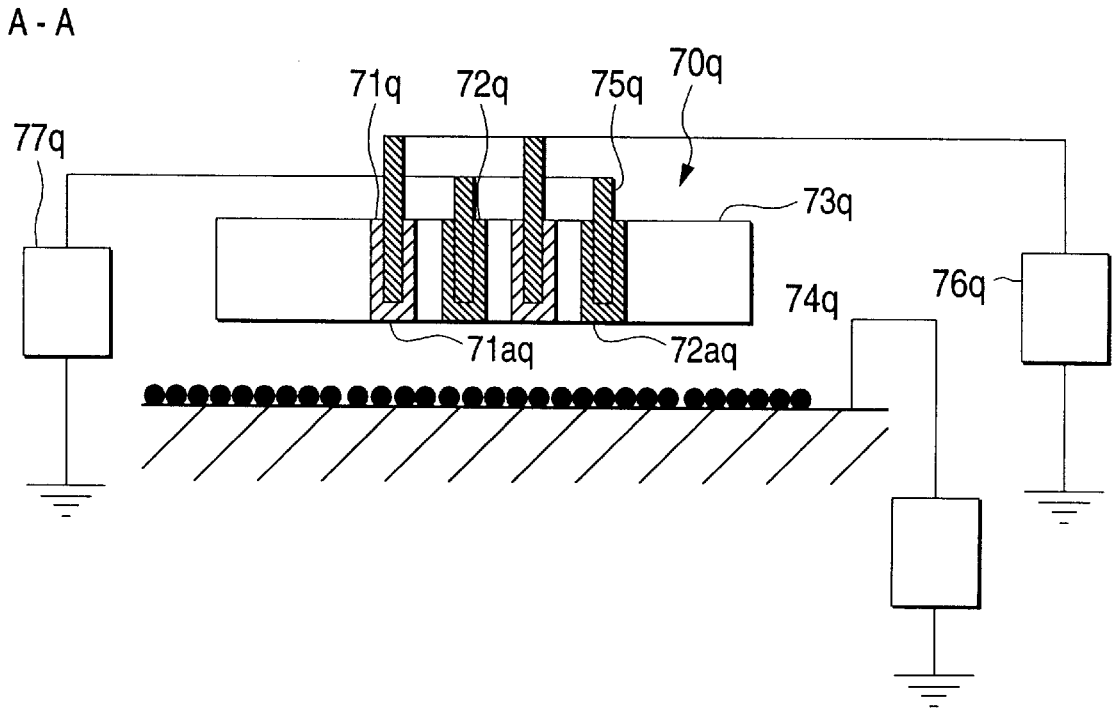
FIGS. 45A and 45B are schematic representations showing an electrifying apparatus according to a third embodiment of the present invention.
Figure 45B:
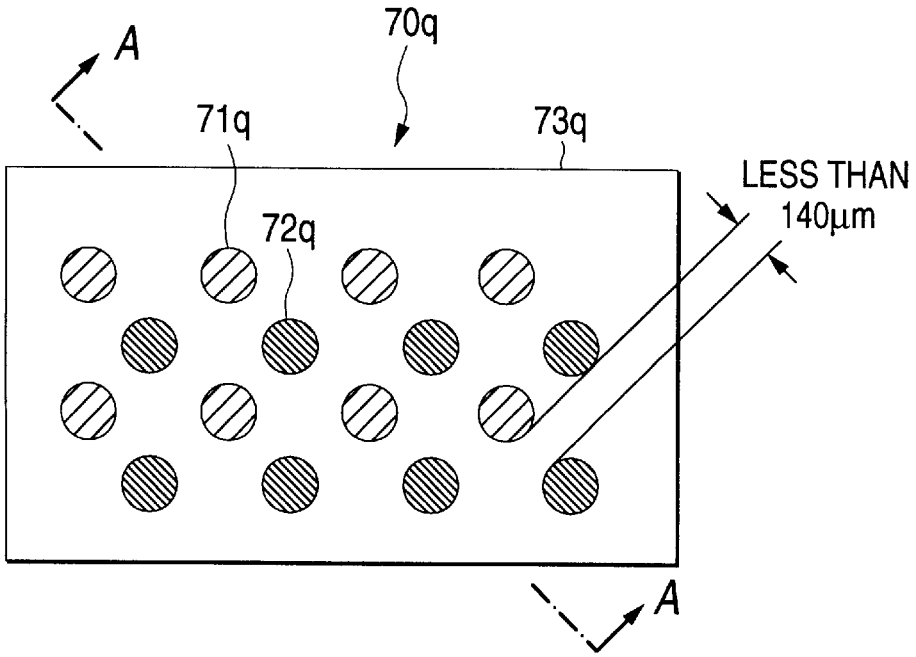

FIGS. 45A and 45B are schematic representations illustrating an electrifying apparatus according to a third embodiment of the present invention.

An electrifying apparatus 70*q* is provided with a plurality of columnar members 71*q* (first electrodes) consisting of conductive material, and a plurality of columnar members 72*q* (second electrodes) consisting of semi-conductive material. They are alternatively embedded in a substrate 73*q* such that they are spaced a uniform distance away from each other. End faces 71*aq*, 72*aq* of the columnar members are in alignment with the surface of the substrate 73*q* so as to be opposite to an article to be electrified 74*q*. A rod 75*q* consisting of conductive material is inserted into the center of each of the semi-conductive columnar members 72*q*, and this rod 75*q* serves as a feeding member for feeding power to the columnar member 72*q* which serves as a second electrode. A predetermined electric potential is imparted to the feeding members from a power source 77*q*, and a predetermined potential is also imparted to the conductive columnar members 71*q* which serve as a first electrode from a power source 76*q*. As a result, electric discharge is caused by the potential difference between the electric potentials applied to the columnar members 71*q*, 72*q*, and electric charges are imparted to an article placed opposite to the electrifying device 70*q*.

In this electrifying apparatus 70*q*, the range in which the columnar members (which will serve as electrodes) are arranged is arbitrarily set, and electric charges can be substantially uniformly imparted to the article within that range.

(Fourth Embodiment)

Figure 46:
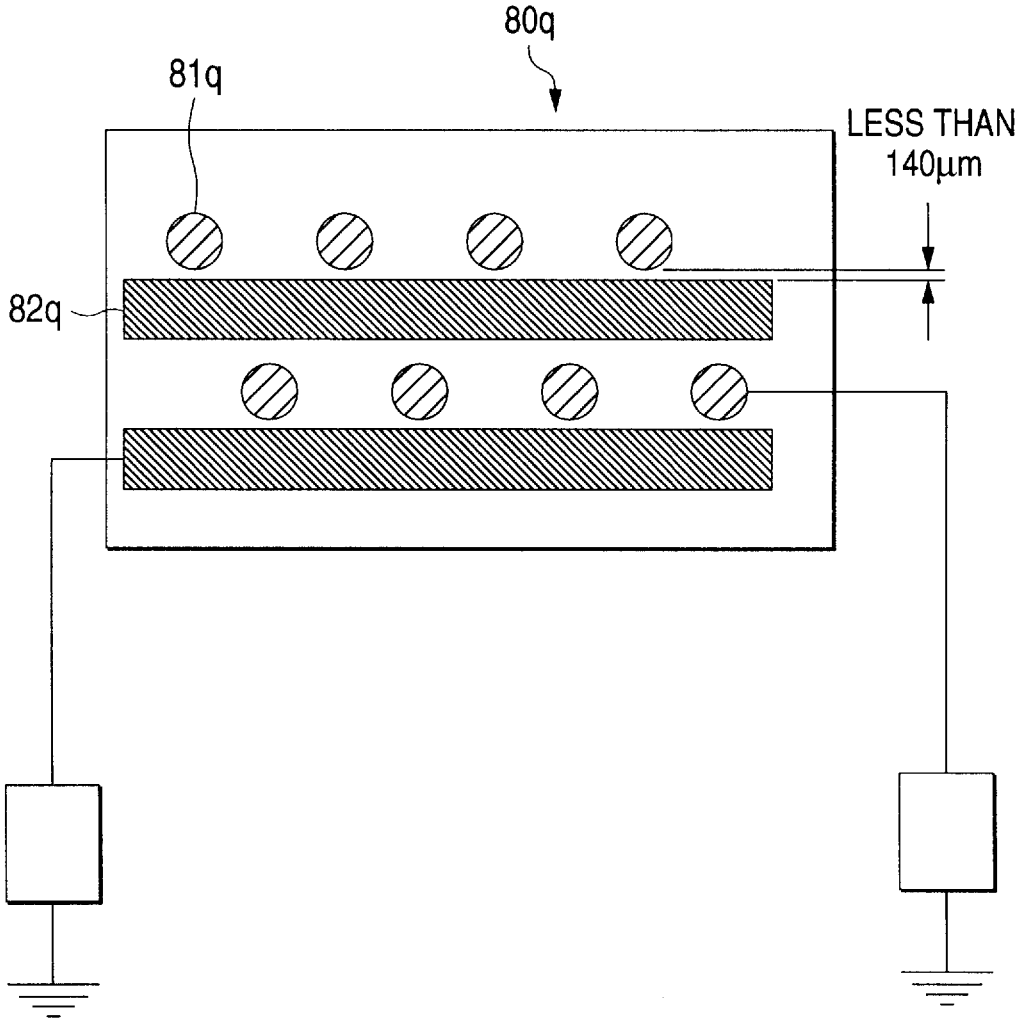
FIG. 46 is a schematic representation showing an electrifying apparatus according to a fourth embodiment of the present invention.

FIG. 46 is a schematic representation illustrating an electrifying apparatus according to a fourth embodiment of the present invention.

An electrifying apparatus 80*q* is comprised of two electrodes 82*q* which consist of semi-conductive material and are formed into the shape of a strip, and conductive columnar members 81*q* which serve as first electrodes and are laid above each of the electrodes 82*q*. The first electrodes, or the columnar members 81*q*, and the second strip-shaped electrodes 82*q* are spaced at a uniform distance away from each other.

Even in the case of this electrifying apparatus 80*q*, electric discharge is continually produced between the first columnar electrodes 81*q* and the second strip-shaped electrodes 82*q*. Resultantly ionized ions or electrons migrate toward an article provided opposite the electrifying apparatus 80*q*, so that the article can be electrified with desired polarity.

(Fifth Embodiment)

Figure 47A:
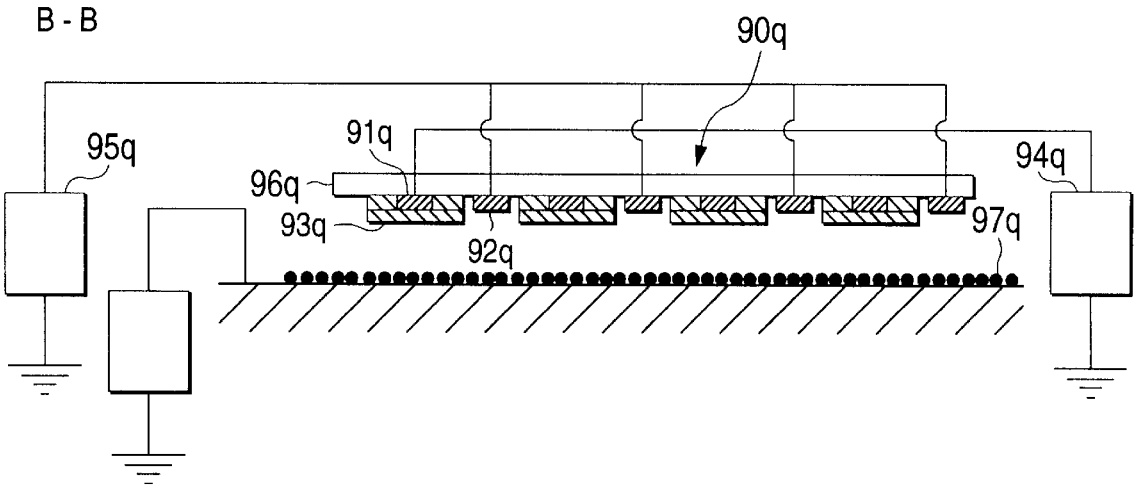
FIGS. 47A and 47B are schematic representations showing an electrifying apparatus according to a fourth embodiment of the present invention.
Figure 47B:
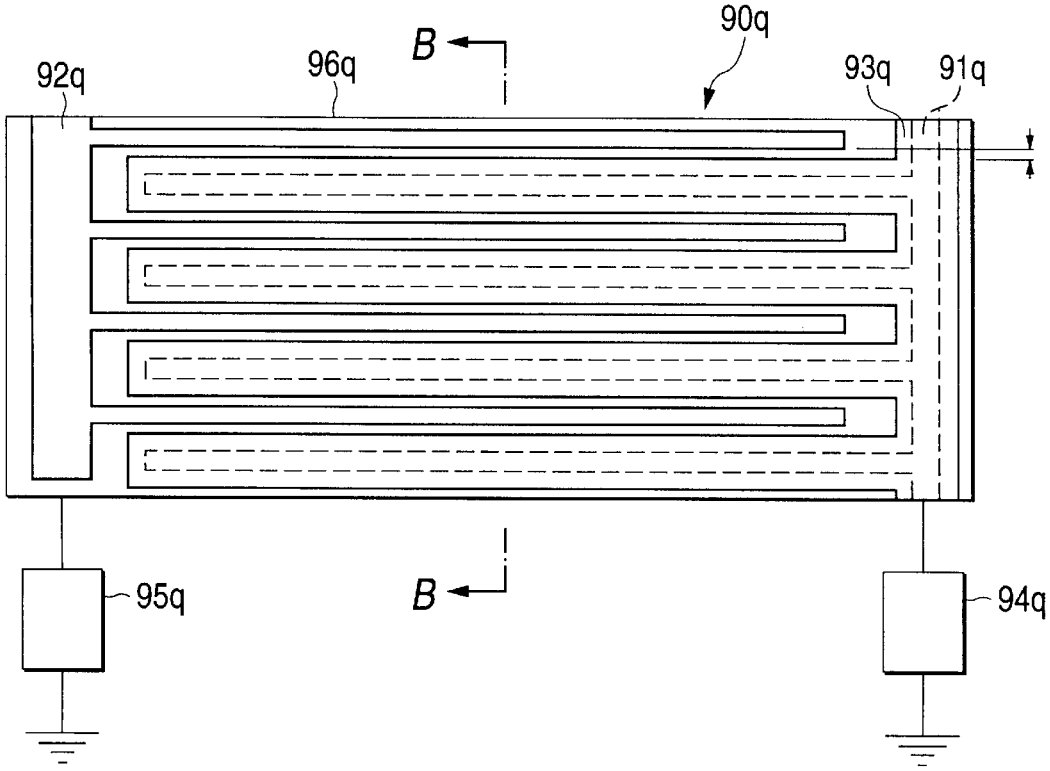
Figure 48:
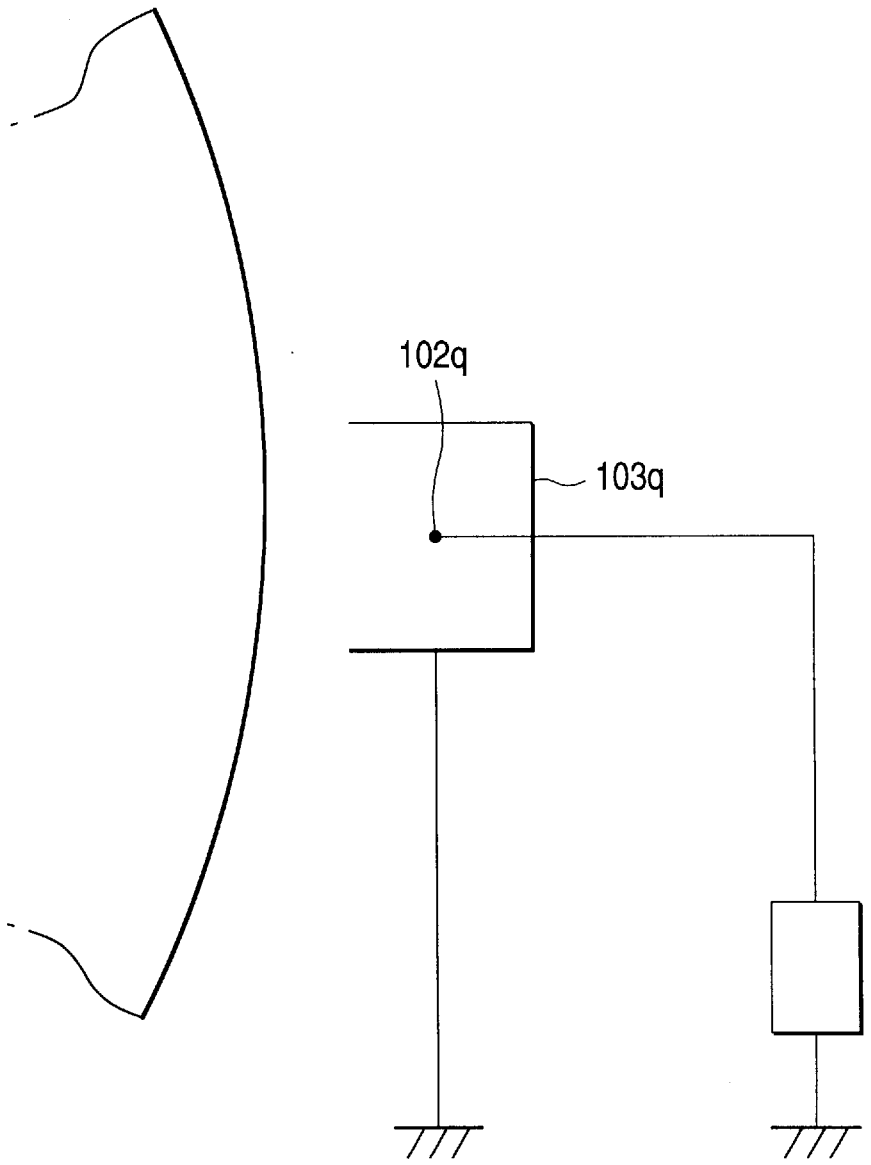
FIG. 48 PRIOR ART
FIG. 48 is a schematic representation illustrating a conventionally-known corona discharge device.
Figure 49A:
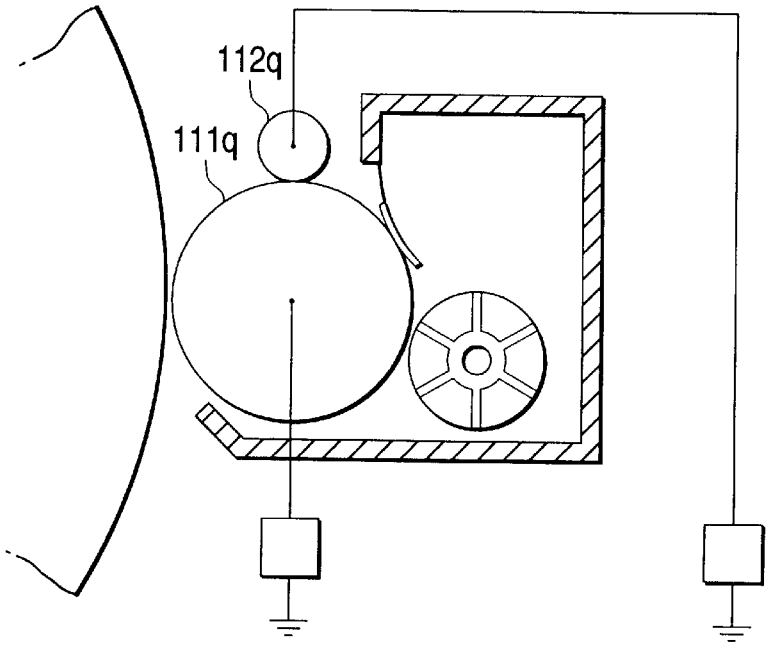
FIG. 49A PRIOR ART
FIGS. 49A and 49B are schematic representations illustrating another example of a conventionally-known photographic developing apparatus having the capability of electrifying toner.
Figure 49B:
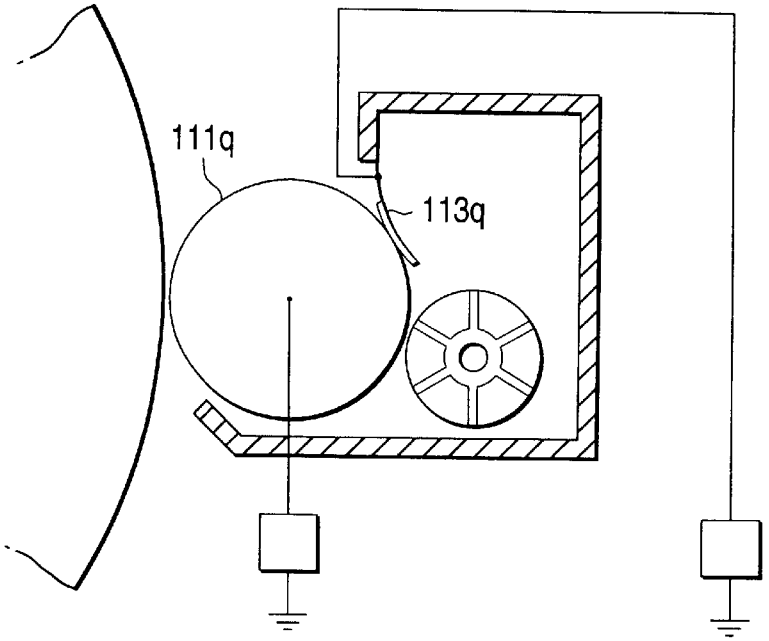
FIG. 49B PRIOR ART
Figure 50A:
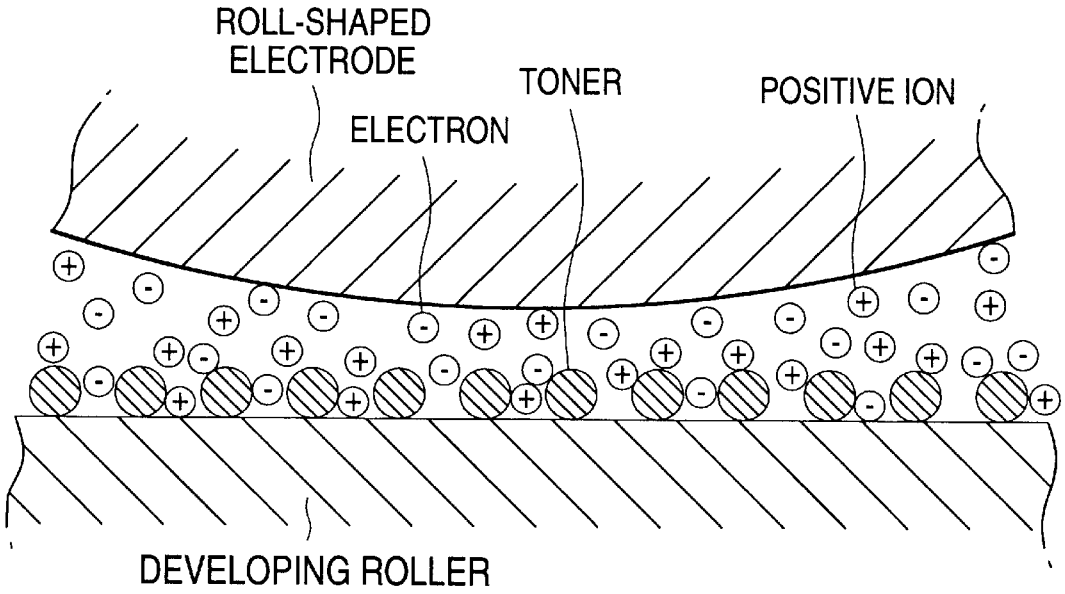
FIG. 50A PRIOR ART
FIGS. 50A and 50B are schematic representations for explaining the problems of an electrifying device used in the photographic developing apparatus shown in FIGS. 49A and 49B.
Figure 50B:
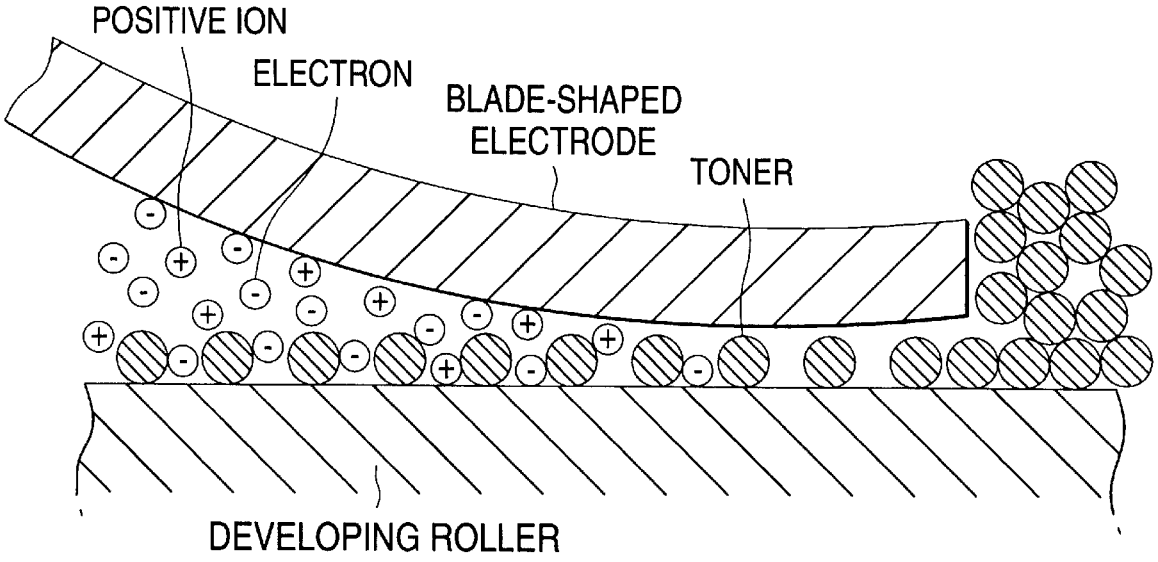
FIG. 50B PRIOR ART
Figure 51A:
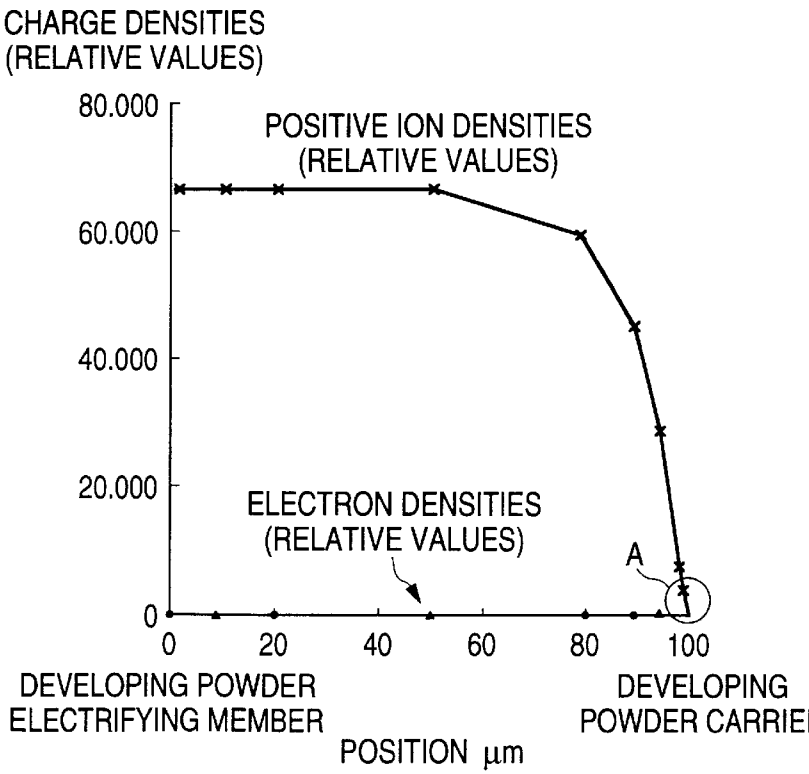
FIG. 51A PRIOR ART
FIGS. 51A and 51B are plots showing the charge density between an electric charge imparting member and a developing powder carrier of the electrifying device used by the photographic developing apparatus shown in FIGS. 49A and 49B.
Figure 51B:
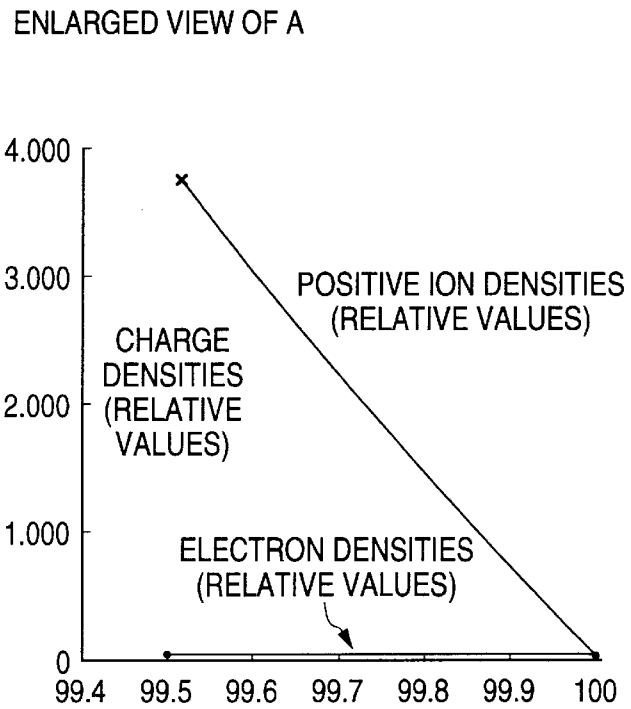
FIG. 51B PRIOR ART

FIGS. 47A and 47B are schematic representations illustrating an electrifying apparatus according to a fifth embodiment of the present invention.

In an electrifying apparatus 90*q*, first and second electrodes are formed by stacking thin metal layers and semi-conductive coating layers on an insulating substrate. Thin metal layers 91*q*, 92*q* are each formed into a comb-shaped pattern, and they are placed along the respective longitudinal sides of the substrate in a staggered pattern as if they mesh each other over the surface of the substrate. The metal layer 91*q* placed along one longitudinal side of the substrate is coated with a semi-conductive coating layer 93*q*. The thin metal layer 92*q* and the coating layer 93*q* which covers the thin metal layer 91*q* are arranged in parallel with and are spaced a uniform distance away from each other. These thin metal layers serve as first and second electrodes. In short, a voltage is applied to the semi-conductive coating layer 93*q* via the metal layer 91*q* placed below the coating layer 93*q* from a power source 94*q*. A voltage is applied to the other metal thin layer 92*q* from a power source 95*q*, and electric discharge is continually produced by the potential difference between the metal layers.

Even in this electrifying apparatus 90*q*, ionization is caused by the electric discharge developing between the electrodes stacked on a substrate 96*q*. Ions of desired polarity or electrons migrate toward an article to be electrified 97*q*, whereby the article placed on the substrate opposite the electrifying apparatus is electrified.

As has been described above, in the photographic developing apparatus of the present invention, both positive and negative ions occur by electric discharge occurring between a charge imparting member and an electrification control member. However, electron avalanche does not occur between the electrification control member and a developing powder carrier. Either positive or negative ions are attracted toward the developing powder carrier by the action of an electric field, enabling substantially uniform electrification of toner provided on the developing powder carrier.

The amount of electric charges of developing powder provided on the developing powder carrier is reduced by charge reducing means after the developing powder has passed through a developing area. The developing powder can be electrified substantially uniformly. For this reasons, if the developing powder remaining on the developing powder carrier after the developing treatment is repeatedly carried to the developing area, variations in the developing characteristics are prevented every cycle, enabling production of homogenous and high-quality pictures without ghosts. Further, leakage of electric charge and attachment of toner to the charge reducing means can be prevented by correctly setting a peak-to-peak voltage and a frequency of a.c. voltage to be applied to the charge reducing means.

Moreover, in an electrifying apparatus of the present invention, electric discharge is continually caused between first and second electrodes which are positioned so as to be opposite to each other. Of ions or electrons resulting from electron avalanche, only ions having a polarity with which an article is to be electrified or electrons migrate across an electric field developing between the first or second electrode and a substrate carrying an article to be developing, thereby imparting electric charge to the article. Accordingly, only ions or electrons having a predetermined polarity are brought into close proximity to the article, enabling electrification of the article with a desired polarity. For this reason, a thin layer of toner can be electrified with an appropriate polarity without producing toner of the opposite polarity. The first and second electrodes may be small electrodes, and they are spaced a small interval away from and opposite to the article while they remain in close proximity to each other. Consequently, the electrifying apparatus can be made compact.

What is claimed is:

1. A photographic developing apparatus which visualizes a latent image formed on an image carrier, said apparatus comprising:

a developing powder carrier provided so as to be opposite to said image carrier;

a layer forming member for forming a thin layer of developing powder over a circumferential surface of said developing powder carrier;

a charge imparting member which is provided so as to be opposite to said developing powder carrier and causes an electric field between said charge imparting member and said developing powder carrier; and an electrification control member which is interposed between said charge imparting member and said developing powder carrier, and limits an ionization area caused by electric discharge in the electric field by receiving an intermediate electric potential between an electric potential of said charge imparting member and an electric potential of said developing powder carrier.

2. The photographic developing apparatus of claim 1, wherein said electrification control member is one of a conductive mesh member and a semi-conductive mesh member.

3. The photographic developing apparatus of claim 1, wherein said electrification control member is one of a conductive plate member and a semi-conductive plate member having a plurality of pores.

4. The photographic developing apparatus of claim 1, wherein said electrification control member is formed by stacking one of a conductive layer and a semi-conductive layer on a surface of said charge imparting member via an insulating layer.

5. The photographic developing apparatus of claim 4, wherein said charge imparting member is supported so as to be integral with said layer forming member.

6. The photographic developing apparatus of claim 4, wherein said charge imparting member is a rotatable cylindrical member and is driven so as to differ from said developing powder carrier in terms of circumferential speed.

7. The photographic developing apparatus of claim 1, wherein the electric field caused by said charge imparting member and the electric potential imparted to said electrification control member are set so as to cause electric discharge between said charge imparting member and said electrification control member as well as to prevent electric discharge from occurring between said electrification control member and said developing powder carrier.

8. The photographic developing apparatus of claim 1, wherein one of said charge imparting member and said electrification control member is semi-conductive.

9. The photographic developing apparatus of claim 1, wherein said charge imparting member and said electrification control member are both either conductive or semi-conductive.

10. A photographic developing apparatus which visualizes a latent image formed on an image carrier, said apparatus comprising:

a developing powder carrier provided so as to be opposite to said image carrier;

a layer forming member for forming a thin layer of developing powder over a circumferential surface of said developing powder carrier;

a rotatable cylindrical charge imparting member which is provided so as to be opposite to said developing powder carrier and causes an electric field between said charge imparting member and said developing powder carrier; and an electrification control member which is a cylinder having a larger diameter than that of said charge imparting member; which houses said charge imparting member; which is supported so as to rotate in such a way that part of an internal circumferential surface of said electrification control member comes into contact with said charge imparting member at a position where said electrification control member is opposite to said developing powder carrier; and which limits an ionization area caused by electric discharge in the electric field by receiving an intermediate electric potential between an electric potential of said charge imparting member and an electric potential of said developing powder carrier.

11. The photographic developing apparatus of claim 10, wherein said electrification control member is one of a conductive mesh member and a semi-conductive mesh member.

12. The photographic developing apparatus of claim 10, wherein said electrification control member is one of a conductive plate member and a semi-conductive plate member having a plurality of pores.

13. The photographic developing apparatus of claim 10, wherein the electric field caused by said charge imparting member and the electric potential imparted to said electrification control member are set so as to cause electric discharge between said charge imparting member and said electrification control member as well as to prevent electric discharge from occurring between said electrification control member and said developing powder carrier.

14. The photographic developing apparatus of claim 10, wherein said electrification control member is sandwiched between said charge imparting member and said developing powder carrier, and is rotatively driven so as to follow the rotation of said developing powder carrier.

15. The photographic developing apparatus of claim 10, wherein said electrification control member is supported so as to be spaced away from said developing powder carrier, and is rotatively driven so as to differ from said developing powder carrier in terms of circumferential speed.

16. A photographic developing apparatus which visualizes a latent image formed on an image carrier, said apparatus comprising:

a developing powder carrier provided so as to be opposite to said image carrier;

a layer forming member for forming a thin layer of developing powder over a circumferential surface of said developing powder carrier;

an electrifying member which is provided so as to be opposite to said developing powder carrier and imparts electric charge to developing powder particles provided on said developing powder carrier; and a charge reducing means which reduces the amount of electric charge of said developing powder particles provided on the developing powder carrier; and which is positioned downstream from a developing area where said developing powder carrier is opposite to said image carrier in the direction of rotation of said developing powder carrier.

17. The photographic developing apparatus of claim 16, wherein said charge reducing means has at least one of conductive electrodes and semi-conductive electrodes, and an a.c. voltage is applied to these electrodes.

18. The photographic developing apparatus of claim 17, wherein a peak-to-peak voltage of the a.c. voltage is set so as to be more than twice as large as a discharge start voltage and to prevent leakage of electric charge.

19. The photographic developing apparatus of claim 17, wherein a frequency "f" of the a.c. voltage is set so as to exceed a frequency which allows toner to travel back and forth pursuant to the frequency f of the a.c. voltage.

20. The photographic developing apparatus of claim 16, wherein said charge reducing means doubles as said layer forming member;

a portion of said layer forming member which is in contact with said developing powder carrier is formed from semi-conductive resilient material; and an a.c. voltage is applied to this contact portion.

21. The photographic developing apparatus of claim 20, wherein a peak-to-peak voltage of the a.c. voltage is set so as to be more than twice as large as a discharge start voltage and to prevent leakage of electric charge.

22. The photographic developing apparatus of claim 20, wherein a frequency "f" of the a.c. voltage is set so as to exceed a frequency which allows toner to travel back and forth pursuant to the frequency f of the a.c. voltage.

23. The photographic developing apparatus of claim 16, wherein the electrifying member comprises:

a charge imparting member which is placed so as to be opposite to said developing powder carrier and produces an electric field between said charge imparting member and said developing powder carrier; and an electrification control member which is interposed between said charge imparting member and said developing powder carrier, and limits an ionization area caused by electric discharge in the electric field by receiving an intermediate electric potential between an electric potential of said charge imparting member and an electric potential of said developing powder carrier.

24. The photographic developing apparatus of claim 16, wherein said charge reducing means is pressed upstream in the direction of rotation of said developing powder carrier and doubles as a layer forming member which forms a thin layer of developing powder on said developing powder carrier;

a portion of said layer forming member which is in contact with said developing powder carrier is formed from semi-conductive resilient material;

an a.c. voltage is applied to this contact portion;

said electrifying member is formed by stacking one of a conductive layer and a semi-conductive layer on the surface of a charge imparting member via an insulating layer; and said charge imparting member is supported so as to be integral with said charge reducing means.

25. A photographic developing apparatus which visualizes a latent image formed on an image carrier, said apparatus comprising:

a developing powder carrier provided so as to be opposite to said image carrier;

a layer forming member for forming a thin layer of developing powder over a circumferential surface of said developing powder carrier;

a first electrode which is made of a resistor and is positioned so as to be opposite to said developing powder carrier;

a second electrode which is made of a resistor or conductor; which is positioned so as to be opposite to said developing powder carrier; and which is placed in close proximity to and in parallel with said first electrode without a contact; and a power source for applying a voltage between said first and second electrodes in such a way as to continually cause electric discharge between said first and second electrodes and to form an electric field which permits migration of electrons or ions having electric charge of a polarity, with which the developing powder provided on said developing powder carrier is electrified, from said first or second electrode to said developing powder carrier.

26. The photographic developing apparatus of claim 25, wherein said first and second electrodes are supported so as to be spaced a uniform interval away from and opposite to the circumferential surface of said developing powder carrier in the widthwise direction thereof.

27. The photographic developing apparatus of claim 25, wherein a feeding member which is made of conductive material and has a uniform thickness in the widthwise direction of the circumferential surface of said developing powder carrier, is provided on a reverse side of each of said first and second electrodes.

28. The photographic developing apparatus of claim 25, wherein said first and second electrodes are bonded together with an insertion member including an insulating material therebetween, and said insertion member whose end face is substantially flush with the ends of said first and second electrodes facing said developing powder carrier.

29. The photographic developing apparatus of claim 25, wherein said first and second electrodes are bonded together with an insertion member including an insulating material therebetween, and said insertion member whose end face is set back from the ends of said first and second electrodes facing said developing powder carrier.

30. The photographic developing apparatus of claim 25, wherein said first and second electrodes are made up of a plurality of electrodes which are provided so as to be spaced a uniform interval away from and opposite to the circumferential surface of said developing powder carrier.

31. The photographic developing apparatus of claim 25, wherein said first and second electrodes are made of conductive or resistive material stacked on an insulating board.

32. An electrifying apparatus which is positioned so as to be spaced away from and in proximity to an article to be electrified provided on a conductive substrate, and which applies an electric charge to the article, said apparatus comprising:

a first electrode which is made of a resistor and is positioned so as to be opposite to the substrate;

a second electrode which is made of a resistor or conductor, which is positioned so as to be opposite to the substrate, and which is placed in close proximity to and in parallel with said first electrode without a contact; wherein a D.C. voltage is applied so as to continually produce electric discharge between said first and second electrodes; and the electric potentials of said first and second electrodes are set in such a way that an electric field, which permits migration of electrons or ions having an electric charge of polarity with which the article is electrified toward the substrate, is formed between one of said first electrode and said second electrode, and said substrate, said first and second electrodes being placed so as to be in close proximity to and opposite to a belt or cylinder whose circumferential surface is endlessly movable, and being supported so as to be spaced a uniform interval away from and opposite to the circumferential surface in the widthwise direction thereof, with a feeding member including conductive material being provided on a reverse side of each of said first and second electrodes made of a resistor; and said second and first electrodes have a uniform thickness in the widthwise direction of the circumferential surface of said belt or cylinder.

33. The electrifying apparatus of claim 32, wherein said first and second electrodes are bonded together with an insertion member including an insulating material therebetween, and said insertion member whose end face is substantially flush with or set back from the ends of said first and second electrodes facing said developing powder carrier.

34. The electrifying apparatus of claim 32, wherein said first and second electrodes are made up of a plurality of electrodes which are spaced at an even interval away from the article in a distributed manner while one type of electrode is spaced a uniform interval away from the other type of electrode.

35. The electrifying apparatus of claim 32, wherein said first and second electrodes are made of conductive or resistive material stacked on an insulating board.

36. A photographic developing apparatus which visualizes a latent image formed on an image carrier, said apparatus comprising:

a developing powder carrier provided so as to be opposite to said image carrier;

a layer forming member for forming a thin layer of developing powder over a circumferential surface of said developing powder carrier;

a charge imparting member which is provided so as to be opposite to said developing powder carrier and causes an electric field between said charge imparting member and said developing powder carrier; wherein said charge imparting member comprises a first electrode which is made of a resistor and is positioned so as to be opposite to the developing powder carrier;

a second electrode which is made of a resistor or conductor, which is positioned so as to be opposite to the developing powder carrier; and which is placed in close proximity to and in parallel with said first electrode without a contact; wherein a voltage is applied so as to continually produce electric discharge between said first and second electrodes; and the electric potentials of said first and second electrodes are set in such a way that an electric field, which permits migration of electrons or ions having an electric charge of polarity with which the developing powder carrier is electrified toward the developing powder carrier, is formed between one of said first electrode and said second electrode, and said developing powder carrier.

* * * * *